US009675972B2

(12) United States Patent
Pollack et al.

(10) Patent No.: US 9,675,972 B2
(45) Date of Patent: Jun. 13, 2017

(54) METHOD OF CONCENTRATING BEADS IN A DROPLET

(75) Inventors: Michael G. Pollack, Durham, NC (US); Ramakrishna Sista, Morrisville, NC (US); Zhishan Hua, Cary, NC (US); Vamsee K. Pamula, Durham, NC (US); Arjun Sudarsan, Cary, NC (US); Vijay Srinivasan, Durham, NC (US); Prasanna Thwar, Morrisville, NC (US); Alexander Shenderov, Raleigh, NC (US); Dwayne Allen, Durham, NC (US)

(73) Assignee: ADVANCED LIQUID LOGIC, INC., San Diego, CA (US)

( * ) Notice: Subject to any disclaimer, the term of this patent is extended or adjusted under 35 U.S.C. 154(b) by 991 days.

(21) Appl. No.: 12/921,256

(22) PCT Filed: Mar. 9, 2009

(86) PCT No.: PCT/US2009/036449
§ 371 (c)(1),
(2), (4) Date: Dec. 17, 2010

(87) PCT Pub. No.: WO2009/111769
PCT Pub. Date: Sep. 11, 2009

(65) Prior Publication Data

US 2011/0104747 A1 May 5, 2011

Related U.S. Application Data

(63) Continuation-in-part of application No. 11/838,450, filed on Aug. 14, 2007, now Pat. No. 7,939,021,
(Continued)

(51) Int. Cl.
*B01L 3/00* (2006.01)
*B01L 3/02* (2006.01)
(Continued)

(52) U.S. Cl.
CPC ..... *B01L 3/0282* (2013.01); *B01F 13/002* (2013.01); *B01F 13/0023* (2013.01);
(Continued)

(58) Field of Classification Search
CPC B01F 13/002; B01F 13/0023; B01F 13/0071; B01F 13/0076; B01F 13/0818;
(Continued)

(56) References Cited

U.S. PATENT DOCUMENTS 4,127,460 A 11/1978 Gaske et al.
4,244,693 A 1/1981 Guon
(Continued)

FOREIGN PATENT DOCUMENTS

EP 1707965 * 4/2006 ..... G01N 35/10
JP 2006078225 A 3/2006
(Continued)

OTHER PUBLICATIONS

Weaver, Nicole. "Application of Magnetic Microspheres for Pyrosequencing on a Digital Microfluidic Platform". Department of Electrical and Computer Engineering, Duke University, p. 1-11, Aug. 2005.*
(Continued)

*Primary Examiner* — Melanie Y Brown

(57) ABSTRACT

Methods of concentrating beads in a droplet and/or loading beads on a fluidic device are provided, including among other things, a method of concentrating beads in a droplet, the method comprising: (a) providing a droplet actuator comprising: (i) an interior droplet operations volume; and (ii) a reservoir exterior to the interior volume; (iii) a droplet established in a liquid path extending from the reservoir into the interior volume; (b) providing magnetically responsive beads in the portion of the droplet which is in the reservoir; (c) magnetically attracting the magnetically responsive
(Continued)

beads through the liquid path into the portion of the droplet which is in the interior volume; and (d) forming a droplet comprising one or more of the magnetically responsive beads in the interior volume.

22 Claims, 23 Drawing Sheets

Related U.S. Application Data which is a continuation of application No. PCT/US2007/011298, filed on May 9, 2007.

(60) Provisional application No. 61/034,771, filed on Mar. 7, 2008, provisional application No. 61/047,789, filed on Apr. 25, 2008, provisional application No. 60/746,797, filed on May 9, 2006, provisional application No. 60/806,412, filed on Jun. 30, 2006.

(51) Int. Cl.

| | |
|---|---|
| ***B01F 13/00*** | (2006.01) |
| ***B01F 13/08*** | (2006.01) |
| ***B03C 1/01*** | (2006.01) |
| ***B03C 1/28*** | (2006.01) |

(52) U.S. Cl.

CPC ..... *B01F 13/0071* (2013.01); *B01F 13/0076* (2013.01); *B01F 13/0818* (2013.01); *B01L 3/502753* (2013.01); *B03C 1/01* (2013.01); *B03C 1/284* (2013.01); *B03C 1/286* (2013.01); *B01L 2200/0621* (2013.01); *B01L 2200/0631* (2013.01); *B01L 2200/0652* (2013.01); *B01L 2200/0668* (2013.01); *B01L 2200/141* (2013.01); *B01L 2300/0832* (2013.01); *B01L 2300/0864* (2013.01); *B01L 2300/0867* (2013.01); *B01L 2400/043* (2013.01); *B03C 2201/18* (2013.01); *B03C 2201/26* (2013.01); *B03C 2201/28* (2013.01); *Y10T 436/25* (2015.01)

(58) Field of Classification Search

CPC ..... B01L 3/0282; B01L 3/502753; B01L 2200/0621; B01L 2200/0631; B01L 2200/0652; B01L 2200/0668; B01L 2200/141; B01L 3/502; B01L 3/5027; B03C 1/01; B03C 1/284; B03C 1/286

USPC ..... 436/526

See application file for complete search history.

(56) References Cited

U.S. PATENT DOCUMENTS

| | | | |
|---|---|---|---|
| 4,636,785 | A | 1/1987 | Le Pesant |
| 5,038,852 | A | 8/1991 | Johnson et al. |
| 5,176,203 | A | 1/1993 | Larzul |
| 5,181,016 | A | 1/1993 | Lee et al. |
| 5,224,843 | A | 7/1993 | Van Lintel |
| 5,225,332 | A | 7/1993 | Weaver et al. |
| 5,266,498 | A | 11/1993 | Tarcha et al. |
| 5,455,008 | A | 10/1995 | Earley et al. |
| 5,472,881 | A | 12/1995 | Beebe et al. |
| 5,486,337 | A | 1/1996 | Ohkawa et al. |
| 5,498,392 | A | 3/1996 | Wilding et al. |
| 5,720,923 | A | 2/1998 | Haff et al. |
| 5,779,977 | A | 7/1998 | Haff et al. |
| 5,817,526 | A | 10/1998 | Kinoshita et al. |
| 5,827,480 | A | 10/1998 | Haff et al. |
| 5,945,281 | A | 8/1999 | Prabhu et al. |
| 5,998,224 | A | 12/1999 | Rohr et al. |
| 6,013,531 | A | 1/2000 | Wang et al. |
| 6,033,880 | A | 3/2000 | Haff et al. |
| 6,063,339 | A | 5/2000 | Tisone et al. |
| 6,130,098 | A | 10/2000 | Handique et al. |
| 6,152,181 | A | 11/2000 | Wapner et al. |
| 6,180,372 | B1 | 1/2001 | Franzen |
| 6,294,063 | B1 | 9/2001 | Becker et al. |
| 6,319,668 | B1 | 11/2001 | Nova et al. |
| 6,453,928 | B1 | 9/2002 | Kaplan et al. |
| 6,461,570 | B2 | 10/2002 | Ishihara et al. |
| 6,548,311 | B1 | 4/2003 | Knoll |
| 6,565,727 | B1 | 5/2003 | Shenderov |
| 6,632,655 | B1 | 10/2003 | Mehta et al. |
| 6,673,533 | B1 | 1/2004 | Wohlstadter et al. |
| 6,734,436 | B2 | 5/2004 | Faris et al. |
| 6,773,566 | B2 * | 8/2004 | Shenderov ..... 204/450 |
| 6,790,011 | B1 | 9/2004 | Le Pesant et al. |
| 6,841,128 | B2 | 1/2005 | Kambara et al. |
| 6,846,638 | B2 | 1/2005 | Shipwash |
| 6,911,132 | B2 | 6/2005 | Pamula et al. |
| 6,924,792 | B1 | 8/2005 | Jessop |
| 6,955,881 | B2 | 10/2005 | Tanaami |
| 6,977,033 | B2 | 12/2005 | Becker et al. |
| 6,989,234 | B2 | 1/2006 | Kolar et al. |
| 6,995,024 | B2 | 2/2006 | Smith et al. |
| 7,052,244 | B2 | 5/2006 | Fouillet et al. |
| 7,163,612 | B2 | 1/2007 | Sterling et al. |
| 7,189,359 | B2 | 3/2007 | Yuan et al. |
| 7,211,223 | B2 | 5/2007 | Fouillet et al. |
| 7,211,442 | B2 | 5/2007 | Gilbert et al. |
| 7,255,780 | B2 | 8/2007 | Shenderov |
| 7,267,752 | B2 | 9/2007 | King et al. |
| 7,328,979 | B2 | 2/2008 | Decre et al. |
| 7,329,545 | B2 | 2/2008 | Pamula et al. |
| 7,438,860 | B2 | 10/2008 | Takagi et al. |
| 7,439,014 | B2 | 10/2008 | Pamula et al. |
| 7,458,661 | B2 | 12/2008 | Kim et al. |
| 7,495,031 | B2 | 2/2009 | Sakuma et al. |
| 7,531,072 | B2 | 5/2009 | Roux et al. |
| 7,547,380 | B2 | 6/2009 | Velev |
| 7,556,776 | B2 | 7/2009 | Fraden et al. |
| 7,569,129 | B2 | 8/2009 | Pamula et al. |
| 7,579,172 | B2 | 8/2009 | Cho et al. |
| 7,641,779 | B2 | 1/2010 | Becker et al. |
| 7,727,466 | B2 | 6/2010 | Meathrel et al. |
| 7,727,723 | B2 | 6/2010 | Pollack et al. |
| 7,759,132 | B2 | 7/2010 | Pollack et al. |
| 7,763,471 | B2 | 7/2010 | Pamula et al. |
| 7,767,147 | B2 | 8/2010 | Adachi et al. |
| 7,767,435 | B2 | 8/2010 | Chiu et al. |
| 7,815,871 | B2 | 10/2010 | Pamula et al. |
| 7,816,121 | B2 | 10/2010 | Pollack et al. |
| 7,822,510 | B2 | 10/2010 | Paik et al. |
| 7,851,184 | B2 | 12/2010 | Pollack et al. |
| 7,875,160 | B2 | 1/2011 | Jary |
| 7,901,947 | B2 | 3/2011 | Pollack et al. |
| 7,919,330 | B2 | 4/2011 | De Guzman et al. |
| 7,922,886 | B2 | 4/2011 | Fouillet et al. |
| 7,939,021 | B2 | 5/2011 | Smith et al. |
| 7,943,030 | B2 | 5/2011 | Shenderov |
| 7,989,056 | B2 | 8/2011 | Plissonier et al. |
| 7,998,436 | B2 | 8/2011 | Pollack |
| 8,007,739 | B2 | 8/2011 | Pollack et al. |
| 8,041,463 | B2 | 10/2011 | Pollack et al. |
| 8,048,628 | B2 | 11/2011 | Pollack et al. |
| 8,075,754 | B2 | 12/2011 | Sauter-Starace et al. |
| 8,088,578 | B2 | 1/2012 | Hua et al. |
| 8,093,062 | B2 | 1/2012 | Winger et al. |
| 8,093,064 | B2 | 1/2012 | Shah et al. |
| 8,137,917 | B2 | 3/2012 | Pollack et al. |
| 8,147,668 | B2 | 4/2012 | Pollack et al. |
| 8,179,216 | B2 | 5/2012 | Knospe |
| 8,202,686 | B2 | 6/2012 | Pamula et al. |
| 8,208,146 | B2 | 6/2012 | Srinivasan et al. |
| 8,221,605 | B2 | 7/2012 | Pollack et al. |
| 8,236,156 | B2 | 8/2012 | Sarrut et al. |
| 8,268,246 | B2 | 9/2012 | Srinivasan et al. |
| 8,287,711 | B2 | 10/2012 | Pollack et al. |
| 8,292,798 | B2 | 10/2012 | Californniaa |
| 8,304,253 | B2 | 11/2012 | Yi et al. |

(56) References Cited

U.S. PATENT DOCUMENTS 8,313,698 B2 11/2012 Pollack et al.
8,317,990 B2 11/2012 Pamula et al.
8,337,778 B2 12/2012 Stone et al.
8,342,207 B2 1/2013 Raccurt et al.
8,349,276 B2 1/2013 Pamula et al.
8,364,315 B2 1/2013 Sturmer et al.
8,388,909 B2 3/2013 Pollack et al.
8,389,297 B2 3/2013 Pamula et al.
8,394,249 B2 3/2013 Pollack et al.
8,394,641 B2 3/2013 Winger
8,426,213 B2 4/2013 Eckhardt et al.
8,440,392 B2 5/2013 Pamula et al.
8,444,836 B2 5/2013 Fouillet et al.
2002/0001544 A1 1/2002 Hess et al.
2002/0005354 A1 1/2002 Spence et al.
2002/0036139 A1 3/2002 Becker et al.
2002/0043463 A1 4/2002 Shenderov
2002/0058332 A1 5/2002 Quake et al.
2002/0143437 A1 10/2002 Handique et al.
2003/0007898 A1 1/2003 Bohm et al.
2003/0049177 A1 3/2003 Smith et al.
2003/0164295 A1 9/2003 Sterling
2003/0170686 A1 9/2003 Hoet et al.
2003/0183525 A1 10/2003 Elrod et al.
2003/0205632 A1 11/2003 Kim et al.
2004/0031688 A1 2/2004 Shenderov
2004/0055871 A1 3/2004 Walton et al.
2004/0055891 A1 3/2004 Pamula et al.
2004/0058450 A1 3/2004 Pamula et al.
2004/0086870 A1 5/2004 Tyvoll et al.
2004/0101445 A1 5/2004 Shvets et al.
2004/0180346 A1 9/2004 Anderson et al.
2004/0209376 A1 10/2004 Natan et al.
2004/0231987 A1 11/2004 Sterling et al.
2005/0056569 A1 3/2005 Yuan et al.
2005/0179746 A1 8/2005 Roux et al.
2005/0189049 A1 9/2005 Ohno et al.
2005/0196746 A1* 9/2005 Xu et al. ..... 435/4
2005/0227349 A1 10/2005 Kim et al.
2005/0260686 A1 11/2005 Watkins
2005/0282224 A1 12/2005 Fouillet et al.
2006/0021875 A1 2/2006 Griffith et al.
2006/0039823 A1 2/2006 Yamakawa et al.
2006/0040375 A1 2/2006 Arney et al.
2006/0054503 A1 3/2006 Pamula et al.
2006/0102477 A1 5/2006 Vann et al.
2006/0164490 A1 7/2006 Kim et al.
2006/0186048 A1 8/2006 Tan
2006/0194331 A1 8/2006 Pamula et al.
2006/0210443 A1 9/2006 Stearns et al.
2006/0231398 A1 10/2006 Sarrut et al.
2007/0023292 A1 2/2007 Kim et al.
2007/0037294 A1 2/2007 Pamula et al.
2007/0045117 A1 3/2007 Pamula et al.
2007/0064990 A1 3/2007 Roth
2007/0075922 A1 4/2007 Jessop
2007/0086927 A1 4/2007 Natarajan et al.
2007/0179641 A1 8/2007 Lucas et al.
2007/0202538 A1 8/2007 Glezer et al.
2007/0207513 A1 9/2007 Sorensen et al.
2007/0217956 A1 9/2007 Pamula et al.
2007/0241068 A1 10/2007 Pamula et al.
2007/0242105 A1 10/2007 Srinivasan et al.
2007/0242111 A1 10/2007 Pamula et al.
2007/0243634 A1 10/2007 Pamula et al.
2007/0251885 A1 11/2007 Korpela et al.
2007/0267294 A1 11/2007 Shenderov
2007/0275415 A1 11/2007 Srinivasan et al.
2008/0003142 A1 1/2008 Link et al.
2008/0003588 A1 1/2008 Hasson et al.
2008/0006535 A1 1/2008 Paik et al.
2008/0023330 A1 1/2008 Viovy
2008/0038810 A1 2/2008 Pollack et al.
2008/0044893 A1 2/2008 Pollack et al.
2008/0044914 A1 2/2008 Pamula et al.
2008/0050834 A1 2/2008 Pamula et al.
2008/0053205 A1 3/2008 Pollack et al.
2008/0105549 A1 5/2008 Pamela et al.
2008/0113081 A1 5/2008 Hossainy et al.
2008/0124252 A1 5/2008 Marchand et al.
2008/0142376 A1 6/2008 Fouillet et al.
2008/0151240 A1 6/2008 Roth
2008/0166793 A1 7/2008 Beer et al.
2008/0210558 A1 9/2008 Sauter-Starace et al.
2008/0226500 A1 9/2008 Shikida et al.
2008/0247920 A1 10/2008 Pollack et al.
2008/0264797 A1 10/2008 Pamula et al.
2008/0274513 A1 11/2008 Shenderov et al.
2008/0281471 A1* 11/2008 Smith et al. ..... 700/266
2008/0283414 A1 11/2008 Monroe et al.
2008/0302431 A1 12/2008 Marchand et al.
2008/0305481 A1 12/2008 Whitman et al.
2009/0014394 A1 1/2009 Yi et al.
2009/0042319 A1 2/2009 De Guzman et al.
2009/0053726 A1 2/2009 Owen et al.
2009/0127123 A1 5/2009 Raccurt et al.
2009/0134027 A1 5/2009 Jary
2009/0142564 A1 6/2009 Plissonnier et al.
2009/0155902 A1 6/2009 Pollack et al.
2009/0191594 A1* 7/2009 Ohashi ..... C12P 19/34 435/91.2
2009/0192044 A1 7/2009 Fouillet
2009/0260988 A1 10/2009 Pamula et al.
2009/0263834 A1 10/2009 Sista et al.
2009/0280251 A1 11/2009 De Guzman et al.
2009/0280475 A1 11/2009 Pollack et al.
2009/0280476 A1 11/2009 Srinivasan et al.
2009/0283407 A1 11/2009 Shah et al.
2009/0288710 A1 11/2009 Viovy et al.
2009/0289213 A1* 11/2009 Pipper ..... B01J 20/28009 252/62.51 R
2009/0291433 A1 11/2009 Pollack et al.
2009/0304944 A1 12/2009 Sudarsan et al.
2009/0311713 A1 12/2009 Pollack et al.
2009/0321262 A1 12/2009 Adachi et al.
2010/0025242 A1 2/2010 Pamula et al.
2010/0025250 A1 2/2010 Pamula et al.
2010/0028920 A1 2/2010 Eckhardt
2010/0032293 A1 2/2010 Pollack et al.
2010/0041086 A1 2/2010 Pamula et al.
2010/0048410 A1 2/2010 Shenderov et al.
2010/0062508 A1 3/2010 Pamula et al.
2010/0068764 A1 3/2010 Sista et al.
2010/0087012 A1 4/2010 Shenderov et al.
2010/0096266 A1 4/2010 Kim et al.
2010/0116640 A1 5/2010 Pamula et al.
2010/0118307 A1 5/2010 Srinivasan et al.
2010/0120130 A1 5/2010 Srinivasan et al.
2010/0126860 A1 5/2010 Srinivasan et al.
2010/0130369 A1 5/2010 Shenderov et al.
2010/0140093 A1 6/2010 Pamula et al.
2010/0143963 A1 6/2010 Pollack
2010/0151439 A1 6/2010 Pamula et al.
2010/0190263 A1 7/2010 Srinivasan et al.
2010/0194408 A1 8/2010 Sturmer et al.
2010/0221713 A1 9/2010 Pollack et al.
2010/0236927 A1 9/2010 Pope et al.
2010/0236928 A1 9/2010 Srinivasan et al.
2010/0236929 A1 9/2010 Pollack et al.
2010/0258441 A1 10/2010 Sista et al.
2010/0270156 A1 10/2010 Srinivasan et al.
2010/0279374 A1 11/2010 Sista et al.
2010/0282608 A1 11/2010 Srinivasan et al.
2010/0282609 A1 11/2010 Pollack et al.
2010/0291578 A1 11/2010 Pollack et al.
2010/0307917 A1 12/2010 Srinivasan et al.
2010/0320088 A1 12/2010 Fouillet et al.
2010/0323405 A1 12/2010 Pollack et al.
2011/0086377 A1 4/2011 Thwar et al.
2011/0091989 A1 4/2011 Sista et al.
2011/0097763 A1 4/2011 Pollack et al.
2011/0100823 A1 5/2011 Pollack et al.
2011/0104725 A1 5/2011 Pamula et al.
2011/0104747 A1 5/2011 Pollack et al.

(56) References Cited

U.S. PATENT DOCUMENTS

| | | | |
|---|---|---|---|
| 2011/0104816 | A1 | 5/2011 | Pollack et al. |
| 2011/0114490 | A1 | 5/2011 | Pamula et al. |
| 2011/0118132 | A1 | 5/2011 | Winger et al. |
| 2011/0180571 | A1 | 7/2011 | Srinivasan et al. |
| 2011/0186433 | A1 | 8/2011 | Pollack et al. |
| 2011/0203930 | A1 | 8/2011 | Pamula et al. |
| 2011/0209998 | A1 | 9/2011 | Shenderov |
| 2011/0213499 | A1 | 9/2011 | Sturmer et al. |
| 2011/0303542 | A1 | 12/2011 | Srinivasan et al. |
| 2011/0311980 | A1 | 12/2011 | Pollack et al. |
| 2012/0018306 | A1 | 1/2012 | Srinivasan et al. |
| 2012/0132528 | A1 | 5/2012 | Shenderov et al. |
| 2012/0165238 | A1 | 6/2012 | Pamula et al. |
| 2013/0217583 | A1 | 8/2013 | Link et al. |
| 2013/0280131 | A1 | 10/2013 | Handique et al. |

FOREIGN PATENT DOCUMENTS

| | | | |
|---|---|---|---|
| JP | 2006329899 | A | 12/2006 |
| JP | 2006329904 | A | 12/2006 |
| JP | 2008096590 | A | 4/2008 |
| KR | 10-2007-0037432 | A | 4/2007 |
| WO | 0069565 | A1 | 11/2000 |
| WO | 0073655 | A1 | 12/2000 |
| WO | 2004011938 | A2 | 2/2004 |
| WO | 2004029585 | A1 | 4/2004 |
| WO | 2004030820 | | 4/2004 |
| WO | 2004073863 | A2 | 9/2004 |
| WO | 2005047696 | A1 | 5/2005 |
| WO | 2005069015 | A1 | 7/2005 |
| WO | 2006003292 | A1 | 1/2006 |
| WO | 2006013303 | A1 | 2/2006 |
| WO | 2006070162 | A1 | 7/2006 |
| WO | 2006081558 | | 8/2006 |
| WO | 2006085905 | A1 | 8/2006 |
| WO | 2006124458 | A2 | 11/2006 |
| WO | 2006127451 | A2 | 11/2006 |
| WO | 2006134307 | A1 | 12/2006 |
| WO | 2006138543 | | 12/2006 |
| WO | 2007003720 | A1 | 1/2007 |
| WO | 2007012638 | A1 | 2/2007 |
| WO | 2007033990 | A1 | 3/2007 |
| WO | 2007048111 | | 4/2007 |
| WO | 2007120240 | A2 | 10/2007 |
| WO | 2007120241 | A2 | 10/2007 |
| WO | 2007123908 | A2 | 11/2007 |
| WO | 2008051310 | A2 | 5/2008 |
| WO | 2008055256 | A3 | 5/2008 |
| WO | 2008068229 | A1 | 6/2008 |
| WO | 2008091848 | A2 | 7/2008 |
| WO | 2008098236 | A2 | 8/2008 |
| WO | 2008101194 | A2 | 8/2008 |
| WO | 2008106678 | A1 | 9/2008 |
| WO | 2008109664 | A1 | 9/2008 |
| WO | 2008112856 | A1 | 9/2008 |
| WO | 2008116209 | A1 | 9/2008 |
| WO | 2008116221 | A1 | 9/2008 |
| WO | 2008118831 | A2 | 10/2008 |
| WO | 2008124846 | A2 | 10/2008 |
| WO | 2008131420 | A2 | 10/2008 |
| WO | 2008134153 | A1 | 11/2008 |
| WO | 2009002920 | A1 | 12/2008 |
| WO | 2009003184 | A1 | 12/2008 |
| WO | 2009011952 | A1 | 1/2009 |
| WO | 2009021173 | A1 | 2/2009 |
| WO | 2009021233 | A2 | 2/2009 |
| WO | 2009026339 | A2 | 2/2009 |
| WO | 2009029561 | A2 | 3/2009 |
| WO | 2009032863 | A2 | 3/2009 |
| WO | 2009052095 | A1 | 4/2009 |
| WO | 2009052123 | A2 | 4/2009 |
| WO | 2009052321 | A2 | 4/2009 |
| WO | 2009052345 | A1 | 4/2009 |
| WO | 2009052348 | A2 | 4/2009 |
| WO | 2009076414 | | 6/2009 |
| WO | 2009086403 | A2 | 7/2009 |
| WO | 2009111769 | A2 | 9/2009 |
| WO | 2009135205 | A2 | 11/2009 |
| WO | 2009137415 | A2 | 11/2009 |
| WO | 2009140373 | A2 | 11/2009 |
| WO | 2009140671 | A2 | 11/2009 |
| WO | 2010006166 | A2 | 1/2010 |
| WO | 2010009463 | A2 | 1/2010 |
| WO | 2010019782 | A2 | 2/2010 |
| WO | 2010027894 | A2 | 3/2010 |
| WO | 2010042637 | A2 | 4/2010 |
| WO | 2010077859 | A3 | 7/2010 |

OTHER PUBLICATIONS

Shah et al. Meniscus-assisted magnetic bead trapping on EWOD-based digital microfluidics for specific protein localization, Jun. 2007, Transducers&Eurosensors, pp. 707-710.*

Y. Wang et al., "Efficient in-droplet separation of magnetic particles for digital microfluidics," Journal of Micromechanics and Microengineering, vol. 17, pp. 2148-2156 (2007).

PCT International Search Report and Written Opinion for PCT/US2009/036449 dated Oct. 20, 2009.

Chakrabarty, "Automated Design of Microfluidics-Based Biochips: connecting Biochemistry of Electronics CAD", IEEE International Conference on Computer Design, San Jose, CA, Oct 1-4, 2006, 93-100.

Chakrabarty et al., "Design Automation Challenges for Microfluidics-Based Biochips", DTIP of MEMS & MOEMS, Montreux, Switzerland, Jun. 1-3, 2005.

Chakrabarty et al., "Design Automation for Microfluidics-Based Biochips", ACM Journal on Engineering Technologies in Computing Systems , 1(3), Oct. 2005, 186-223.

Chakrabarty, "Design, Testing, and Applications of Digital Microfluidics-Based Biochips", Proceedings of the 18th International Conf. on VLSI held jointly with 4th International Conf. on Embedded Systems Design (VLSID'05), IEEE, Jan. 3-7, 2005.

Chen et al., "Development of Mesoscale Actuator Device with Micro Interlocking Mechanism", J. Intelligent Material Systems and Structures, vol. 9, No. 4, Jun. 1998, pp. 449-457.

Chen et al., "Mesoscale Actuator Device with Micro Interlocking Mechanism", Proc. IEEE Micro Electro Mechanical Systems Workshop, Heidelberg, Germany, Jan. 1998, pp. 384-389.

Chen et al., "Mesoscale Actuator Device: Micro Interlocking Mechanism to Transfer Macro Load", Sensors and Actuators, vol. 73, Issues 1-2, Mar. 1999, pp. 30-36.

Cotten et al., "Digital Microfluidics: a novel platform for multiplexed detection of lysosomal storage diseases", Abstract # 3747.9. Pediatric Academic Society Conference, 2008.

Delattre, Movie in news on TF1 (at 12'45" Cyril Delattre), http://videos.tf1.fr/jt-we/zoom-sur-grenoble-6071525.html, 2009.

Delattre, Movie in talk show "C Dans l'air" (at 24" Cyril Delattre), http://www.france5.fr/c-dans-l-air/sante/bientot-vous-ne-serez-plus-malade-31721, 2009.

Delattre, Movie on Web TV—Cite des sciences (at 3'26" Cyril Delattre), http://www.universcience.tv/video-laboratoire-de-poche-793.html, 2009.

Delattre et al., "Towards an industrial fabrication process for electrowetting chip using standard MEMS Technology", μTAS2008, San Diego; poster presented, Oct. 15, 2008.

Delattre et al., "Towards an industrial fabrication process for electrowetting chip using standard MEMS Technology", μTAS2008, San Diego; Abstract in proceedings, Oct. 13-16, 2008, 1696-1698.

Dewey, "Towards a Visual Modeling Approach to Designing Microelectromechanical System Transducers", Journal of Micromechanics and Microengineering, vol. 9, Dec. 1999, 332-340.

Dewey et al., "Visual modeling and design of microelectromechanical system tansducers", Microelectronics Journal, vol. 32, Apr. 2001, 373-381.

Fair et al., "A Micro-Watt Metal-Insulator-Solution-Transport (MIST) Device for Scalable Digital Bio-Microfluidic Systems", IEEE IEDM Technical Digest, 2001, 16.4.1-4.

(56) References Cited

OTHER PUBLICATIONS

Fair et al., "Advances in droplet-based bio lab-on-a-chip", BioChips 2003, Boston, 2003.
Fair et al., "Bead-Based and Solution-Based Assays Performed on a Digital Microfluidic Platform", Biomedical Engineering Society (BMES) Fall Meeting, Baltimore, MD, Oct. 1, 2005.
Fair, "Biomedical Applications of Electrowetting Systems", 5th International Electrowetting Workshop, Rochester, NY, May 31, 2006.
Fair et al., "Chemical and Biological Applications of Digital-Microfluidic Devices", IEEE Design & Test of Computers, vol. 24(1), Jan.-Feb. 2007, 10-24.
Fair et al., "Chemical and biological pathogen detection in a digital microfluidic platform", DARPA Workshop on Microfluidic Analyzers for DoD and National Security Applications, Keystone, CO, 2006.
Fair, "Digital microfluidics: is a true lab-on-a-chip possible?", Microfluid Nanofluid, vol. 3, Mar. 8, 2007, 245-281.
Fair, "Droplet-based microfluidic Genome sequencing", NHGRI PI's meeting, Boston, 2005.
Fair et al., "Electrowetting-based On-Chip Sample Processing for Integrated Microfluidics", IEEE Inter. Electron Devices Meeting (IEDM), 2003, 32.5.1-32.5.4.
Fair et al., "Integrated chemical/biochemical sample collection, pre-concentration, and analysis on a digital microfluidic lab-on-a-chip platform", Lab-on-a-Chip: Platforms, Devices, and Applications, Conf. 5591, SPIE Optics East, Philadelphia, Oct. 25-28, 2004.
Fair, "Scaling of Digital Microfluidic Devices for Picoliter Applications", The 6th International Electrowetting Meeting, Aug. 20-22, 2008, p. 14.
Fouillet, "Bio-Protocol Integration in Digital Microfluidic Chips", The 6th International Electrowetting Meeting, Aug. 20-22, 2008, p. 15.
Fouillet et al., "Design and Validation of a Complex Generic Fluidic Microprocessor Based on EWOD Droplet for Biological Applications", 9th International Conference on Miniaturized Systems for Chem and Life Sciences, Boston, MA, Oct. 9-13, 2005, 58-60.
Fouillet et al., "Digital microfluidic design and optimization of classic and new fluidic functions for lab on a chip systems", Microfluid Nanofluid, vol. 4, 2008, 159-165.
Hua et al., "Rapid Detection of Methicillin-Resistant *Staphylococcus aureus* (MRSA) Using Digital Microfluidics", 12th Intl Conference on Miniaturized Systems for Chemistry and Life Sciences, Proc. μTAS, Oct. 12-16, 2008.
Jun et al., "Valveless Pumping using Traversing Vapor Bubbles in Microchannels", J. Applied Physics, vol. 83, No. 11, Jun. 1998, pp. 5658-5664.
Kim et al., "MEMS Devices Based on the Use of Surface Tension", Proc. Int. Semiconductor Device Research Symposium (ISDRS'99), Charlottesville, VA, Dec. 1999, pp. 481-484.
Kim, "Microelectromechanical Systems (MEMS) at the UCLA Micromanufacturing Lab", Dig. Papers, Int. Microprocesses and Nanotechnology Conf. (MNC'98), Kyungju, Korea, Jul. 1998, pp. 54-55.
Kim et al., "Micromachines Driven by Surface Tension", AIAA 99-3800, 30th AIAA Fluid Dynamics Conference, Norfolk, VA, (Invited lecture), Jun. 1999, pp. 1-6.
Kleinert et al., "Electric Field-Assisted Convective Assembly of Large-Domain Colloidal Crystals", The 82nd Colloid & Surface Science Symposium, ACS Division of Colloid & Surface Science, North Carolina State University, Raleigh, NC. www.colloids2008.org., Jun. 15-18, 2008.
Lee et al., "Microactuation by Continuous Electrowetting Phenomenon and Silicon Deep Rie Process", Proc. MEMS (DSC—vol. 66) ASME Int. Mechanical Engineering Congress and Exposition, Anaheim, CA, Nov. 1998, 475-480.
Lee et al., "Liquid Micromotor Driven by Continuous Electrowetting", Proc. IEEE Micro Electro Mechanical Systems Workshop, Heidelberg, Germany, Jan. 1998, pp. 538-543.
Lee et al., "Theory and Modeling of Continuous Electrowetting Microactuation", Proc. MEMS (MEMS—vol. 1), ASME Int. Mechanical Engineering Congress and Exposition, Nashville, TN, Nov. 1999, pp. 397-403.
Marchand et al., "Organic Synthesis in Soft Wall-Free Microreactors: Real-Time Monitoring of Fluorogenic Reactions", Analytical Chemistry, vol. 80, Jul. 2, 2008, 6051-6055.
Millington et al., "Digital Microfluidics: a novel platform for multiplexed detection of LSDs with potential for newborn screening", Association of Public Health Laboratories Annual Conference, San Antonio, TX, Nov. 4, 2008.
Millington et al., "Digital Microfluidics: A Novel Platform for Multiplexing Assays Used in Newborn Screening", Proceedings of the7th International and Latin American Congress. Oral Presentations. Rev Invest Clin; vol. 61 (Supl. 1), 2009, 21-33.
Paik et al., "A digital-microfluidic approach to chip cooling", IEEE Design & Test of Computers, vol. 25, Jul. 2008, 372-381.
Paik et al., "Adaptive Cooling of Integrated Circuits Using Digital Microfluidics", IEEE Transactions on VLSI, vol. 16, No. 4, 2008, 432-443.
Paik et al., "Adaptive Cooling of Integrated Circuits Using Digital Microfluidics", accepted for publication in IEEE Transactions on VLSI Systems, 2007, and Artech House, Norwood, MA, 2007.
Paik, "Adaptive Hot-Spot Cooling of Integrated Circuits Using Digital Microfluidics", Dissertation, Dept. of Electrical and Computer Engineering, Duke University, Apr. 25, 2006, 1-188.
Paik et al., "Adaptive hot-spot cooling of integrated circuits using digital microfluidics", Proceedings ASME International Mechanical Engineering Congress and Exposition, Orlando, Florida, USA. IMECE2005-81081, Nov. 5-11, 2005, 1-6.
Paik et al., "Coplanar Digital Microfluidics Using Standard Printed Circuit Board Processes", 9th International Conference on Miniaturized Systems for Chemistry and Life Sciences (MicroTAS), Boston, MA; Poster, 2005.
Paik et al., "Coplanar Digital Microfluidics Using Standard Printed Circuit Board Processes", 9th Int'l Conf. on Miniaturized Systems for Chemistry and Life Sciences, Boston, MA, Oct. 9-13, 2005, 566-68.
Paik et al., "Droplet-Based Hot Spot Cooling Using Topless Digital Microfluidics on a Printed Circuit Board", Int'l Workshops on Thermal Investigations of ICs and Systems (THERMINIC), 2005, 278-83.
Paik et al., "Electrowetting-based droplet mixers for microfluidic systems", Lab on a Chip (LOC), vol. 3. (more mixing videos available, along with the article, at LOC's website), 2003, 28-33.
Paik et al., "Programmable Flow-Through Real Time PCR Using Digital Microfluidics", 11th International Conference on Miniaturized Systems for Chemistry and Life Sciences, Paris, France, Oct. 7-11, 2007, 1559-1561.
Paik et al., "Programmable flow-through real-time PCR using digital microfluidics", Proc. Micro Total Analysis Systems (μTAS), Handout, 2007.
Paik et al., "Programmable flow-through real-time PCR using digital microfluidics", Proc. Micro Total Analysis Systems (μTAS), Poster, 2007.
Paik et al., "Rapid Droplet Mixers for Digital Microfluidic Systems", Masters Thesis, Duke Graduate School., 2002, 1-82.
Paik et al., "Rapid droplet mixers for digital microfluidic systems", Lab on a Chip, vol. 3. (More mixing videos available, along with the article, at LOC's website.), 2003, 253-259.
Paik et al., "Thermal effects on Droplet Transport in Digital Microfluids with Application to Chip Cooling Processing for Integrated Microfluidics", International Conference on Thermal, Mechanics, and Thermomechanical Phenomena in Electronic Systems (ITherm), 2004, 649-654.
Pamula, "A digital microfluidic platform for multiplexed explosive detection", Chapter 18, Electronics Noses and Sensors for the Detection of Explosives, Eds., J.W. Gardner and J. Yinon, Kluwer Academic Publishers, 2004.
Pamula et al., "A droplet-based lab-on-a-chip for colorimetric detection of nitroaromatic explosives", Proceedings of Micro Electro Mechanical Systems, 2005, 722-725.

(56) References Cited

OTHER PUBLICATIONS

Pamula et al., "Cooling of integrated circuits using droplet-based microfluidics", Proc. ACM Great Lakes Symposium on VLSI, Apr. 2003, 84-87.
Pamula et al., "Digital microfluidic lab-on-a-chip for protein crystallization", 5th Protein Structure Initiative "Bottlenecks" Workshop, NIH, Bethesda, MD, Apr. 13-14, 2006, I-16.
Pamula et al., "Digital Microfluidics Platform for Lab-on-a-chip applications", Duke University Annual Post Doctoral Research Day, 2002.
Pamula et al., "Microfluidic electrowetting-based droplet mixing", IEEE, 2002, 8-10.
Pollack, et al., "Electrowetting-Based Actuation of Droplets for Integrated Microfluidics", Lab on a Chip (LOC), vol. 2, 2002, 96-101.
Pollack et al., "Electrowetting-based actuation of liquid droplets for microfluidic applications", Appl. Phys. Letters, vol. 77, No. 11, Sep. 11, 2000, 1725-1726.
Pollack, "Electrowetting-based Microactuation of Droplets for Digital Microfluidics", PhD Thesis, Department of Electrical and Computer Engineering, Duke University, 2001.
Pollack et al., "Electrowetting-Based Microfluidics for High-Throughput Screening", smallTalk 2001 Conference Program Abstract, San Diego, Aug. 27-31, 2001, 149.
Pollack et al., "Investigation of electrowetting-based microfluidics for real-time PCR applications", Proc. 7th Int'l Conference on Micro Total Analysis Systems (mTAS), Squaw Valley, CA, Oct. 5-9, 2003, 619-622.
Pollack, "Lab-on-a-chip platform based digital microfluidics", The 6th International Electrowetting Meeting, Aug. 20-22, 2008, 16.
Ren et al., "Automated electrowetting-based droplet dispensing with good reproducibility", Proc. Micro Total Analysis Systems (mTAS), 7th Int. Conf.on Miniaturized Chem and Biochem Analysis Systems, Squaw Valley, CA, Oct. 5-9, 2003, 993-996.
Ren et al., "Automated on-chip droplet dispensing with volume control by electro-wetting actuation and capacitance metering", Sensors and Actuators B: Chemical, vol. 98, Mar. 2004, 319-327.
Ren et al., "Design and testing of an interpolating mixing architecture for electrowetting-based droplet-on-chip chemical dilution", Transducers, 12th International Conference on Solid-State Sensors, Actuators and Microsystems, 2003, 619-622.
Ren et al., "Dynamics of electro-wetting droplet transport", Sensors and Actuators B (Chemical), vol. B87, No. 1, Nov. 15, 2002, 201-206.
Ren et al., "Micro/Nano Liter Droplet Formation and Dispensing by Capacitance Metering and Electrowetting Actuation", IEEE-NANO, 2002, 369-372.
Rival et al., "Towards Single Cells Gene Expression on EWOD Lab on Chip", ESONN 2008, Grenoble, France; Poster presented, Aug. 26, 2008.
Rival et al., "Towards single cells gene expression on EWOD lab on chip", ESONN, Grenoble, France, abstract in proceedings, Aug. 2008.
Rouse et al., "Digital microfluidics: a novel platform for multiplexing assays used in newborn screening", Poster 47, 41st AACC's Annual Oak Ridge Conference Abstracts, Clinical Chemistry, vol. 55, 2009, 1891.
Sherman et al., "Flow Control by Using High-Aspect-Ratio, In-Plane Microactuators", Sensors and Actuators, vol. 73, 1999, pp. 169-175.
Sherman et al., "In-Plane Microactuator for Fluid Control Application", Proc. IEEE Micro Electro Mechanical Systems Workshop, Heidelberg, Germany, Jan. 1998, pp. 454-459.
Sista et al., "96-Immunoassay Digital Microfluidic Multiwell Plate", Proc. μTAS, Oct. 12-16, 2008.
Sista, "Development of a Digital Microfluidic Lab-on-a-Chip for Automated Immunoassays with Magnetically Responsive Beads", PhD Thesis, Department of Chemical Engineering, Florida State University, 2007.
Sista et al., "Development of a digital microfluidic platform for point of care testing", Lab on a chip, vol. 8, Dec. 2008, First published as an Advance Article on the web, Nov. 5, 2008, 2091-2104.
Sista et al., "Heterogeneous immunoassays using magnetic beads on a digital microfluidic platform", Lab on a Chip, vol. 8, Dec. 2008, First published as an Advance Article on the web, Oct. 14, 2008, 2188-2196.
Sista et al., "Spatial multiplexing of immunoassays for small-volume samples", 10th PI Meeting IMAT, Bethesda, 2009.
Srinivasan et al., "3-D imaging of moving droplets for microfluidics using optical coherence tomography", Proc. 7th International Conference on Micro Total Analysis Systems (mTAS), Squaw Valley, CA, Oct. 5-9, 2003, 1303-1306.
Srinivasan et al., "A digital microfluidic biosensor for multianalyte detection", Proc. IEEE 16th Annual Int'l Conf. on Micro Electro Mechanical Systems Conference, 2003, 327-330.
Srinivasan, "A Digital Microfluidic Lab-on-a-Chip for Clinical Diagnostic Applications", Ph.D. thesis, Dept of Electrical and Computer Engineering, Duke University, 2005.
Srinivasan et al., "An integrated digital microfluidic lab-on-a-chip for clinical diagnostics on human physiological fluids", Lab on a Chip, vol. 4, 2004, 310-315.
Srinivasan et al., "Clinical diagnostics on human whole blood, plasma, serum, urine, saliva, sweat and tears on a digital microfluidic platform", Proc. 7th International Conference on Micro Total Analysis Systems (mTAS), Squaw Valley, CA, Oct. 5-9, 2003, 1287-1290.
Srinivasan et al., "Digital Microfluidic Lab-on-a-Chip for Protein Crystallization", The 82nd ACS Colloid and Surface Science Symposium, 2008.
Srinivasan et al., "Digital Microfluidics: a novel platform for multiplexed detection of lysosomal storage diseases for newborn screening", AACC Oak Ridge Conference Abstracts, Clinical Chemistry, vol. 54, 2008, 1934.
Srinivasan et al., "Droplet-based microfluidic lab-on-a-chip for glucose detection", Analytica Chimica Acta, vol. 507, No. 1, 2004, 145-150.
Srinivasan et al., "Protein Stamping for MALDI Mass Spectrometry Using an Electrowetting-based Microfluidic Platform", Lab-on-a-Chip: Platforms, Devices, and Applications, Conf. 5591, SPIE Optics East, Philadelphia, Oct. 25-28, 2004.
Srinivasan et al., "Scalable Macromodels for Microelectromechanical Systems", Technical Proc. 2001 Int. Conf. on Modeling and Simulation of Microsystems, 2001, 72-75.
Su et al., "Yield Enhancement of Digital Microfluidics-Based Biochips Using Space Redundancy and Local Reconfiguration", Proc. Design, Automation and Test in Europe (Date) Conf., IEEE, 2005, 1196-1201.
Sudarsan et al., "Printed circuit technology for fabrication of plastic based microfluidic devices", Analytical Chemistry vol. 76, No. 11, Jun. 1, 2004, Previously published on-line, May 2004, 3229-3235.
Wang et al., "Droplet-based micro oscillating-flow PCR chip", J. Micromechanics and Microengineering, vol. 15, 2005, 1369-1377.
Xu et al., "A Cross-Referencing-Based Droplet Manipulation Method for High-Throughput and Pin-Constrained Digital Microfluidic Arrays", Proceedings of conference on Design, Automation and Test in Europe, Apr. 2007.
Xu et al., "Automated Design of Pin-Constrained Digital Microfluidic Biochips Under Droplet-Interference Constraints", ACM Journal on Emerging Technologies is Computing Systems, vol. 3(3), 2007, 14:1-14:23.
Xu et al., "Automated solution preparation on a digital microfluidic lab-on-chip", PSI Bottlenecks Workshop, 2008.
Xu et al., "Automated, Accurate and Inexpensive Solution-Preparation on a Digital Microfluidic Biochip", Proc. IEEE Biomedical Circuits and Systems Conference (BioCAS), 2008, 301-304.
Xu et al., "Defect-Aware Synthesis of Droplet-Based Microfluidic Biochips", IEEE, 20th International Conference on VLSI Design, 2007.

(56) References Cited

OTHER PUBLICATIONS

Xu et al., "Design and Optimization of a Digital Microfluidic Biochip for Protein Crystallization", Proc. IEEE/ACM International Conference on Computer-Aided Design (ICCAD), Nov. 2008, 297-301.
Xu et al., "Digital Microfluidic Biochip Design for Protein Crystallization", IEEE-NIH Life Science Systems and Applications Workshop, LISA, Bethesda, MD, Nov. 8-9, 2007, 140-143.
Xu et al., "Droplet-Trace-Based Array Partitioning and a Pin Assignment Algorithm for the Automated Design of Digital Microfluidic Biochips", CODES, 2006, 112-117.
Xu et al., "Integrated Droplet Routing in the Synthesis of Microfluidic Biochips", IEEE, 2007, 948-953.
Xu et al., "Parallel Scan-Like Test and Multiple-Defect Diagnosis for Digital Microfluidic Biochips", IEEE Transactions on Biomedical Circuits and Systems, vol. 1(2), Jun. 2007, 148-158.
Xu et al., "Parallel Scan-Like Testing and Fault Diagnosis Techniques for Digital Microfluidic Biochips", Proceedings of the 12th IEEE European Test Symposium (ETS), Freiburg, Germany, May 20-24, 2007, 63-68.
Yao et al., "Spot Cooling Using Thermoelectric Microcooler", Proc. 18th Int. Thermoelectric Conf, Baltimore, VA, pp. 256-259, Aug. 1999.
Yi et al., "Channel-to-droplet extractions for on-chip sample preparation", Solid-State Sensor, Actuators and Microsystems Workshop (Hilton Head '06), Hilton Head Island, SC, Jun. 2006, 128-131.
Yi et al., "Characterization of electrowetting actuation on addressable single-side coplanar electrodes", Journal of Micromechanics and Microengineering, vol. 16.,Oct. 2006, 2053-2059.
Yi et al., "EWOD Actuation with Electrode-Free Cover Plate", Digest of Tech. papers,13th International Conference on Solid-State Sensors, Actuators and Microsystems (Transducers '05), Seoul, Korea, Jun. 5-9, 2005, 89-92.
Yi et al., "Geometric surface modification of nozzles for complete transfer of liquid drops", Solid-State Sensor, Actuator and Microsystems Workshop, Hilton Head Island, South Carolina, Jun. 6-10, 2004, 164-167.
Yi, "Soft Printing of Biological Liquids for Micro-arrays: Concept, Principle, Fabrication, and Demonstration", Ph.D. dissertation, UCLA, 2004.
Yi et al., "Soft Printing of Droplets Digitized by Electrowetting", Transducers 12th Int'l Conf. on Solid State Sensors, Actuators and Microsystems, Boston, Jun. 8-12, 2003, 1804-1807.
Yi et al., "Soft Printing of Droplets Pre-Metered by Electrowetting", Sensors and Actuators A: Physical, vol. 114, Jan. 2004, 347-354.
Zeng et al., "Actuation and Control of Droplets by Using Electrowetting-on-Dielectric", Chin. Phys. Lett., vol. 21(9), 2004, 1851-1854.
Zhao et al., "Droplet Manipulation and Microparticle Sampling on Perforated Microfilter Membranes", J. Micromech. Microeng., vol. 18, 2008, 1-11.
Zhao et al., "In-droplet particle separation by travelling wave dielectrophoresis (twDEP) and EWOD", Solid-State Sensor, Actuators and Microsystems Workshop (Hilton Head '06), Hilton Head Island, SC, Jun. 2006, 181-184.
Zhao et al., "Micro air bubble manipulation by electrowetting on dielectric (EWOD): transporting, splitting, merging and eliminating of bubbles", Lab on a chip, vol. 7, 2007, First published as an Advance Article on the web, Dec. 4, 2006, 273-280.
Zhao et al., "Microparticle Concentration and Separation by Traveling-Wave Dielectrophoresis (twDEP) for Digital Microfluidics", J. Microelectromechanical Systems, vol. 16, No. 6, Dec. 2007, 1472-1481.
Weaver, "Application of Magnetic Microspheres for Pyrosequencing on a Digital Microfluidic Platform", Department of Electrical and Computer Engineering, Duke University, 2005.
International Preliminary Report on Patentability dated Sep. 7, 2010 from PCT International Application No. PCT/US2009/036449.
Binks, "Wetting: theory and experiment", Current Opinion in Colloids and Interface Science, vol. 6, No. 1, 17-21, 2001.
Chamberlain, et al., "Deletion screening of Duchenne musular dystrophy locus via multiplex DNA amplification", Nuc. Acid. Res. 16, pp. 11141-11156, 1988.
Cho, et al., "Concentration and binary separation of micro particles for droplet-based digital microfluidics", Lab Chip, vol. 7, 490-498, 2007.
Dorfman, et al., "Contamination-Free Continuouse Flow Microfluidic Polymerase Chain Reaction for Quantitative and Clinical Applications", Analytical Chemistry 77, 3700-3704, 2005.
Fowler, "Labon-on-a-Chip Technology May Present New ESD Challenges", Electrostatic Discharge (ESD) Journal. Retrieved on Apr. 18, 2008 from:http://www.esdjournal.com/articles/labchip/Lab.htm., Mar. 2002.
Gijs, Mam, "Magnetic bead handling on-chip:new opportunities for analytical applications", Microfluidics and Nanofluidics, vol. 1, 22-40, Oct. 2, 2004.
Huang, et al., "MEMS-based sample preparation for molecular diagnostics", Analytical and Bioanalytical Chemistry, vol. 372, 49-65, 2002.
Jones, et al., "Dielectrophoretic liquid actuation and nanodroplet formation", J. Appl. Phys., vol. 89, No. 2, 1441-1448, Jan. 2001.
Margulies, et al., "Genome sequencing in microfabricated high-density picolitre reactors", Nature, vol. 437, 376-380 and Supplemental Materials, 2005.
Pamula et al., "Digital Microfluidics for Lab-on-a-Chip Applications", "Emerging CAD Challenges for Biochip Design" Workshop, Conference on Design, Automation, and Test in Europe (Date), Munich, Germany, Advance Programme, pp. 85-87, 2006.
Pinho, et al., "Haemopoietic progenitors in the adult mouse omentum: permanent production of B lymphocytes and monocytes", Cell Tissue Res., vol. 319, No. 1, 91-102, Jan. 2005.
Poliski, Making materials fit the future: accommodating relentless technological requirements means researchers must recreate and reconfigure materials, frequently challenging established laws of physics, while keeping an eye on Moore's Law, R&D Magazine Conference, Dec. 2001.
Raj, et al., Composite Dielectrics and Surfactants for Low Voltage Electrowetting Devices, University/Government/Industry Micro/Nano Symposium, vol. 17, 187-190, Jul. 13-16, 2008.
Russom, et al., "Pyrosequencing in a Microfluidic Flow-Through Device", Anal. Chem. vol. 77, 7505-7511, 2005.
Schwartz, et al., "Dielectrophoretic approaches to sample preparation and analysis", The University of Texas, Dissertation, Dec. 2001.
Tsuchiya, et al., "On-chip polymerase chain reaction microdevice employing a magnetic droplet-manipulation system", Sensors and Actuators B, vol. 130, 583-588, Oct. 18, 2007.
Wheeler, et al., "Electrowetting-Based Microfluidics for Analysis of Peptides and Proteins by Matrix-Assisted Laser Desportion/Ionization Mass Spectrometry", Anal. Chem. 76, 4833-4838, 2004.
Yi et al., "Microfluidics technology for manipulation and analysis of biological cells", Analytica Chimica Acta, vol. 560, 1-23, 2006.

* cited by examiner

METHOD OF CONCENTRATING BEADS IN A DROPLET

1 RELATED APPLICATIONS

This patent application is a U.S. National Phase of PCT International Application No. PCT/US2009/036449 entitled "Reagent and Sample Preparation and Loading On a Fluidic Device," filed Mar. 9, 2009, the application of which claims priority to and incorporates by reference related U.S. Provisional Patent Application Nos. 61/034,771 entitled "Methods of Sample Preparation Using Magnetically Responsive Beads and/or Magnetic Swab," filed Mar. 7, 2008; and 61/047,789, entitled "Droplet Actuator Devices and Droplet Operations Using Beads," filed Apr. 25, 2008.

This patent application also relates to and claims priority as a continuation-in-part of U.S. patent application Ser. No. 11/838,450 entitled "Droplet Actuator Analyzer With Cartridge," filed Aug. 14, 2007 (now U.S. Pat. No. 7,939,021 issued May 10, 2011), which is a continuation of PCT International Application No. PCT/US2007/011298 entitled "Droplet Manipulation Systems," filed May 9, 2007, which is related to and claims priority to U.S. Provisional Patent Application Nos. 60/746,797 entitled "Portable Analyzer Using Droplet-Based Microfluidics," filed May 9, 2006; and 60/806,412 entitled "Systems and Methods for Droplet Microactuator Operations," filed Jun. 30, 2006.

2 FIELD OF THE INVENTION

The invention relates to methods of reagent and sample preparation and loading on a fluidic device, such as a microfluidic device.

3 BACKGROUND

Droplet actuators are used to conduct a wide variety of droplet operations. A droplet actuator typically includes two substrates separated to form a droplet operations gap. The substrates include electrodes for conducting droplet operations. The gap between the substrates is typically filled with a filler fluid that is immiscible with the liquid that is to be subjected to droplet operations. Droplet operations are controlled by electrodes associated with one or both of the substrates. Because the volume of a sample of interest and/or the concentration of a target substance within a sample of interest may not be suitable for processing in a droplet actuator, there is a need for alternative approaches to preparing sample for analysis on a droplet actuator. For example, there is a need for concentrating analytes into a small volume for analysis on a droplet actuator. Further, in some droplet actuator applications there is a need for using "beads" in droplets for conducting various protocols. For protocols that make use of beads, the beads are typically used to bind to one or more target substances in a mixture of substances. The target substances may, for example, be analytes or contaminants. There is a need for alternative approaches for using beads in a droplet actuator. For example, there is a need for concentrating analytes into a small volume for analysis on a droplet actuator.

4 SUMMARY OF THE INVENTION

The invention provides a method of concentrating beads in a droplet. In some cases, the method makes use of a droplet actuator. For example, the droplet actuator may provide include an interior droplet operations volume. The droplet actuator may also include a reservoir which is exterior to the interior volume. Further, the droplet actuator may include a liquid path from the reservoir into the interior volume. In some cases, an activation state of one or more electrodes is changed to cause the liquid to flow onto a surface of the droplet actuator bounding the interior volume, thereby establishing the liquid path. The liquid path may, for example, be defined by various passages, tubes and/or openings. Various steps of the method of the invention may be electrode-mediated. Various steps of the method of the invention may be conducted on a droplet actuator. Various steps of the method of the invention may be accomplished using droplet operations.

As noted, the droplet actuator may include a reservoir which is exterior to the interior volume. The method of the invention may include providing magnetically responsive beads in the reservoir. In some cases, a liquid including the magnetically responsive beads is provided in the reservoir, and a portion of the liquid including the magnetically responsive beads is flowed into the interior volume to establish the liquid path.

The method of the invention may include magnetically attracting the magnetically responsive beads through the liquid path into the interior volume. In some cases, the magnetically responsive beads are attracted to a terminus of the liquid path in the interior volume. In certain embodiments, magnetically attracting the magnetically responsive beads into the interior volume includes magnetically attracting the beads towards a locus of the interior volume which is substantially opposite an entry point of the liquid path.

The method of the invention may include forming a droplet including one or more of the magnetically responsive beads in the interior volume. In some cases, forming the droplet may include breaking the liquid path in a region lacking the magnetically responsive beads to yield a droplet including substantially all of the magnetically responsive beads attracted to the terminus of the liquid path in the interior volume. The droplet may, in some instances, include substantially all of the magnetically responsive beads provided in the reservoir. In some cases, formation of the droplet is caused by changing an activation state of one or more electrodes to cause the formation of a droplet including substantially all of the beads provided in the reservoir. In an alternative embodiment, the invention retains the beads in the droplet path while dispensing a droplet substantially lacking in beads. For example, the invention may include a step of changing an activation state of one or more electrodes to cause the formation of one or more droplets substantially lacking the beads. In some cases, prior to changing an activation state of one or more electrodes to cause the formation of one or more droplets substantially lacking the beads, the beads are magnetically attracted to a terminus of the flow of liquid. In some cases, forming a droplet including one or more of the magnetically responsive beads in the interior volume includes changing an activation state of one or more electrodes to cause the formation of a droplet from the terminus of the flow, the droplet including substantially all of the beads provided in the reservoir.

In an alternative embodiment, the magnetically responsive beads are magnetically attracted to an intermediate locus of the flow. The intermediate locus may be between a portion of the liquid that is in the reservoir and a terminus of the liquid that is in the droplet operations gap. A droplet may be formed which is substantially lacking the beads. For example, an activation state of one or more electrodes may be changed to cause the formation of one or more droplets from the terminus of the flow, the one or more droplets substantially lacking the beads.

Similarly, the invention provides a method of concentrating beads in a droplet. The method may make use of a droplet actuator. The droplet actuator may, for example, include an interior droplet operations volume and a reservoir exterior to the interior volume. A droplet may be established in a liquid path extending from the reservoir into the interior volume. The method may include providing magnetically responsive beads in the droplet. The method may include magnetically attracting the magnetically responsive beads through the liquid path into the interior volume into a region of the liquid path which is intermediate between a portion of the liquid path which is in the reservoir and a portion of the liquid path which is in the interior droplet operations volume. The method may also include forming a droplet from a terminus of the droplet which is in the interior droplet operations volume, the droplet substantially lacking in magnetically responsive beads.

In some embodiments, the droplet actuator includes a first substrate, and a second substrate separated from the first substrate to provide the interior volume between the first substrate and the second substrate. A droplet may be formed in the reservoir and may extend via the liquid path into the interior volume. Electrodes may be associated with the first and/or second substrate and arranged for conducting one or more droplet operations in the interior volume. The droplet actuator may include one or more magnets providing a magnetic field arranged to attract magnetically responsive beads from the liquid reservoir into the interior volume.

The beads may have affinity for a target substance in the liquid. The liquid may, for example, include a biological sample. The beads have affinity for a target substance in the biological sample. The liquid may, for example, include a lysis buffer. The beads may have an affinity for one or more target substances from cells lysed with the lysis buffer.

The invention also provides a method of concentrating magnetically responsive beads in a region of a droplet. Magnetically responsive beads may be provided in the droplet. The magnetically responsive beads provided into the droplet may be immobilized by a first magnetic field. In the droplet, the magnetically responsive beads may be released from the magnetic field. Using a second magnetic field, the magnetically responsive beads may be aggregated in a region of the droplet. In some cases, at least a portion of the droplet may be in a droplet operations gap of a droplet actuator. One or more steps of the method may be conducted in a droplet operations gap of a droplet actuator. In one embodiment, the second magnetic field aggregates the magnetically responsive beads in a region of the droplet within a droplet operations gap of a droplet actuator. In another embodiment, the magnetically responsive beads are provided in a region of the droplet that is not within a droplet operations gap of the droplet actuator, and the second magnetic field aggregates the magnetically responsive beads in a region of the droplet that is within a droplet operations gap of a droplet actuator. In some cases, the portion of the droplet in a droplet operations gap of a droplet actuator may be at least partially surrounded by filler fluid including an oil. In other cases, the portion of the droplet in a droplet operations gap of a droplet actuator may be substantially completely surrounded by filler fluid including an oil.

In certain embodiments, the first magnetic field may be established by a magnetic swab. The first magnetic field may, for example, be established by a magnetic swab device including a moveable magnet. In some cases, the magnet may be coupled to a plunger and inserted in a slot within a magnetic swab device body. Releasing the beads from the first magnetic field may in some cases include withdrawing a magnetic plunger from magnet plunger device. In other embodiments, the first magnetic field may be established by a magnetic swab device including an electromagnet.

As noted the droplet may be provided on a droplet actuator. In some cases, the droplet may be shaped and/or maintained in place within a droplet operations gap by electric field induced changes in surface tension, e.g., to produce an elongated droplet within the droplet operations gap. The electric field may, for example, be emitted from an electrode associated with a substrate of the droplet actuator. In some cases, the second magnetic field may be emitted from a source underlying, overlying, and/or alongside, the droplet.

The invention also provides a method of concentrating a sample. The method may include combining a sample with magnetically responsive beads to yield a bead-containing sample. The method may also include removing beads from the bead-containing sample. For example, the beads may be removed from the bead-containing sample using a magnetic swab. The method may also include conducting a method of concentrating magnetically responsive beads as described herein using the magnetic swab for providing the magnetically responsive beads in the source droplet.

The invention also provides a method of concentrating a target substance into a droplet. The method may include combining a sample liquid with beads to yield a bead-containing sample liquid. The method may also include removing beads from the bead-containing sample liquid. The method may also include concentrating the beads into a droplet on a droplet actuator. In some cases the beads include magnetically responsive beads. In some cases, the beads include substantially non-magnetically responsive beads.

Further, the invention provides a method of concentrating beads in a droplet. The method may make use of a droplet actuator. The droplet actuator may, for example, include a first substrate and a second substrate separated from the first substrate to provide a gap between the first substrate and the second substrate. The gap may have dimensions suitable for conducting droplet operations. The droplet actuator may also include a liquid reservoir and a liquid path from the reservoir into the gap. The droplet actuator may also include electrodes associated with the first and/or second substrate and arranged for conducting one or more droplet operations in the gap. Further, the droplet actuator may include a magnet providing a magnetic field arranged to attract magnetically responsive beads from the liquid reservoir into the gap. The method may include providing a liquid including magnetically responsive beads in the liquid reservoir. At least a portion of the magnetically responsive beads may be magnetically attracted from the reservoir into the gap.

The invention provides a bead washing device. The device may include a body including an interior volume. The body may also include a plunger insertion opening for inserting a plunger into the interior volume. The body may include a fill opening for flowing liquid into and out of the interior volume. In some embodiments, the body with plunger insertion opening, plunger and fill opening may be substantially the same as the body of an ordinary syringe. A first plunger may be inserted into the interior volume to define a fill volume between the plunger and the fill opening. The first plunger may include a slot for insertion of a second plunger. A second plunger including a magnet may be inserted into a slot in the first plunger or into a slot of another plunger which may be inserted into the first plunger. In fact, any number of plungers may be used in a plunger assembly. In some embodiments, the device is provided with beads in the fill volume. A filter may be interposed in the fill opening. The filter may have properties selected to retain beads in the fill volume. The fill opening may have a size selected to retain the beads in the fill volume. The bead washing device may be packaged together as a kit. For example, a kit may include elements of the bead washing device in a common packaging, such as sterile packaging. The kit may include instructions for using the bead washing device. The components of the bead washing device may be provided assembled, partially assembled, or unassembled in packaging. The packaging may be sterile. The packaging may include operating instructions and/or a link to operating instructions available via a network, such as the Internet.

The invention provides a device for collecting magnetically responsive beads from a liquid flow. The device may include a flow channel including an opening for insertion of a magnet. A magnet may be inserted into the flow channel. A liquid including magnetically responsive beads may be flowed through the flow channel. Magnetically responsive beads may be collected on the magnet. The magnetically responsive beads may be removed from the flow channel and subjected to further processing, e.g., on a droplet actuator. In some cases, the magnet is a component of a magnetic swab or plunger. Following removal of the beads from the flow channel, the beads may be released from the magnetic swab or plunger.

The invention provides a method of concentrating beads in a droplet. The method may include providing a source droplet having a first volume and including a set of beads. A sub-droplet including a second volume may be dispensed from the first volume. The second volume may be smaller than the first volume. The sub-droplet may include a subset of the set of beads provided in the source droplet. The method may include dispensing a second sub-droplet from the source droplet. The second sub-droplet may be contacted with the first droplet to yield a combined droplet. Beads in the combined droplet may be substantially immobilized or aggregated in a region of the combined droplet. A droplet-splitting operation may be conducted using the combined droplet with immobilized or aggregated beads. The droplet-splitting operation may yield a bead droplet including substantially all beads of the combined droplet, and a supernatant droplet substantially lacking beads from the combined droplet. Additional source droplets may be contacted with the bead droplet including substantially all beads, and the immobilizing and droplet-splitting operations may be repeated as necessary until a predetermined bead concentration is achieved in the bead droplet. In some cases, process concentrates all beads from the source droplet into the bead-containing droplet.

Substantially immobilizing or retaining beads in a region of the sub-droplet may include transporting the combined droplet into the presence of a magnetic field to substantially immobilize the beads. The bead containing droplet may be formed in the presence of a magnetic field and subsequently may be sufficiently separated from the magnetic field to re-suspend the beads in the bead containing droplet. In an alternative embodiment, substantially immobilizing or retaining beads in a region of the sub-droplet includes transporting the combined droplet into the presence of a physical obstacle and physically retaining the beads. In some cases, substantially immobilizing or retaining beads in a region of the sub-droplet may be dielectrophoresis-mediated. The beads may include a target substance for analysis. The source droplet may include a sample substance and the beads have an affinity for a target substance potentially present in the sample substance. One or more steps of the method may be conducted in a droplet operations gap of a droplet actuator.

The invention provides a method of conducting an assay. The method may include providing a sample liquid including a sample substance. The sample liquid may be combined with beads having affinity for a target substance potentially present in the sample liquid to yield a source liquid. A method of concentrating beads in a droplet as described herein may be used to concentrate the beads. An assay may be conducted using the concentrated beads. As with other embodiments described herein, the sample liquid including a sample substance includes a biological sample. For example, the biological sample may include a prepared and unprepared sample selected from the group consisting of whole blood, lymphatic fluids, serum, plasma, sweat, tear, saliva, sputum, cerebrospinal fluids, amniotic fluids, seminal fluids, vaginal excretions, serous fluids, synovial fluids, pericardial fluids, peritoneal fluids, pleural fluids, transudates, exudates, cystic fluids, bile, urine, gastric fluids, intestinal fluids, fecal samples, fluidized tissues, fluidized organisms, biological swabs and biological washes. Again, these biological samples are suitable for use with any embodiment of the invention. Any of the steps of the invention may be electric field-mediated, electrode-mediated, and/or electrowetting-mediated.

The invention provides a droplet actuator device. The droplet actuator device may include a droplet actuator body including a first substrate and a second substrate separated from one another to provide a droplet operations gap. The droplet actuator device may include an opening through the first substrate into the droplet operations gap. The droplet actuator device may include a coupling configured for sealably coupling an external reservoir to the droplet actuator via the opening, such that when coupled to an external reservoir, a fluid path may be established from the external reservoir into the droplet operations gap. In some embodiments, the device may include an external reservoir sealably coupled to the coupling. The external reservoir may include a reservoir opening configured to establish a fluid path from an interior volume of the external reservoir into the droplet operations gap. The reservoir opening may be sealed or capped. The reservoir may include beads. The reservoir may include magnetically responsive beads. The reservoir may include beads that are not substantially magnetically responsive. The reservoir may include beads and a sample. The reservoir may include beads and a sample liquid. The reservoir may be sufficiently sealed to prevent leakage of liquid from the interior volume of the reservoir. A means for unsealing the reservoir opening without otherwise opening the reservoir may be provided. A removable seal or cap may cover the reservoir opening. The droplet operations gap may be at least partially filled with a liquid filler fluid. The coupling may be integral with the opening. The coupling may be coupled to a fluid passage which is in fluid communication with the opening.

The invention provides a kit including a droplet actuator device as described in the preceding paragraph and an external reservoir configured to be sealably coupled to the coupling. The reservoir opening may be sealed or capped. The fill opening may be filled or capped. The droplet actuator device provided in the kit may include a liquid filler fluid. The reservoir opening may be sealed with a substance which may be soluble in the liquid filler fluid. The coupling on the droplet actuator device may be sealed or capped to restrict contamination and/or loss of filler fluid. The reservoir opening may be sealed with a substance which melts at an operational temperature. The reservoir opening may be sealed with a substance which melts at a temperature that may be greater than room temperature but less than a temperature that would cause sufficient damage to the droplet actuator device as to render it unusable for its intended purpose. The reservoir opening may include a plug which may be physically removable by a user. The reservoir may include beads. The reservoir may include magnetically responsive beads. The reservoir may include beads that are not substantially magnetically responsive. The reservoir may include a fitting or cap configured for injection of a sample liquid. The reservoir may include beads and a sample. The reservoir may be sufficiently sealed to prevent leakage of liquid from the interior volume of the reservoir. A means may be provided for unsealing the reservoir opening without otherwise opening the reservoir. A removable seal or cap may cover the fill opening. The droplet operations gap may be at least partially filled with a liquid filler fluid. The coupling may be integral with the opening. The coupling may include an external fluid path which may be in fluid communication with the opening. The droplet actuator may include on-actuator reservoirs including reagents for conducting an assay. The droplet actuator may include one or more off-actuator reservoirs including reagents for conducting an assay. The droplet actuator may include multiple couplings configured for sealably joining multiple external reservoirs to the droplet actuator via multiple openings through the first substrate into the droplet operations gap. Multiple external reservoirs may be joined together as a bank of reservoirs configured for coupling to a droplet actuator. Openings through substrates may be replaced with openings through side walls, i.e., entrance between the substrates.

As will be appreciated by those of skill in the art, the invention may be embodied as a method, system, or computer program product. Accordingly, various aspects of the invention may take the form of hardware embodiments, software embodiments (including firmware, resident software, micro-code, etc.), or embodiments combining software and hardware aspects that may all generally be referred to herein as a "circuit," "module" or "system." Furthermore, the methods of the invention may take the form of a computer program product on a computer-usable storage medium having computer-usable program code embodied in the medium.

These and other embodiments of the invention will be apparent from the ensuing detailed description of the invention.

5 DEFINITIONS

As used herein, the following terms have the meanings indicated.

"Activate" with reference to one or more electrodes means effecting a change in the electrical state of the one or more electrodes which, in the presence of a droplet, results in a droplet operation.

"Bead," with respect to beads on a droplet actuator, means any bead or particle that is capable of interacting with a droplet on or in proximity with a droplet actuator. Beads may be any of a wide variety of shapes, such as spherical, generally spherical, egg shaped, disc shaped, cubical and other three dimensional shapes. The bead may, for example, be capable of being transported in a droplet on a droplet actuator or otherwise configured with respect to a droplet actuator in a manner which permits a droplet on the droplet actuator to be brought into contact with the bead, on the droplet actuator and/or off the droplet actuator. Beads may be manufactured using a wide variety of materials, including for example, resins, and polymers. The beads may be any suitable size, including for example, microbeads, microparticles, nanobeads and nanoparticles. In some cases, beads are magnetically responsive; in other cases beads are not significantly magnetically responsive. For magnetically responsive beads, the magnetically responsive material may constitute substantially all of a bead or one component only of a bead. The remainder of the bead may include, among other things, polymeric material, coatings, and moieties which permit attachment of an assay reagent. Examples of suitable magnetically responsive beads are described in U.S. Patent Publication No. 2005-0260686, entitled, "Multiplex flow assays preferably with magnetic particles as solid phase," published on Nov. 24, 2005, the entire disclosure of which is incorporated herein by reference for its teaching concerning magnetically responsive materials and beads. Any liquids described herein may include one or more magnetically responsive and/or non-magnetically responsive beads. Any mention of beads may include one or more of such beads. Examples of droplet actuator techniques for immobilizing magnetically responsive beads and/or non-magnetically responsive beads and/or conducting droplet operations protocols using beads are described in U.S. patent application Ser. No. 11/639,566, entitled "Droplet-Based Particle Sorting," filed on Dec. 15, 2006; U.S. Patent Application No. 61/039,183, entitled "Multiplexing Bead Detection in a Single Droplet," filed on Mar. 25, 2008; U.S. Patent Application No. 61/047,789, entitled "Droplet Actuator Devices and Droplet Operations Using Beads," filed on Apr. 25, 2008; U.S. Patent Application No. 61/086,183, entitled "Droplet Actuator Devices and Methods for Manipulating Beads," filed on Aug. 5, 2008; International Patent Application No. PCT/US2008/053545, entitled "Droplet Actuator Devices and Methods Employing Magnetically responsive beads," filed on Feb. 11, 2008; International Patent Application No. PCT/US2008/058018, entitled "Bead-based Multiplexed Analytical Methods and Instrumentation," filed on Mar. 24, 2008; International Patent Application No. PCT/US2008/058047, "Bead Sorting on a Droplet Actuator," filed on Mar. 23, 2008; and International Patent Application No. PCT/US2006/047486, entitled "Droplet-based Biochemistry," filed on Dec. 11, 2006; the entire disclosures of which are incorporated herein by reference. Beads may have affinity for one or more target substances. Target substances may be collected from a starting sample by binding them to the beads. Beads on which target substances have been collected may be provided in a liquid volume which is less than the liquid volume of the starting sample, and thereby target substances from a starting sample may be concentrated into a reduced volume sample. Beads may be introduced into a droplet on a droplet actuator. Target substances may be analyzed using droplet-based protocols-mediated by droplet operations on a droplet actuator. In some cases, target substances may be eluted from beads prior to analysis.

"Droplet" means, unless otherwise indicated, a volume of liquid on a droplet actuator that is at least partially bounded by filler fluid. For example, a droplet may be completely surrounded by filler fluid or may be bounded by filler fluid and one or more surfaces of the droplet actuator. Droplets may, for example, be aqueous or non-aqueous or may be mixtures or emulsions including aqueous and non-aqueous components. Droplets may take a wide variety of shapes; nonlimiting examples include generally disc shaped, droplet slug shaped, truncated sphere, ellipsoid, spherical, partially compressed sphere, hemispherical, ovoid, cylindrical, and various shapes formed during droplet operations, such as merging or splitting or formed as a result of contact of such shapes with one or more surfaces of a droplet actuator. For examples of droplet liquids that may be subjected to droplet operations using the approach of the invention, see International Patent Application No. PCT/US 06/47486, entitled, "Droplet-Based Biochemistry," filed on Dec. 11, 2006. In various embodiments, a droplet may include a biological sample, such as whole blood, lymphatic liquid, serum, plasma, sweat, tear, saliva, sputum, cerebrospinal liquid, amniotic liquid, seminal liquid, vaginal excretion, serous liquid, synovial liquid, pericardial liquid, peritoneal liquid, pleural liquid, transudates, exudates, cystic liquid, bile, urine, gastric liquid, intestinal liquid, fecal samples, liquids including single or multiple cells, liquids including organelles, liquidized tissues, liquidized organisms, liquids including multi-celled organisms, biological swabs and biological washes. Moreover, a droplet may include a reagent, such as water, deionized water, saline solutions, acidic solutions, basic solutions, detergent solutions and/or buffers. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological liquids.

"Droplet Actuator" means a device for manipulating droplets. For examples of droplet actuators, see U.S. Pat. No. 6,911,132, entitled "Apparatus for Manipulating Droplets by Electrowetting-Based Techniques," issued on Jun. 28, 2005 to Pamula et al.; U.S. patent application Ser. No. 11/343,284, entitled "Apparatuses and Methods for Manipulating Droplets on a Printed Circuit Board," filed on filed on Jan. 30, 2006; U.S. Pat. No. 6,773,566, entitled "Electrostatic Actuators for Microliquidics and Methods for Using Same," issued on Aug. 10, 2004 and U.S. Pat. No. 6,565,727, entitled "Actuators for Microliquidics Without Moving Parts," issued on Jan. 24, 2000, both to Shenderov et al.; Pollack et al., International Patent Application No. PCT/US2006/047486, entitled "Droplet-Based Biochemistry," filed on Dec. 11, 2006; and Roux et al., U.S. Patent Pub. No. 20050179746, entitled "Device for Controlling the Displacement of a Drop Between two or Several Solid Substrates," published on Aug. 18, 2005; the disclosures of which are incorporated herein by reference. droplet actuators will include a substrate, droplet operations electrodes associated with the substrate, one or more dielectric and/or hydrophobic layers atop the substrate and/or electrodes forming a droplet operations surface, and optionally, a top substrate separated from the droplet operations surface by a gap. Top and bottom substrates may be provided as one integral component. One or more reference electrodes may be provided on the top and/or bottom substrates and/or in the gap. In various embodiments, the manipulation of droplets by a droplet actuator may be electrode-mediated, e.g., electrowetting-mediated and/or dielectrophoresis-mediated and/or Coulombic force-mediated. Examples of other methods of controlling liquid flow that may be used in the droplet actuators of the invention include devices that induce hydrodynamic liquidic pressure, such as those that operate on the basis of mechanical principles (e.g. external syringe pumps, pneumatic membrane pumps, vibrating membrane pumps, vacuum devices, centrifugal forces, piezoelectric/ultrasonic pumps and acoustic forces); electrical or magnetic principles (e.g. electroosmotic flow, electrokinetic pumps, ferroliquidic plugs, electrohydrodynamic pumps, attraction or repulsion using a magnetic field and magnetohydrodynamic pumps); thermodynamic principles (e.g. gas bubble generation/phase-change-induced volume expansion); other kinds of surface-wetting principles (e.g. electrowetting, and opto-electrowetting, as reservoir as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); a magnetic field (e.g., oscillating ions causes flow); magnetohydrodynamic forces; and vacuum or pressure differential. In some embodiments, combinations of two or more of the foregoing techniques may be employed in droplet actuators of the invention.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction in 3D space; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining," "contact," "contacting," and the like are used with reference to droplets to describe the formation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" "dividing," and "dispensing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. In some cases, loading may be electrode assisted. Droplet operations may be electrode-mediated. In some cases, droplet operations are further facilitated by the use of hydrophilic and/or hydrophobic regions on surfaces and/or by physical obstacles.

"Filler fluid" means a liquid associated with a droplet operations substrate of a droplet actuator, which liquid is sufficiently immiscible with a droplet phase to render the droplet phase subject to droplet operations, such as electrode-mediated droplet operations. The filler fluid may, for example, be a low-viscosity oil, such as silicone oil. Other examples of filler fluids are provided in International Patent Application No. PCT/US2006/047486, entitled, "Droplet-Based Biochemistry," filed on Dec. 11, 2006; International Patent Application No. PCT/US2008/072604, entitled "Use of additives for enhancing droplet actuation," filed on Aug. 8, 2008; and U.S. Patent Publication No. 20080283414, entitled "Electrowetting Devices," filed on May 17, 2007; the entire disclosures of which are incorporated herein by reference. The filler fluid may fill the entire gap of the droplet actuator or may coat one or more surfaces of the droplet actuator. Filler fluid may be conductive or non-conductive. The invention includes embodiments of any of the droplet actuators and methods described herein that make use of a filler fluid. The invention also includes embodiments of any of the droplet actuators and methods described herein that do not make use of a filler fluid.

"Immobilize" or "aggregate" with respect to magnetically responsive beads, means that the beads are substantially restrained or localized in position in a droplet or in filler fluid on a droplet actuator. For example, in one embodiment, immobilized beads are sufficiently restrained in position to permit execution of a splitting operation on a droplet, yielding one droplet with substantially all of the beads and one droplet substantially lacking in the beads.

"Magnetically responsive" means responsive to a magnetic field. "Magnetically responsive beads" include or are composed of magnetically responsive materials. Examples of magnetically responsive materials include paramagnetic materials, ferromagnetic materials, ferrimagnetic materials, and metamagnetic materials. Examples of suitable paramagnetic materials include iron, nickel, and cobalt, as reservoir as metal oxides, such as $Fe_3O_4$, $BaFe_{12}O_{19}$, CoO, NiO, $Mn_2O_3$, $Cr_2O_3$, and CoMnP.

"Target substance" means a substance suitable for use in an analytical protocol or including or producing a subcomponent which is suitable for use in an analytical protocol. "Analytical protocol" is broadly construed to mean a protocol resulting in any kind of characterization of a property of a substance. For example, a "target substance" may be, or include, an atom, small molecule, organic molecule, in organic molecule, peptide, protein, macro molecule, subcellular component of a cell, cell, group of cells, single celled organism, multicellular organism.

"Washing" with respect to washing a magnetically responsive bead means reducing the amount and/or concentration of one or more substances in contact with the magnetically responsive bead or exposed to the magnetically responsive bead from a droplet in contact with the magnetically responsive bead. The reduction in the amount and/or concentration of the substance may be partial, substantially complete, or even complete. The substance may be any of a wide variety of substances; examples include target substances for further analysis, and unwanted substances, such as components of a sample, contaminants, and/or excess reagent. In some embodiments, a washing operation begins with a starting droplet in contact with a magnetically responsive bead, where the droplet includes an initial amount and initial concentration of a substance. The washing operation may proceed using a variety of droplet operations. The washing operation may, for example, yield a droplet including the magnetically responsive bead, where the droplet has a total amount and/or concentration of the substance which is less than the initial amount and/or concentration of the substance. Examples of suitable washing techniques are described in Pamula et al., U.S. Pat. No. 7,439,014, entitled "Droplet-Based Surface Modification and Washing," granted on Oct. 21, 2008, the entire disclosure of which is incorporated herein by reference. Any of the bead-containing droplets described herein may be subjected to a bead washing protocol.

The terms "top," "atop," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) or layer is described as being "on", "at", or "over" an another liquid or layer, or electrode, array, matrix or surface, such liquid or layer could be either in direct contact with the underlying liquid/layer/electrode/array/matrix/surface, or could be in contact with one or more substances interposed between the liquid or layer and the underlying liquid/layer/electrode/array/matrix/surface.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

6 BRIEF DESCRIPTION OF THE FIGURES

FIGS. 12-13 illustrate a side view of a portion of droplet actuator and a process of extracting beads from liquid and dispensing substantially bead-free droplets.

7 DESCRIPTION

Figure 1:
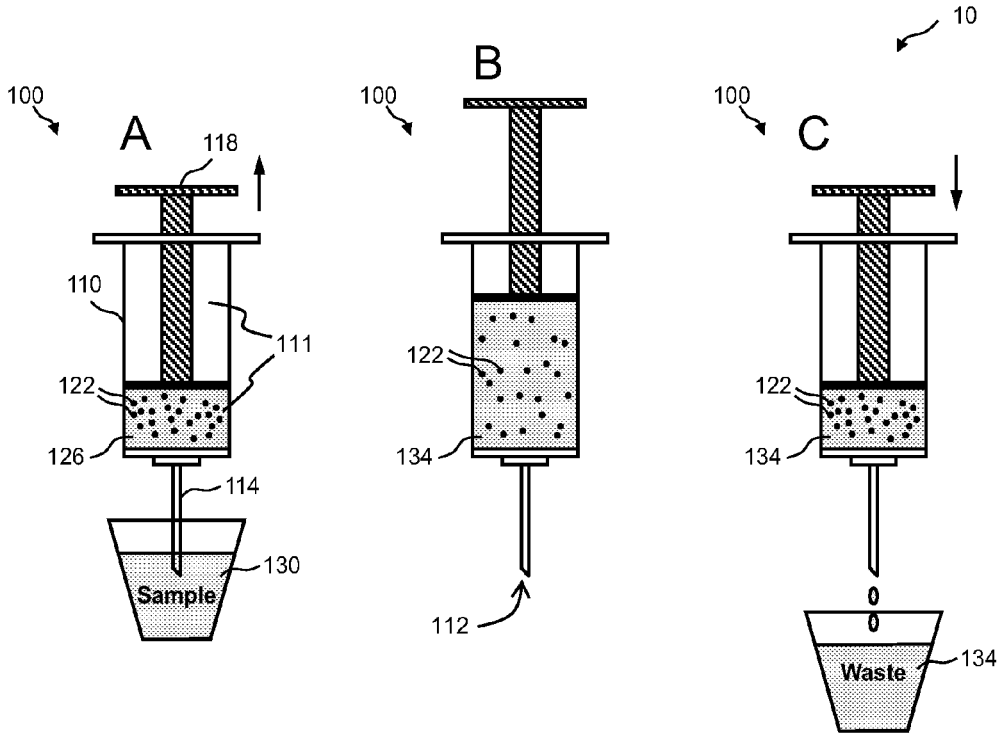
FIG. 1 illustrates a syringe device and a process that uses the syringe device for concentrating beads and thereby concentrating a target substance bound to the beads.
Figure 2:
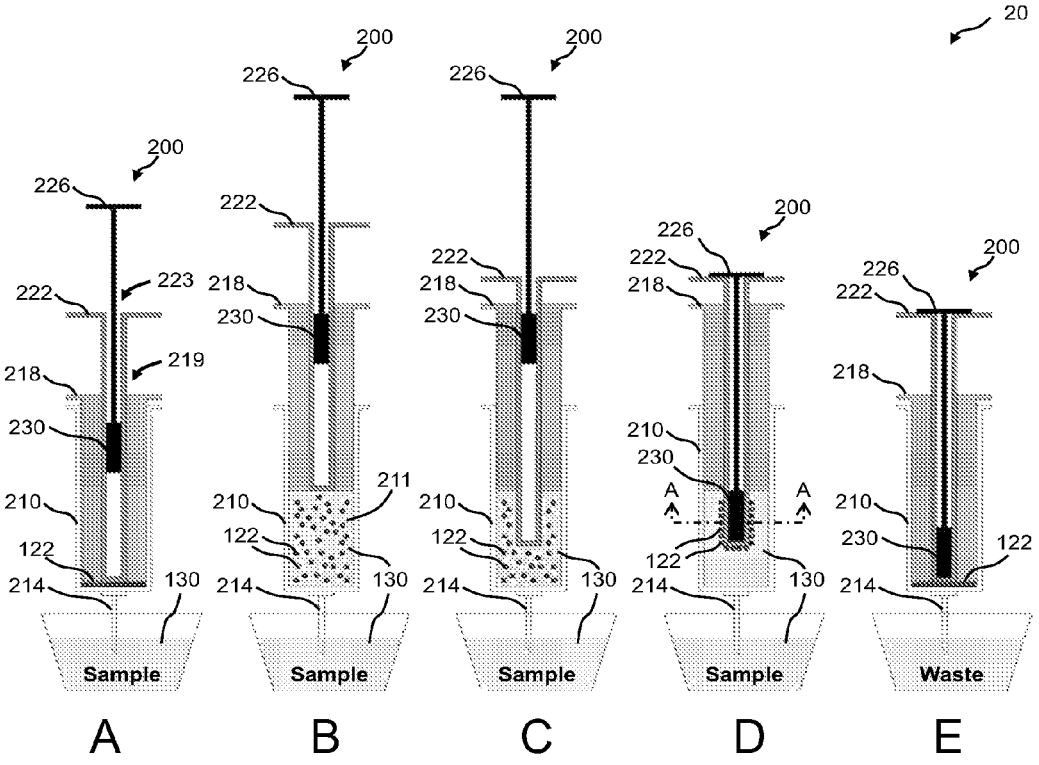
FIG. 2 illustrates a three-plunger syringe device and a process that uses the syringe device in combination with beads and a magnet for providing a droplet with an increased concentration of target substance.

The invention provides methods and devices for preparation of reagents and/or samples for use in droplet-based protocols. The invention also provides methods and devices for loading reagents and/or samples onto a microfluidic device for use in droplet-based protocols. The microfluidic device may, for example, be a droplet actuator. In certain embodiments, the invention makes use of beads as a medium for capturing target substances. The beads in various embodiments may be magnetically responsive or non-magnetically responsive or may include mixtures of both. In some embodiments, the invention is useful in preparation of samples that have a volume which is not suitable for processing in a droplet actuator. The methods and devices of the invention may be useful for concentrating a target substance into a smaller volume of liquid that is suitable for processing on a droplet actuator.

Certain embodiments of the invention provide devices and methods for handling magnetically responsive beads. Aspects of the invention provide immobilization or aggregation of magnetically responsive beads within a fluidic device, such as droplet actuator. Magnetically responsive beads may be immobilized within droplets while conducting droplet operations. For example, beads may be immobilized in assays that require execution of bead washing protocols, such as target substance purification, pyrosequencing and immunoassay applications. As another example, beads may be immobilized in assays that require concentration of beads from larger volume droplets into smaller volume droplets. A magnetic field may be employed for immobilizing magnetically responsive beads and/or for concentrating magnetically responsive beads in a droplet. In some embodiments magnetic field may be employed for transporting magnetically responsive beads from an off-actuator reservoir into an on-actuator reservoir. In certain embodiments, this transport of magnetically responsive beads is facilitated through a liquid medium, such as a droplet that is disposed partly in an off-actuator reservoir and partly in an on-actuator reservoir, such that beads are attracted by a magnetic FIGS. 1A-C illustrate a syringe 100 and a process 10 that uses syringe 100 for concentrating beads 122 in a reduced liquid volume and thereby concentrating a target substance bound to the beads 122. Syringe 100 includes a syringe body 110. Syringe body 110 includes an internal volume 111 suitable for holding a volume of liquid 134. Syringe body 110 includes an opening 112 for expelling liquid from a distal end thereof. Opening 112 in the illustrated embodiment is provided within a hollow tip 114, such as a typical syringe needle or a capillary tube. Hollow tip 114 may be absent, and an opening from syringe body 110 may be provided directly in syringe body 110. Opening 112 may have a size selected to retain beads and/or may include one or more bead retention means, such as a physical obstacle for blocking beads from exiting through opening 110. The bead retention means may be removed when it is desirable to remove beads 122 from syringe body 110. Syringe 100 includes a plunger 118 for forcing liquid or other fluids into or out of the interior volume of syringe body 110, e.g., through opening 112. Liquid may be forced out of the syringe body 110 without beads 122 when the bead retention means is in place. Liquid may be forced out of the syringe body 110 with beads 122 when the bead retention means is not in place.

The process shown in FIG. 1 is an example of a more general concept of mixing beads with a solution, such as a sample solution, to concentrate a target substance on the beads, followed by reducing the volume of the solution to yield a smaller volume of solution with a higher concentration of beads and therefore a higher concentration of target substance. The syringe may be replaced with any of a variety of devices suitable for contacting a set of beads with a target substance in a liquid, followed by reduction or substantial elimination of volume of the liquid while retaining the beads for further processing. In certain embodiments, the beads may then be subjected to a droplet based processing protocol and/or analysis protocol for analyzing the target substance (e.g., a droplet based protocol executed on a droplet actuator). The syringe and process specifically illustrated, as with other illustrations set forth herein, provide a non-limiting example.

FIG. 1A shows that syringe body 110 of syringe 100 including a quantity of liquid 134 in interior volume 111. Liquid 134 includes a quantity of beads 122. In some cases, liquid 134 may be absent, and syringe 100 may simply include beads 122. Beads 122 have affinity for a target substance. As an example, liquid 126 may include a reagent, such as a buffer, such as a lysis buffer. A lysis buffer solution may be selected for lysing cells in a sample to free one or more target substances which are sub-components of the cells. The freed target substances may be available for binding to beads 122. Beads 122 may in some cases be magnetically responsive. Beads 122 may in some cases be substantially non-magnetically responsive. Combinations of magnetically responsive beads 122 and substantially non-magnetically responsive beads 122 are also possible.

FIG. 1A shows hollow tip 114 inserted in liquid 130. Liquid 130 may, for example, be a sample liquid. The sample liquid may be a native sample or a processed sample. For example, liquid 130 may include or be composed of a biological sample, such as whole blood, lymphatic liquid, serum, plasma, sweat, tear, saliva, sputum, cerebrospinal liquid, amniotic liquid, seminal liquid, vaginal excretion, serous liquid, synovial liquid, pericardial liquid, peritoneal liquid, pleural liquid, transudates, exudates, cystic liquid, bile, urine, gastric liquid, intestinal liquid, fecal matter, liquids including single or multiple cells, liquids including organelles, liquidized tissues, liquidized organisms, liquids including multi-celled organisms, biological swabs and biological washes. Moreover, a sample liquid may include a reagent, such as water, deionized water, saline solutions, acidic solutions, basic solutions, detergent solutions and/or buffers. Other examples of sample liquid contents include reagents, such reagents for a biochemical protocol, such as a nucleic acid amplification protocol, an affinity-based assay protocol, an enzymatic assay protocol, a sequencing protocol, and/or a protocol for analyses of biological liquids. The sample liquids described here may, along with other sample liquids known in the art, be used with this and other embodiments of the invention set forth herein.

Liquid 130 may be forced into syringe body 110 by use of plunger 118 of syringe 100. FIG. 1B shows a volume of liquid 134 within syringe body 110 of syringe 100, which is the result of mixing liquid 126 and liquid 130 of FIG. 1A. FIG. 1B also shows beads 122 that are suspended in the resulting liquid 134. One or more target substances may bind to beads 122 in liquid 134. With reference to the lysis buffer example, where liquid 126 includes a lysis buffer solution, cells in sample liquid 130 may be lysed, and the freed target substances may bind to beads 122. This process may be assisted by manually or mechanically shaking, vibrating or agitating syringe 100 or otherwise using an actuator mechanism (not shown) to agitate syringe 100 or beads 122 within syringe 122. For example, a magnetic stir bar may be used. FIG. 1C shows that by forcing plunger 118 into the interior volume of plunger 118, liquid 134 may be partially expelled or even substantially completely expelled. Beads 122, which may have target substance bound thereto, remain within syringe body 110 of syringe 100.

Optionally, after the above-described process is completed, execution of an additional washing operation may be used to remove yet further impurities. For example, process 10 of FIGS. 1A, 1B, and 1C may be repeated one or more times, wherein a wash buffer solution (not shown) may be used in place of liquid 130. Fresh wash buffer may be used after each washing cycle. The result is a clean sample of beads 122 that have the target substances bound thereon, which may used for further processing in, for example, a droplet actuator.

Beads 122 may be removed from syringe body 110. For example, the bead retention means may be opened or removed to permit beads to exit syringe body 110 via opening 112 or another opening. Similarly, a separate opening may be provided which is suitable for removing beads 122 from syringe body 110. Once removed, beads 122 may be subjected to a droplet-based assay protocol, for example, in a microfluidics device, such as a droplet actuator. For example, the protocol may be selected to analyze the target substance. Beads 122 may be introduced into a droplet actuator for processing, and/or subject to another type of analysis. In one embodiment, beads 122 may be flowed directly into a droplet actuator. Opening 112 may be modified to fit within a corresponding fitting on a droplet actuator to establish a fluid flow path extending from interior volume 111 into a reservoir of a droplet actuator. For example, the reservoir may be an off-actuator reservoir or an on-actuator reservoir or both.

FIGS. 2A-2E illustrate syringe 200 and a process 20 that uses syringe 200 in combination with beads 122 and magnet 230 for providing a liquid having an increased concentration of a target substance. FIGS. 2A-2E show syringe 200 that incorporates a three-plunger system, wherein first plunger 218 is provided with slot 219 for insertion of second plunger 222; second plunger 222 is provided with slot 223 for insertion of third plunger 226, and third plunger 226 is provided with magnet 230 mounted thereon.

Syringe 200 includes body 210 establishing interior volume 211 for holding a volume of liquid 130. Syringe 200 includes hollow tip 214 at one end of body 210 through which liquid may enter or exit body 210. Fitted within body 210 is first plunger 218. First plunger 218 includes slot 219 for insertion of second plunger 222. Second plunger 222 may be fitted within slot 219. Second plunger 222 includes slot 223 for insertion of third plunger 226. Third plunger 226 may be inserted in slot 223. Third plunger 226 includes magnet 230 mounted thereon. Magnet 230 may, for example, be oriented generally towards a distal tip of third plunger 226. First plunger 218, second plunger 222, and third plunger 226 may be arranged concentrically within body 210, though a strict concentric arrangement is not required. First plunger 218 is the outermost plunger. Second plunger 222 is an intermediate plunger. Third plunger 226 is the innermost plunger.

First plunger 218 is slideably coupled to body 210, and works together with the other plungers for drawing liquid into or forcing liquid out interior volume 211 of body 210. Second plunger 222 is slideably coupled to first plunger 218. Third plunger 226 with magnet 230 is slideably coupled to second plunger 222. Second plunger 222 and third plunger 226 are used to position magnet 230 within interior volume 211 of body 210. Second plunger 222 may be extended into interior volume 211, e.g. as shown in FIG. 2C. Third plunger 226 may be slight positioned within slot 223 to position magnet 230 a desired distance from liquid 130 and beads 122 within interior volume 211. For example, by fully inserting third plunger 226 into slot 223 while second plunger 222 is inserted into liquid 130 within interior volume 211, as illustrated in FIG. 2D, beads 122 may be immobilized on a surface of plunger 222.

Referring to FIG. 2A, syringe 200 is preloaded with a quantity of beads 122. Beads 122 have an affinity for a target substance. Substantially no liquid is within syringe 200 (i.e., first plunger 218 and second plunger 222 are substantially engaged toward tip 214 of syringe 200), thought it will be appreciated that in other embodiments, liquid may be present, e.g., as described above with reference to FIG. 1A. Beads 122 may be magnetically responsive. Additionally, FIG. 2A shows that third plunger 226 and magnet 230 are in a raised position relative to the tip of second plunger 222 and, thus, magnet 230 exerts no magnetic field upon beads 122 as the tip of second plunger 222 is essentially in a non-magnetic state.

Referring to FIG. 2B, a quantity of liquid 130 flows into body 210 by use of first plunger 218 of syringe 200. Beads 122 become suspended within liquid 130 that is now within body 210 of syringe 200. Target substances of liquid 130 bind to beads 122. FIG. 2B shows that third plunger 226 and magnet 230 are still in a raised position relative to the tip of second plunger 222 and, thus, magnet 230 still exerts no magnetic field upon beads 122.

Referring to FIG. 2C, a portion of second plunger 222 is then pushed toward tip 214 and into the liquid reservoir of body 210. As a result, the tip of second plunger 222 is surrounded by liquid 130 that has beads 122 suspended therein. Third plunger 226 and magnet 230 are still in a raised position relative to the tip of second plunger 222 and, thus, magnet 230 still exerts no magnetic field upon beads 122.

Referring to FIG. 2D, third plunger 226 and magnet 230 are pushed toward a tip of second plunger 222 until magnet 230 is substantially engaged at the tip of second plunger 222. The tip of second plunger 222 essentially becomes magnetic due to the magnetic field of magnet 230. Magnetically responsive beads 122, which have the target substance bound thereon, are attracted to an outer surface of second plunger 222, immobilizing beads 222. Beads 222 may be removed from the solution by withdrawing second plunger 222 and third plunger 226 from syringe body 210. Beads 222 may be introduced into a microfluidic device, such as a droplet actuator, for further processing and/or analysis. For example, beads 222 may be subjected to a droplet-based assay protocol on a droplet actuator for analyzing the target substance.

Referring to FIG. 2E, by pushing first plunger 218, second plunger 222, and third plunger 226 with magnet 230 substantially toward tip 214 of syringe 200, liquid 130 may be partially or substantially completely expelled. Beads 122 only may remain behind within body 210 of syringe 200, as shown in FIG. 2E.

In some embodiments, the plungers may then again be placed in a position similar to the position shown in FIG. 2D, in which second plunger 222 and third plunger 226 are together inserted into the interior space of syringe body 210 to capture the magnetically responsive beads. Beads 222 may be introduced into a microfluidic device, such as a droplet actuator, for further processing and/or analysis. For example, beads 222 may be subjected to a droplet-based assay protocol on a droplet actuator for analyzing the target substance.

Optionally, after the above-described process is completed, an beads 222 may be subjected to an additional washing operation. For example, process 20 or may be repeated using a wash buffer in place of liquid 130. The result is a clean set of beads 122 that have the target substances bound thereon. Beads 222 may then be introduced into a microfluidic device, such as a droplet actuator, for further processing and/or analysis. For example, beads 222 may be subjected to a droplet-based assay protocol on a droplet actuator for analyzing the target substance.

Figure 3:
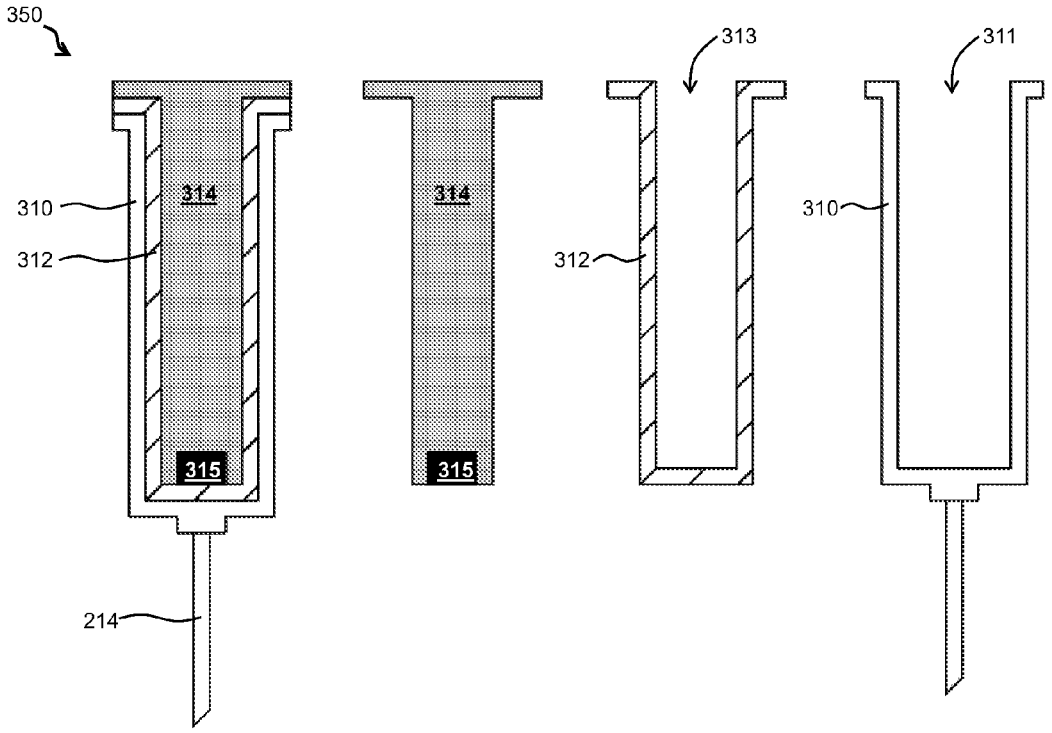
FIG. 3 illustrates a two plunger syringe device and a process that uses the syringe device in combination with beads and a magnet for providing a droplet with an increased concentration of target substance.

FIG. 3 shows an alternative configuration of a syringe-type sample concentration device 100 of the invention. Device 100 illustrates a two plunger layout, including body 310, first plunger 312 and second plunger 314. Body 310 includes chamber 311 configured for slidable insertion of first plunger 314. First plunger 314 may be slidably inserted into chamber 311 and used for forcing liquid into and out of chamber 311. Second plunger 314 includes magnet 315 at a distal tip thereof. Magnet 315 may include a permanent magnet and/or an electromagnet. First plunger 312 may include slot 313 for insertion of second plunger 314. Second plunger 314 may be slidably inserted into slot 313 to move magnet 315 towards or away from a distal end of first plunger 314. When it is desirable to attract magnetically responsive beads from chamber 311, second plunger 314 may be inserted into slot 313 to effect such attraction. For example, second plunger 314 may be substantially completely inserted into slot 313 to effect such attraction. First plunger 312 with second plunger 314 may then be removed from chamber 311 to remove immobilized beads. Beads prepared using this technique may be introduced into a microfluidic device, such as a droplet actuator, for further processing and/or analysis. For example, beads may be subjected to a droplet-based assay protocol on a droplet actuator for analyzing the target substance. Alternatively, the target substance may be eluted from the beads and introduced into a microfluidic device for analysis.

Figure 4:
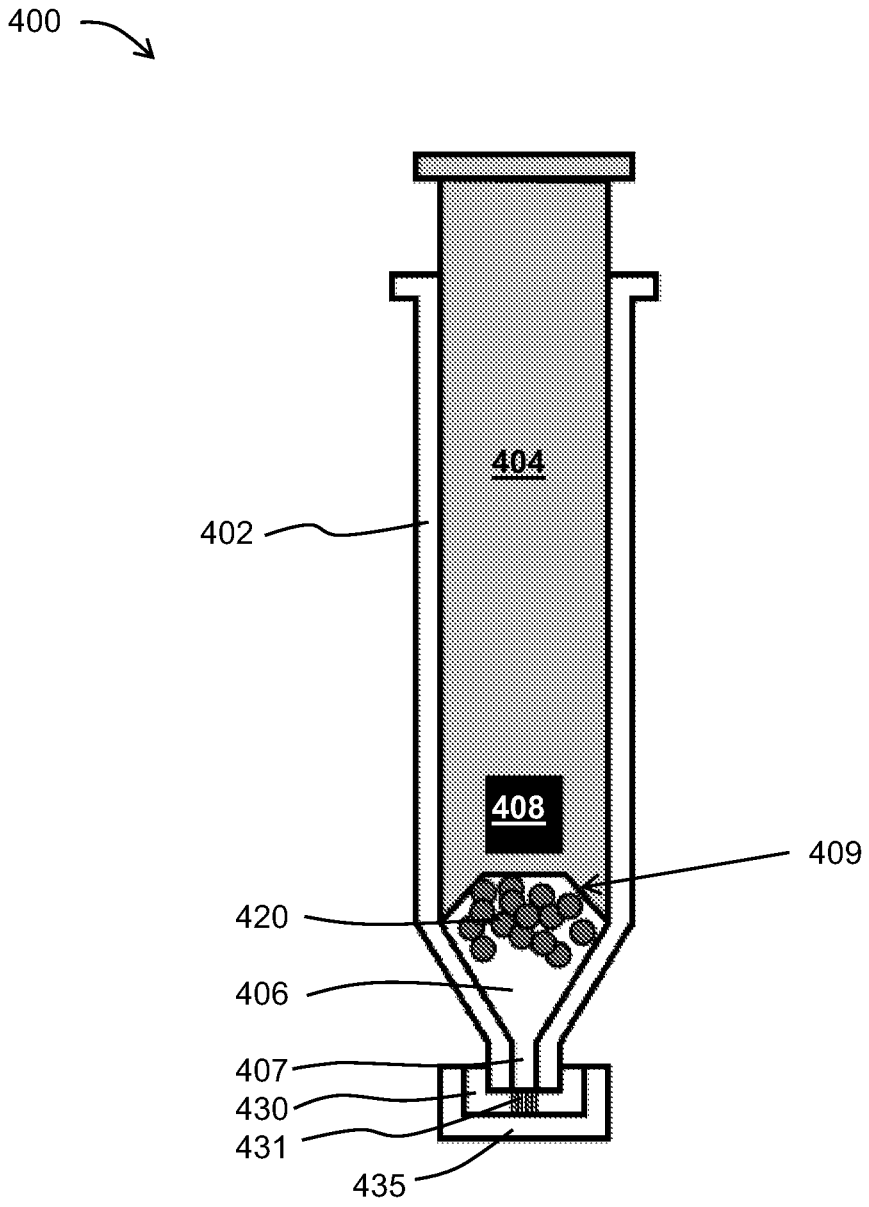
FIG. 4 illustrates a single-plunger syringe device and a process that uses the syringe device in combination with beads and a magnet for providing a droplet with an increased concentration of target substance.

FIG. 4 illustrates syringe 400 for collecting or concentrating magnetically responsive beads. Syringe 400 illustrates a single-plunger device including syringe body 402 and plunger 404. Syringe body 402 includes an interior volume 406 and an opening 407 for flowing liquid or other fluids into and out of interior volume 406. Plunger 404 may be slidably inserted into interior volume 406. Plunger 404 may be used for forcing liquid or other fluids into and out of opening 407. Plunger 404 includes an electromagnet 408 configured for attracting magnetically responsive beads 420 which may be included in interior volume 406. In one embodiment, electromagnet 408 may be activated when it is desirable to attract magnetically responsive beads 420 and deactivated when it is not desirable to attract magnetically responsive beads 420, such as during mixing and/or washing operations. In the specific embodiment illustrated, plunger 404 also includes recessed region 409 at a distal end thereof, for further aggregating magnetically responsive beads attracted by electromagnet 408. Plunger 404 with electromagnet 408 activated and beads 420 immobilized thereon, may be removed from interior volume 406. Beads may be transferred elsewhere and released by deactivating electromagnet 408. Beads 420 prepared by the process may be introduced into a microfluidic device, such as a droplet actuator, for further processing and/or analysis. For example, beads 420 may be subjected to a droplet-based assay protocol on a droplet actuator for analyzing the target substance. Syringe 400 may also include a filter cap 430, which is fitted onto a distal tip of syringe body 402. Filter cap 430 includes a filter region 431 which includes liquid passages sufficiently large to permit a sample to traverse the filter region 431 while retaining beads 420. Syringe 400 may also include a cap 435, which sealably covers filter region 431. Such filters and/or caps may be also be provided with other syringe embodiments of the invention.

Figure 5:
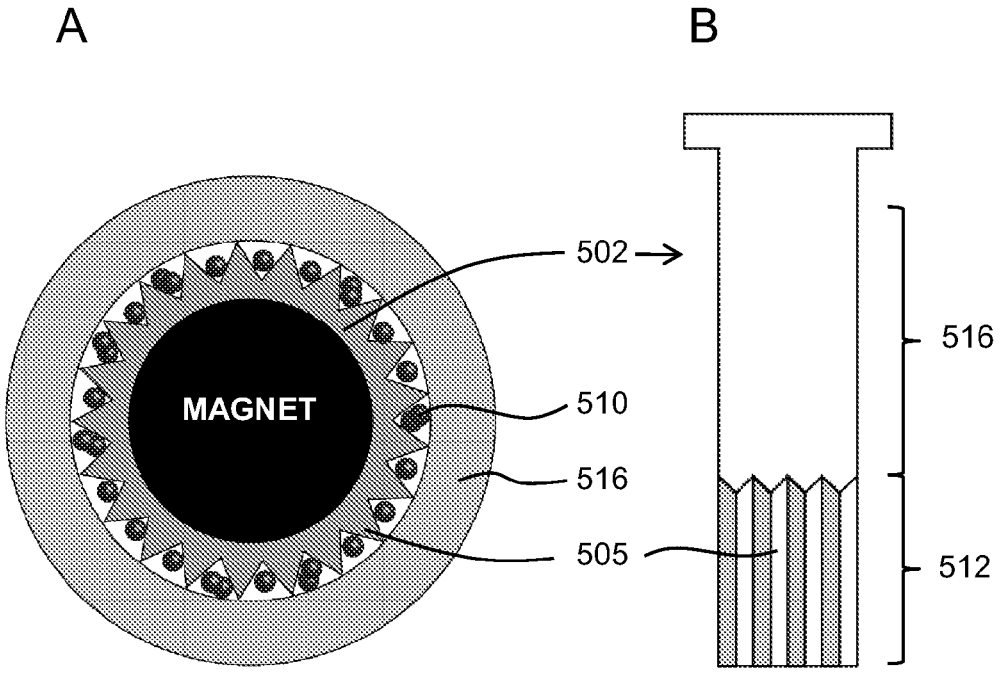
FIG. 5 illustrates an embodiment of a syringe with a plunger including grooves along a region thereof for holding beads.

FIG. 5 illustrates an embodiment of a plunger 502 for a syringe. Plunger 502 includes ridged region 512 with grooves 505 for holding beads 510. Grooves 505 may be longitudinal along an axis of plunger. Any other arrangement of grooves or divots suitable for holding beads 510 is within the scope of the invention. Ridged region 512 with grooves 505 may be located at a distal end region of plunger 502, while a more proximal region 516 may be configured to sealably and slidably fit within a syringe body or within another plunger for forcing liquid into and out of a syringe body. FIG. 5A illustrates an embodiment with a cross-sectional view of distal end region 502 within sleeve 516. Sleeve 516 may represent a syringe body or another plunger (e.g., first plunger 218 of FIG. 2). Plunger 502 may include a magnet, e.g., an electromagnet and/or a permanent magnet. For example, the magnet may be located within distal end region 502 to attract magnetically responsive beads 510 into grooves 505 of distal end region 502. Magnetically responsive beads 510 may be retained in grooves 505 of distal end region 502 while plunger 502 is removed. The magnet may then be mechanically removed, e.g., using a magnet on a plunger set-up as described with respect to FIGS. 2 and 3 and/or by deactivating the electromagnet to release magnetically responsive beads 501 from grooves 505. Beads 510 may be introduced into a microfluidic device, such as a droplet actuator, for further processing and/or analysis. For example, beads 520 may be subjected to a droplet-based assay protocol on a droplet actuator for analyzing the target substance.

Figure 6:
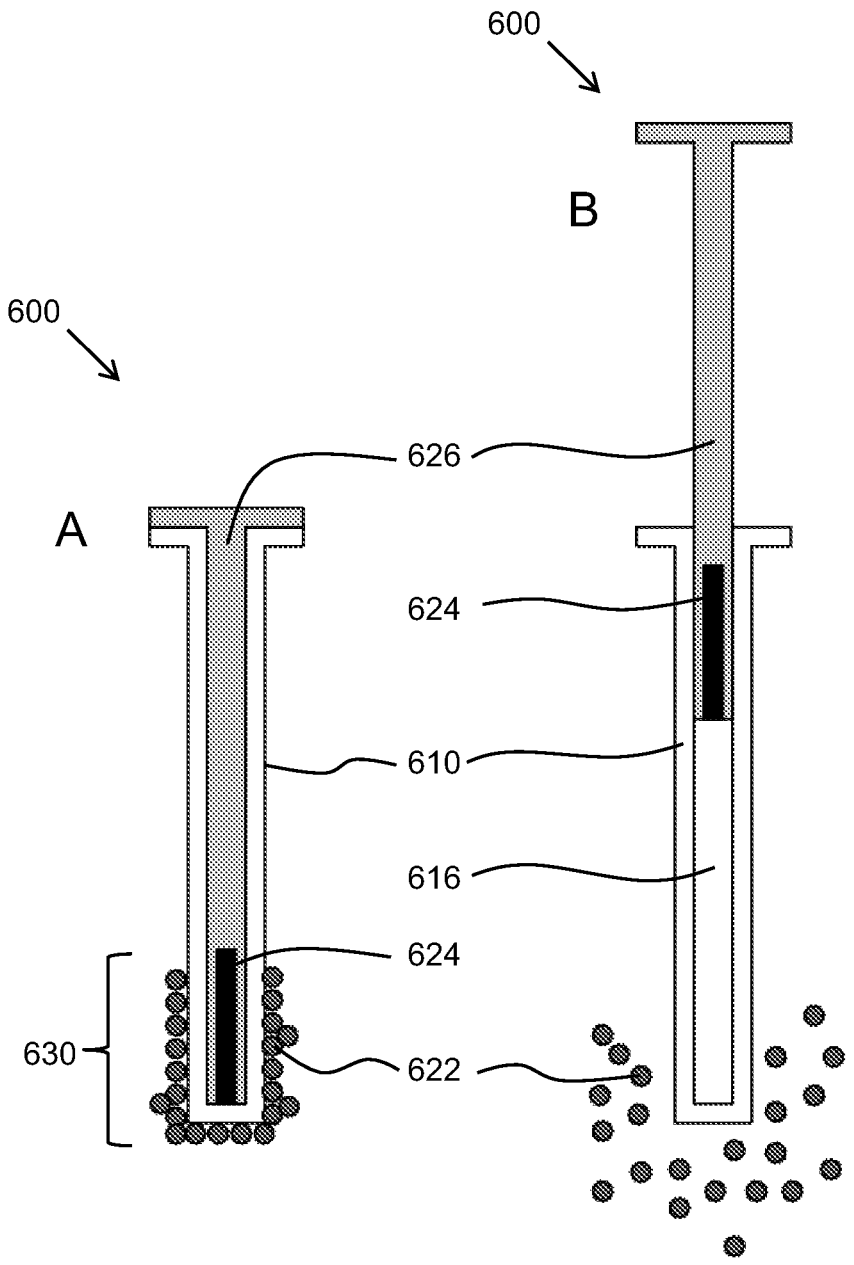
FIG. 6 illustrates a magnetic swab device for collecting magnetically responsive beads.

FIG. 6 illustrates a magnetic swab device 600 for collecting magnetically responsive beads 622. Magnetic swab device 600 includes swab body 610 including channel 616. Channel 616 is adapted for slidable insertion of magnet plunger 626. Magnet plunger 626 includes means for generating a magnetic field, such as magnet 624. The magnetic field is preferably generated from a distal region of magnet plunger 626, e.g., by a magnet 624 at a distal region of magnet plunger 626. Magnet plunger 626 is adapted to slidably fit within channel 616.

Magnetic swab device 600 may be used to releasably collect magnetically responsive beads. With magnet plunger 626 inserted in channel 616, e.g., as shown in FIG. 6A, magnetically responsive beads 622 are attracted to distal region 630 of magnetic swab device 600. With magnet plunger 626 retracted in channel 616, e.g., as shown in FIG. 6A, or removed from channel 616, magnetically responsive beads 622 are released from distal region 630 of magnetic swab device 600.

In practice, magnetic swab device with magnet plunger 626 inserted in channel 616, e.g., as shown in FIG. 6A, may be brought into proximity with beads 622 to capture beads 622. Beads 622 are attracted to and immobilized on a surface of swab body 610 by magnet 624. Magnet plunger 626 may then be withdrawn to release magnetically responsive beads 622. Beads 626 may, for example, be introduced into a droplet actuator for processing. For example, the beads 626 may be subjected to a droplet-based assay protocol on a droplet actuator for analyzing the target substance. In one embodiment, magnetic swab device with magnet plunger 626 may be inserted in channel 616 and magnetically responsive beads immobilized thereon may be inserted into a droplet actuator and/or a droplet actuator reservoir; magnet plunger 626 may then be released to release magnetically responsive beads 622 into the droplet actuator and/or droplet actuator reservoir.

In an alternative embodiment, rather than mechanically removing magnet 624, a magnetic swab device may include an electromagnet. For example, the invention may make use of an electromagnet on a stem. A user may hold the electromagnet by the stem, and stir the electromagnet in a sample comprising magnetically responsive beads. The magnetically responsive beads will be bound on the electromagnet or a surface of the magnetic swab. The beads may then be removed, and released by deactivating the electromagnet. For example, the portion of the magnetic swab device on which the beads are immobilized may be inserted into a reservoir associated with a droplet actuator, and the electromagnet may be deactivated to release the beads in the reservoir on the droplet actuator.

Figure 7:
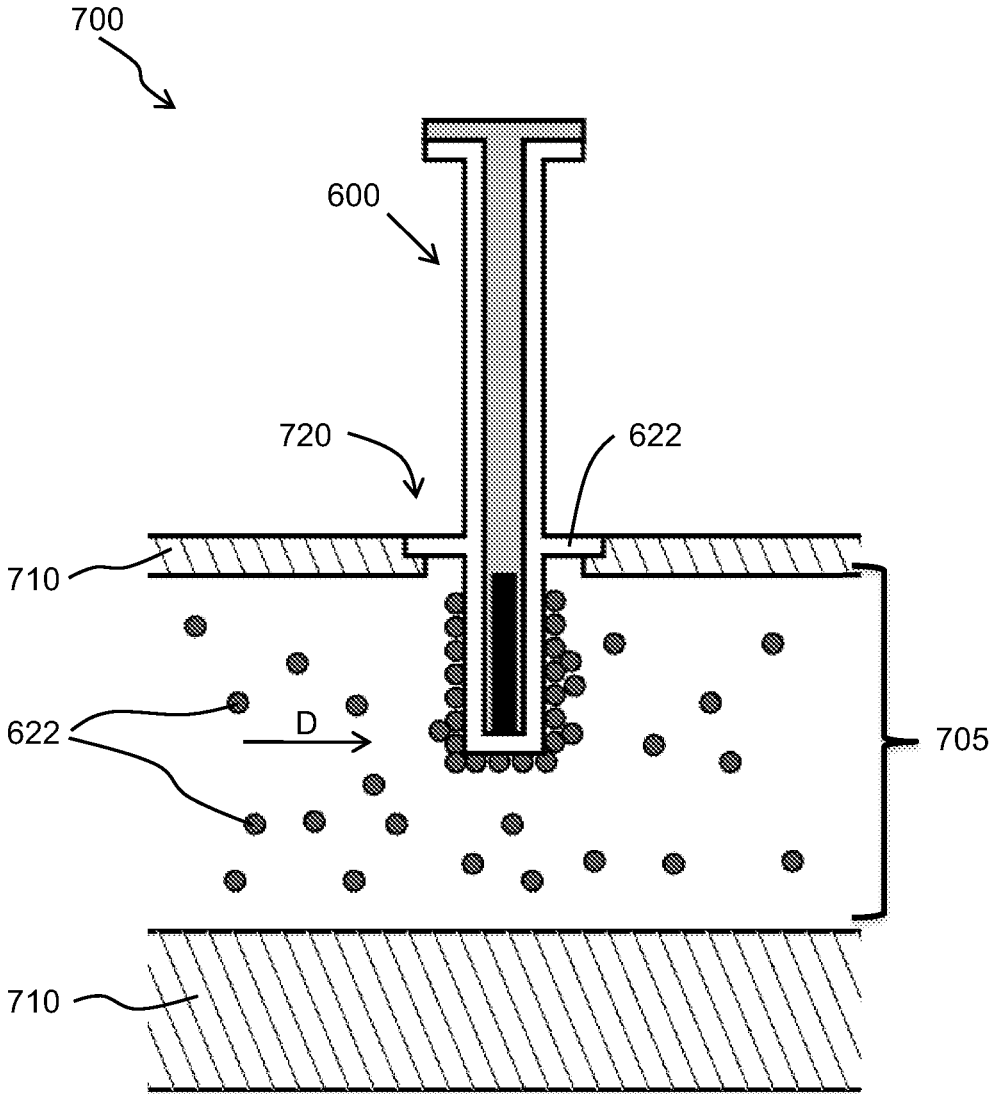
FIG. 7 illustrates a side view of a collection module that is designed for collecting magnetically responsive beads using a magnetic swab, such as the magnetic swab device illustrated in FIG. 6.

FIG. 7 illustrates a side view of a collection module 700 that is designed for collecting magnetically responsive beads using a magnetic swab, such as magnetic swab device 600 illustrated in FIG. 6. Collection module 700 includes liquid channel 705 bounded by channel walls 710. Collection module 700 may include an inlet and an outlet for flowing liquid into and out of liquid channel 705. Sample liquid that includes a quantity of beads 622 may enter channel 705 via one or more inlets and flow out of channel 705 via one or more outlets. Additionally, collection module 700 includes an opening 720 for insertion of magnetic swab device 600. Opening 720 is adapted for receiving magnetic swab device 600 in a manner that allows distal region 630 thereof to enter the flow path of sample liquid 522. Opening 520 may be adapted such that magnetic swab device 600 may be sealably inserted therein. For example, opening 720 may include one or more fittings which correspond to fittings on magnetic swab device 600. Fittings may, for example, include sealing devices, such as one or more male/female fittings, gaskets, threading, etc., designed to fit with corresponding structures 722 on magnetic swab device 600 and thereby seal magnetic swab 600 in place.

In operation, a magnetic swab, such as magnetic swab device 600, is inserted into opening 720 such that, for example, a distal region 630 of the magnetic swab is in the flow path of sample liquid 622. With magnet plunger 626 inserted in channel 705, e.g., as shown in FIG. 6A, magnetically responsive beads 622 are attracted to a distal region 630 of magnetic swab device 600 as liquid including magnetically responsive beads 622 flows past distal region 630 of the magnetic swab. In this manner, magnetically responsive beads 122 are collected on tip 418 of magnetic swab 400. The magnetic swab may then be removed with collected beads immobilized thereon, and the captured beads may be subjected to further manipulations or analyses, e.g., as described above. The size of channel 705 may be established relative to the size of distal region 630 and magnet 624 to ensure capture of all beads 622 that flow through channel 705. The liquid flowing through channel 705 may in some cases be recirculated until all beads 622 are captured. The direction of flow D may be reversed one or more times to enhance bead capture. A vortex may be established in channel 705 to bring beads 622 into proximity with distal region 630. Instead of channel, any of a variety of alternative structures for flowing or circulating liquid may be used. For example, rather than a channel, a circular reservoir may be used, with the means for circulating liquid in the circular reservoir, such as a stir bar or pump. The magnetic swab device may itself be rotated within channel 705 to expose greater surface area to the direct impact of beads flowing through channel 705.

Figure 8:
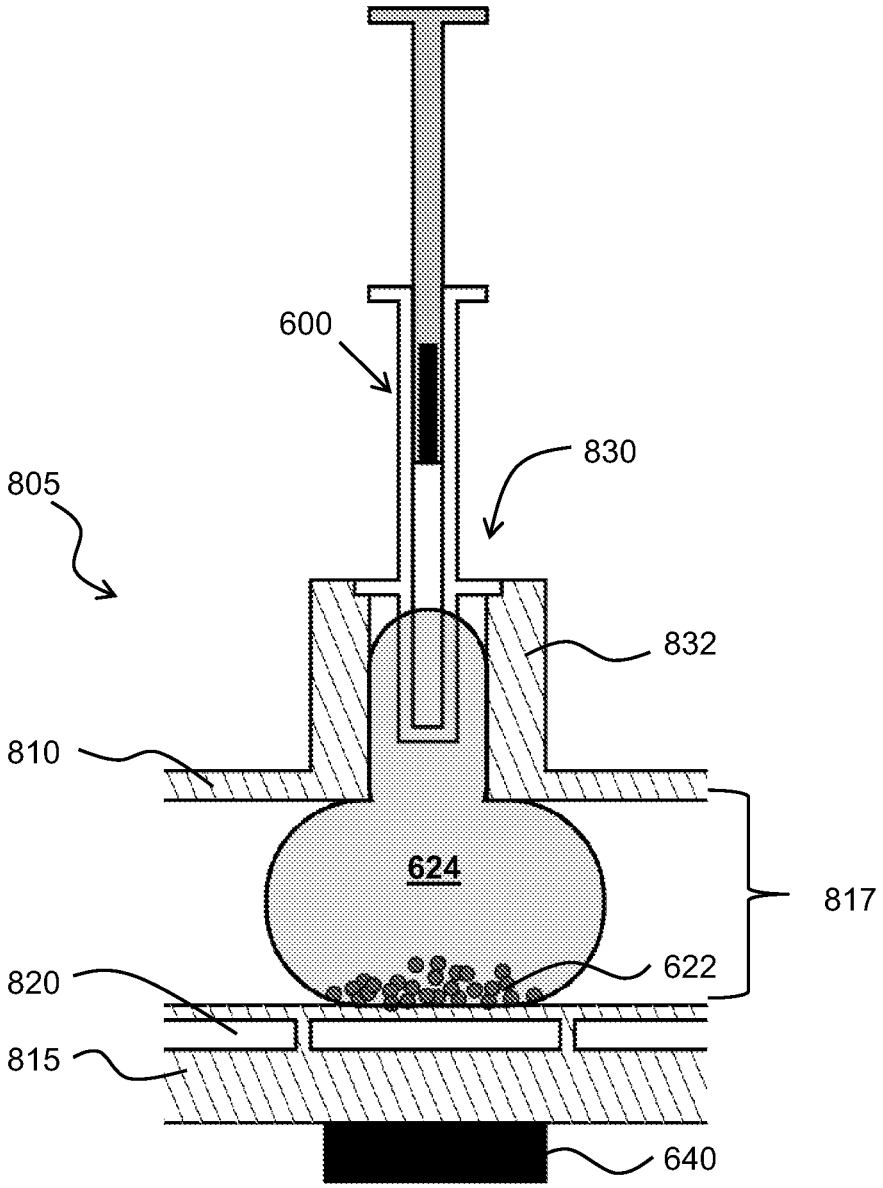
FIG. 8 illustrates a side view of beads being deposited on a droplet actuator device using a magnetic swab, such as the magnetic swab device illustrated in FIG. 6.

FIG. 8 illustrates a side view of beads 622 being deposited on droplet actuator device 805 using a magnetic swab, such as magnetic swab device 600 illustrated in FIG. 6. Droplet actuator device 805 includes top substrate 810 and bottom substrate 815 separated from one another to provide droplet operations gap 817. Either or both substrates 810 and 815 may include one or more electrodes 820. Electrodes 820 may be configured for conducting one or more droplet operations. Top substrate 810 may include an opening 830 for insertion of magnetic swab device 600. Opening 830 may be adapted for receiving magnetic swab device 600 in a manner that allows distal region 630 thereof to enter droplet 624 situated on droplet actuator 805. For example, droplet 624 may be situated at least partially in gap 817 of droplet actuator 805. Similarly, droplet 624 may be situated at least partially in a reservoir on top substrate 810 of droplet actuator 805. Opening 830 may be adapted such that magnetic swab device 600 may be sealably inserted therein. For example, opening 830 may be provided as part of receptacle 832. Receptacle 832 may be fitted to magnetic swab device 600 and may include sealing devices, such as one or more fittings, gaskets, threading, etc., designed to fit with corresponding structures 722 on magnetic swab device 600 and thereby seal magnetic swab device 600 in place. Magnet 640 may be associated with bottom substrate 815. For example, magnet 640 may be situated outside bottom substrate 815, partially inside bottom substrate 815, or completely inside bottom substrate 815. Any configuration is suitable, so long as magnet 815 produces a magnetic field sufficient to attract magnetically responsive beads 622 in droplet 624 to a specific surface or region within droplet 624, such as within a region of droplet 624 that is situated within the droplet operations gap 817.

In operation, a magnetic swab, such as magnetic swab device 600, loaded with magnetically responsive beads 622 is inserted into opening 830 such that magnetically responsive beads 622 are submersed in droplet 624. Magnet plunger 626 may then be released to release magnetically responsive beads 622 into droplet 624. Alternatively, where the magnetic swab includes an electromagnet, the electromagnet may be deactivated to release the magnetically responsive beads 622 into droplet 624. Magnet 640 may be provided to attract freed magnetically responsive beads 622 to a specific surface or region within droplet 624.

Figure 9:
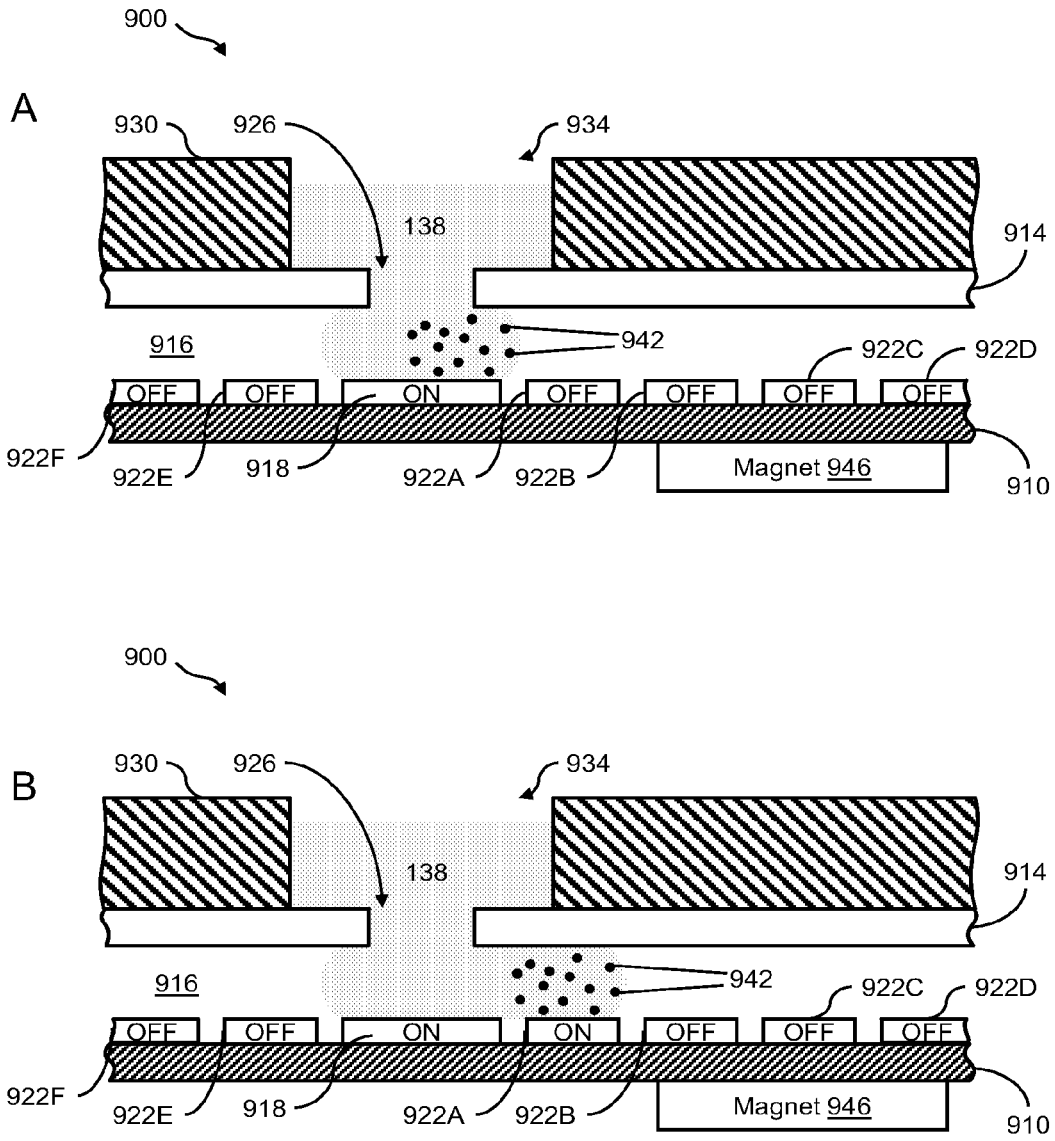
FIGS. 9-10 illustrate a side view of a portion of a droplet actuator and illustrate the use of a magnetic field in a process of dispensing droplets including magnetically responsive beads.
Figure 10:
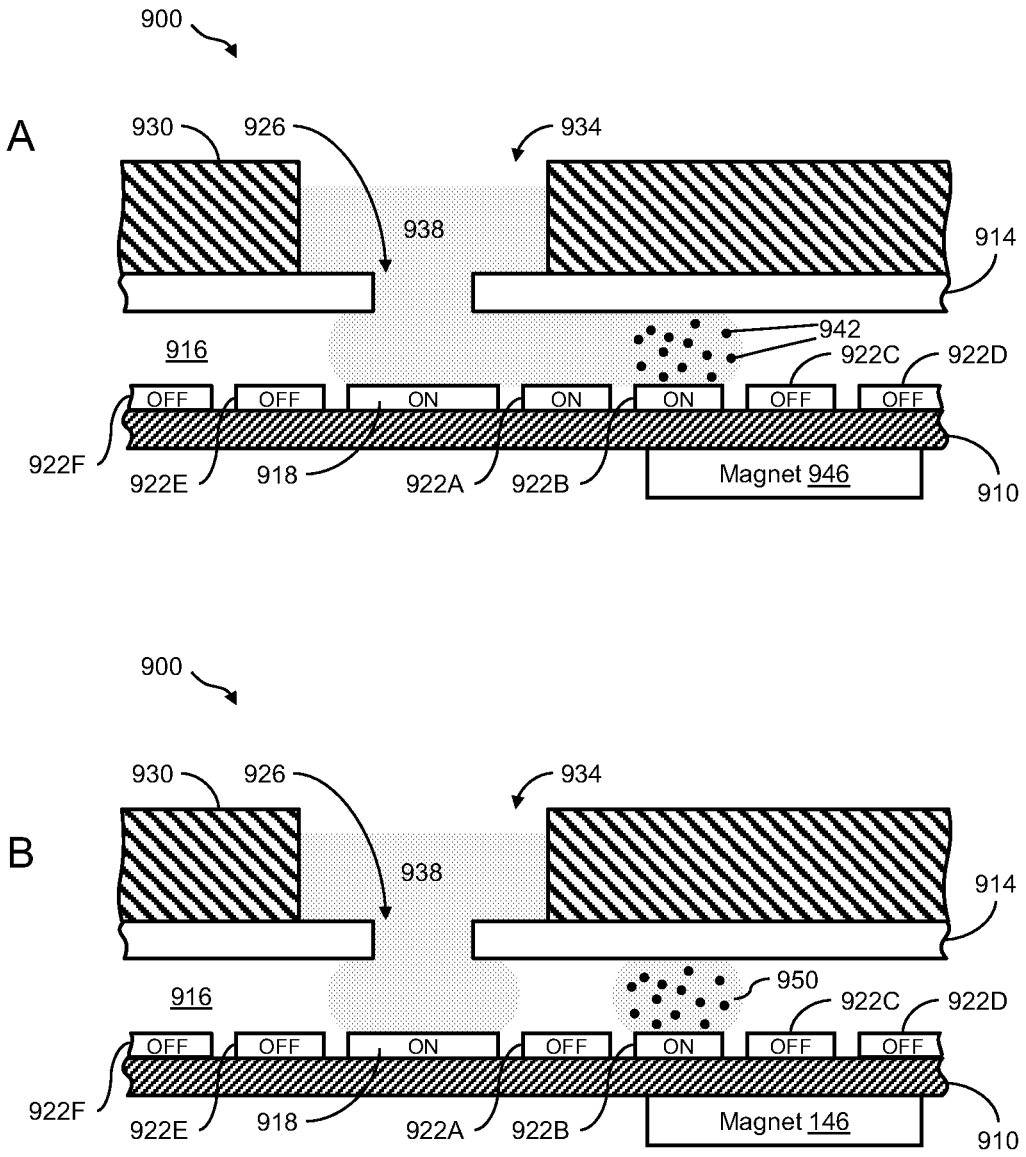

FIGS. 9-10 illustrate a side view of a portion of a droplet actuator 900. This example illustrates the use of a magnetic field in a process of dispensing droplets including magnetically responsive beads. Droplet actuator 900 may include a top substrate 914 and a bottom substrate 910. Bottom substrate 910 may be separated from top substrate 914 by a droplet operations gap 916. A reservoir electrode 918 may be disposed on bottom substrate 910. Reservoir electrode 918 may be arranged in association with a path or array of droplet operations electrodes 922 (e.g., electrowetting and/or dielectrophoresis electrodes) associated with top substrate 914 and/or bottom substrate 910. A droplet may be dispensed from reservoir electrode 918 onto droplet operations electrodes 922. Reservoir electrode 918 is illustrated as being larger than droplet operations electrodes 922, but it may be the same size or smaller. In some cases, reservoir electrode 918 is simply replaced with another droplet operations electrode 922. As with other bottom substrates described herein, bottom substrate 910 may, for example, be formed of a printed circuit board (PCB), silicon-based materials, or another suitable material. As with other top substrates described herein, top substrate 914 may be formed of, for example, PCB, silicon based materials, glass, plastic or another suitable material. An opening 926 is provided within top substrate 914, establishing a liquid path from reservoir 934 into gap 912 into sufficient proximity with reservoir electrode 918 to permit an electric field from the electrode to interact with a liquid flowed through the liquid path. In some cases, opening 926 may be substantially aligned with, or slightly overlapping, reservoir electrode 918.

Substrate 930 may be provided atop top substrate 914. Substrate 930 may include a reservoir 934 for including a quantity of liquid 938. Substrate 930 may, for example, be formed of PCB, silicon based materials, glass, plastic or another suitable substrate material. Substrate 930 may optionally be formed as an integral part of top substrate 914. Alternative liquid sources, such as reservoirs, reservoirs, syringes, pipettes, etc., may be used, so long as fluid path is provided which is capable of delivering liquid from such alternative sources into droplet operations gap 916.

Liquid 938 may include a quantity of beads 942. Beads 942 may include magnetically responsive beads 942 only or magnetically responsive beads along with beads that are not substantially magnetically responsive. Magnet 946 may be associated with droplet actuator 900. Magnet 946 may be arranged such that one or more droplet operations electrodes 922 are within the magnetic field of magnet 946. Magnet 946 may, for example, be a permanent magnet or an electromagnet. Magnet 946 may be used, for example, to aggregate the magnetically responsive beads 942. In operation, magnet 946 may be employed in a process of dispensing droplets including magnetically responsive beads. The magnetically responsive beads may be highly concentrated.

An example of a process of dispensing droplets that have a high concentration of magnetically responsive beads may include, but is not limited to, the following steps:

As illustrated in FIG. 9A, liquid 938 flows from reservoir 934 through opening 926 into gap 916. In this step, reservoir electrode 918 is activated and liquid 938 that has magnetically responsive beads 942 flows from reservoir 934 through opening 926 of top substrate 918 and onto reservoir electrode 918. Because of the magnetic field of magnet 946, magnetically responsive beads 942 within liquid 938 may be concentrated in a region of liquid 938 that is closest to magnet 946.

As illustrated in FIG. 9B, a droplet slug or droplet finger is formed by extending liquid 938 atop droplet operations electrode 922A. In this step, reservoir electrode 918 and droplet operations electrode 922A, which is adjacent to reservoir electrode 918, are activated. A droplet, droplet slug or droplet finger of liquid 938 flows away from reservoir electrode 918 along gap 916 of droplet actuator 900 atop the droplet operations electrode 922A and toward magnet 946. The magnetic field of magnet 946 concentrates magnetically responsive beads 942 in a region of the droplet slug or droplet finger that is closest to magnet 946.

As illustrated in FIG. 10A, the droplet slug or droplet finger may be extended atop droplet operations electrode 922B. In this step, reservoir electrode 918, the droplet operations electrode 922A, and droplet operations electrode 922B (adjacent to droplet operations electrode 922A) are all activated. A droplet slug or droplet finger of liquid 938 flows yet further along the gap 916 of droplet actuator 900 towards the vicinity of magnet 946. Magnet 946 attracts substantially all magnetically responsive beads 942 within liquid 938 in a region of the droplet slug or droplet finger that is closest to magnet 946. In this manner, the concentration of magnetically responsive beads 942 moves from droplet operations electrode 922A to droplet operations electrode 922B. It should be noted that the steps shown in FIGS. 9A, 9B and 9C may be effected in a sequential manner or in a substantially simultaneous manner. In one example, electrodes 918, 922A and 922B may be activated substantially simultaneously, causing the formation of a droplet finger or droplet slug that extends along all three electrodes. Activation may be simultaneous, substantially simultaneous, sequential in any order, or partially simultaneous and partially sequential.

As illustrated in FIG. 10B, droplet 950 is formed atop droplet operations electrode 922B. In this step, droplet operations electrode 922A is deactivated. Reservoir electrode 918 and droplet operations electrode 922B remain activated. Droplet 950 is formed atop droplet operations electrode 922B. Droplet 950 includes magnetically responsive beads 942. The method of the invention may be used to provide a high concentration of magnetically responsive beads 942 in droplet 950. It should be noted that a droplet may be formed by deactivation of any electrode or electrodes which are intermediate in the liquid path extending from reservoir 938 to electrode 922B. For example, a droplet on 922B may be formed by deactivating electrodes 918 and 922A. Similarly, a 2× droplet may be formed by deactivating electrode 918, leaving a 2× droplet on electrodes 922A and 922B.

The high concentration of magnetically responsive beads 942 in droplet 950 may result, at least in part, from the immobilization by magnet 946 of the magnetically responsive beads 942 at droplet operations electrode 922B during the droplet dispensing operation. Once the highly concentrated magnetically responsive bead-containing droplet 950 is formed, it may be subjected to other droplet operations within droplet actuator 900.

The method of the invention may be used, for example, to provide a droplet having a bead concentration which is at least 2× the bead concentration of a starting sample. The method of the invention may be used, for example, to provide a droplet having a bead concentration which is at least 5× the bead concentration of a starting sample. The method of the invention may be used, for example, to provide a droplet having a bead concentration which is at least 10× the bead concentration of a starting sample. The method of the invention may be used, for example, to provide a droplet having a bead concentration which is at least 50× the bead concentration of a starting sample. The method of the invention may be used, for example, to provide a droplet having a bead concentration which is at least 100× the bead concentration of a starting sample.

The method of the invention may be used, for example, to provide a droplet on a droplet actuator having a volume which is at least 20% v/v beads. The method of the invention may be used, for example, to provide a droplet on a droplet actuator having a volume which is at least 30% v/v beads. The method of the invention may be used, for example, to provide a droplet on a droplet actuator having a volume which is at least 40% v/v beads. The method of the invention may be used, for example, to provide a droplet on a droplet actuator having a volume which is at least 50% v/v beads.

The invention also provides a method of conducting a droplet operation on a droplet actuator using a droplet which is at least 20% v/v beads. The invention also provides a method of conducting a droplet operation on a droplet actuator using a droplet which is at least 30% v/v beads. The invention also provides a method of conducting a droplet operation on a droplet actuator using a droplet which is at least 40% v/v beads. The invention also provides a method of conducting a droplet operation on a droplet actuator using a droplet which is at least 50% v/v beads. T droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The droplet operation may be electrode-mediated. The droplet operation may, for example, be electrowetting-mediated or dielectrophoresis-mediated or Coulombic force-mediated. Other examples of techniques useful in such droplet operation include techniques that induce hydrodynamic liquid pressure, such as those that operate on the basis of mechanical principles (e.g. external syringe pumps, pneumatic membrane pumps, vibrating membrane pumps, vacuum devices, centrifugal forces, piezoelectric/ultrasonic pumps and acoustic forces); electrical or magnetic principles (e.g. electroosmotic flow, electrokinetic pumps, ferroliquidic plugs, electrohydrodynamic pumps, attraction or repulsion using a magnetic field and magnetohydrodynamic pumps); thermodynamic principles (e.g. gas bubble generation/phase-change-induced volume expansion); other kinds of surface-wetting principles (e.g. electrowetting, and optoelectrowetting, as reservoir as chemically, thermally, structurally and radioactively induced surface-tension gradients); gravity; surface tension (e.g., capillary action); electrostatic forces (e.g., electroosmotic flow); centrifugal flow (substrate disposed on a compact disc and rotated); a magnetic field (e.g., oscillating ions causes flow); magnetohydrodynamic forces; and vacuum or pressure differential.

Figure 11:
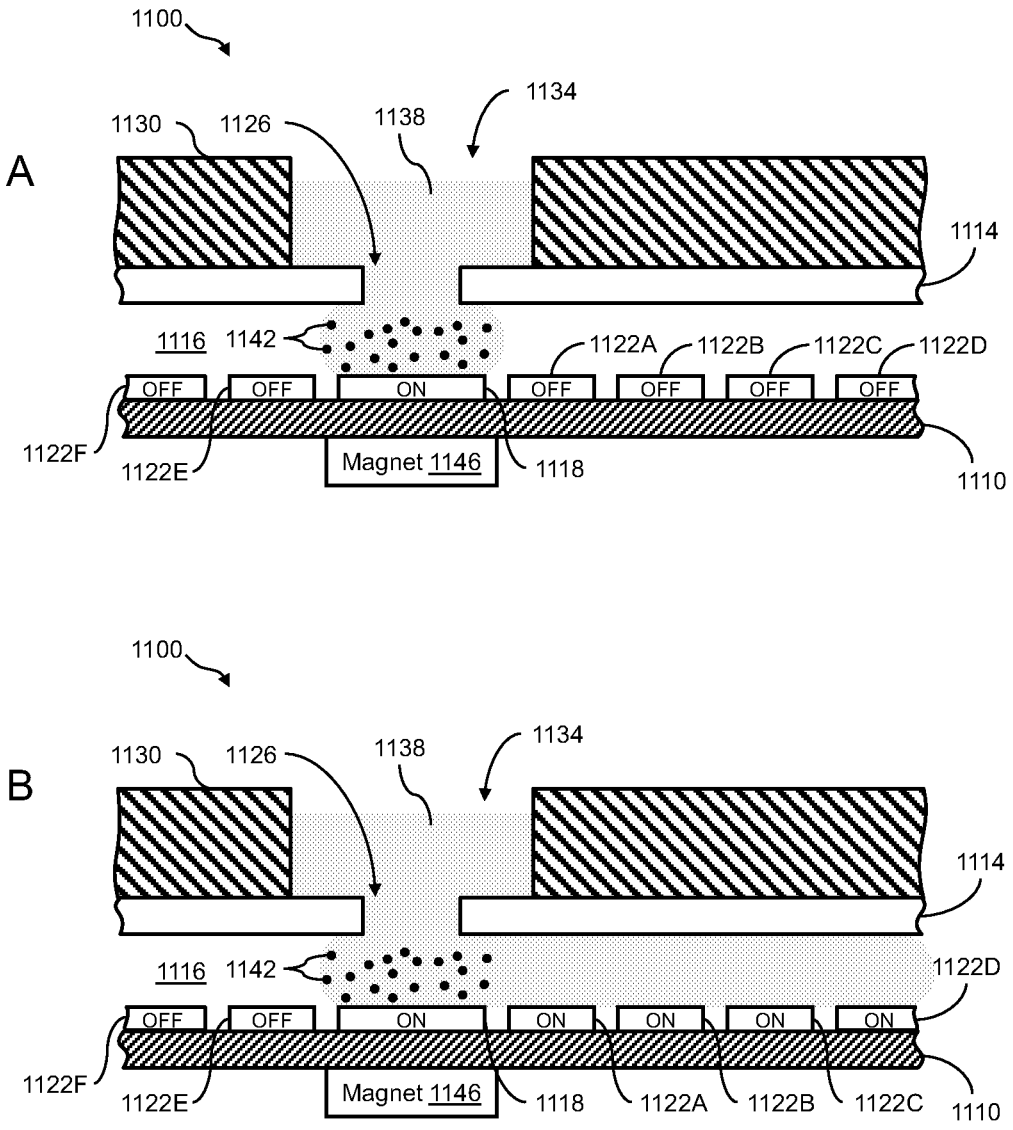
FIGS. 11-12 illustrate a side view of a section of droplet actuator and illustrate the use of a magnetic field in a process dispensing supernatant from a liquid including magnetically responsive beads without also dispensing the magnetically responsive beads.
Figure 12:
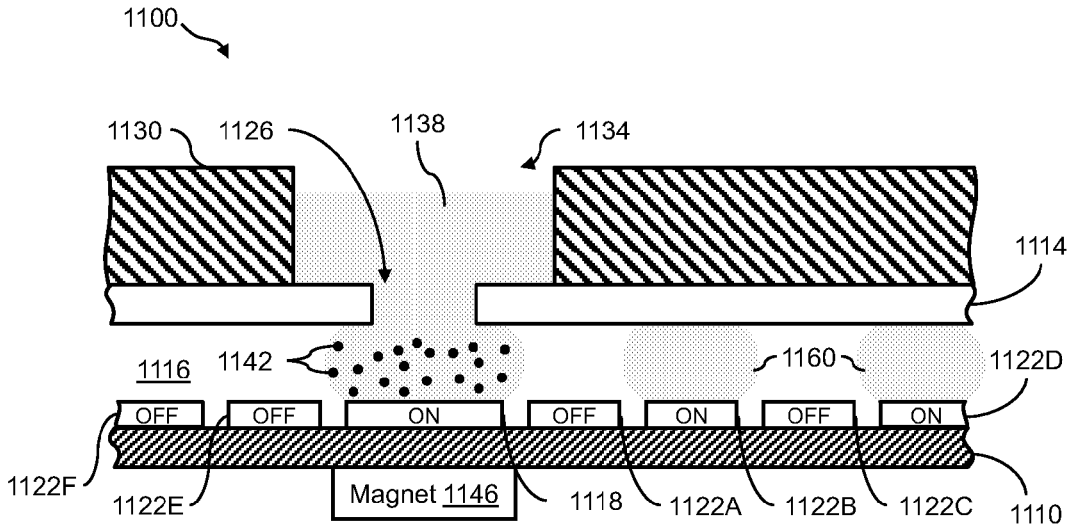

FIGS. 11-12 illustrate a side view of a section of droplet actuator 1100 and illustrate the use of a magnetic field in a process dispensing supernatant from a liquid including magnetically responsive beads without also dispensing the magnetically responsive beads. As compared to FIG. 1, magnet 1146 in FIGS. 11-12 is repositioned in relation to droplet actuator 1100 and the droplet dispensing operation. Magnet 1146 is associated with droplet actuator 1100 such that reservoir electrode 1118 is within the magnetic field of magnet 1146. In embodiments in which a reservoir electrode is omitted, magnet 1146 may be associated with droplet actuator 1100 such that a surface of droplet actuator 1100 in proximity to opening 1126 is within the magnetic field of magnet 1146. Magnet 1146 may attract and/or substantially immobilize magnetically responsive beads 1142 during a droplet dispensing operation. Supernatant may be dispensed without magnetically responsive beads. Magnetically responsive beads may be concentrated on a reservoir electrode. A contaminant may be removed by the magnetically responsive beads, and a supernatant droplet substantially free of the contaminant or having a reduced concentration of the contaminant relative to the starting material may be dispensed. A target substance may be eluted from the magnetically responsive beads using an elution buffer, and a droplet including the target substance but substantially lacking the magnetically responsive beads may be dispensed. Further, beads may capture target substance and contaminant, elute target substance, and dispense a droplet including the target substance but substantially lacking the contaminant Multiple target substances and multiple contaminants may be captured, and multiple target substances eluted for analysis.

As illustrated in FIG. 11A, reservoir electrode 1118 is activated, and liquid 1138 including magnetically responsive beads 1142 flows from reservoir 1134 through opening 1126 and onto reservoir electrode 1118. Magnet 1146 may immobilize substantially all magnetically responsive beads 1142 at the surface of reservoir electrode 1118.

As illustrated in FIG. 11B, reservoir electrode 1118 and any number of droplet operations electrodes 1122 may be activated to extend the liquid into gap 1112 to form a droplet droplet slug or droplet finger of liquid 1138. The droplet slug or droplet finger 1139 flows away from reservoir electrode 1118 along the gap 1116 of droplet actuator 1100. Activation of electrodes 1122 may proceed in any manner which results in formation of droplet slug or droplet finger 1139. For example, activation may be simultaneous, substantially simultaneous, sequential in any order, or partially simultaneous and partially sequential. The magnetic field of magnet 1146 retains substantially all magnetically responsive beads 1142 within liquid 1138. Magnetically responsive beads 1142 remain immobilized at the surface of reservoir electrode 1118, and the droplet finger of liquid 1138 is substantially free of magnetically responsive beads 1142. As a result, the droplet finger of liquid 1138 may be substantially pure supernatant.

As illustrated in FIG. 12, one or more intermediate droplet operations electrodes 1122 along the droplet slug or droplet finger of liquid 1138 is/are deactivated, while reservoir electrode 1118 and other droplet operations electrodes 1122 remain activated to dispense one or more droplets 1160. For example, droplet operations electrodes 1122A and 1122C may be deactivated, while reservoir electrode 1118 and droplet operations electrodes 1122B and 1122D remain activated. As a result, droplet operations electrodes 1122A and 1122C function as "pinch-off" electrodes and droplet operations electrodes 1122B and 1122D function as droplet forming electrodes. Droplets 1160 remain at droplet operations electrodes 1122B and 1122D. Because magnet 1146 immobilizes the magnetically responsive beads 1142 at the surface of reservoir electrode 1118 during the droplet dispensing operation, each droplet 1160 is substantially free of magnetically responsive beads 1142. Each droplet 1160 may be substantially pure supernatant.

Further, the method of the invention may be used to provide a high concentration of magnetically responsive beads 1142 in the liquid 1138 at reservoir electrode 1118. The high concentration of magnetically responsive beads 1142 in the liquid 1138 results from aggregation by magnet 1146 of magnetically responsive beads 1142 at reservoir electrode 1118 as liquid including beads is flowed across reservoir electrode 1118 during a series of droplet dispensing operation. Moreover, as supernatant flows across magnetically responsive beads 1142 aggregated by magnet 1146, magnetically responsive beads 1142 may capture additional target substance, thereby concentrating target substance on beads 1142. Similarly, when it is desirable to separate all magnetically responsive beads 1142 from a substantial amount of bead-containing liquid, the bead-containing liquid may be flowed past a magnet using the process described above, and supernatant may be pinched off as many times as needed until substantially all magnetically responsive beads 1142 have been flowed into sufficient proximity with magnet 1146 to be aggregated or substantially immobilized by the magnetic field of magnet 1146. In this manner, a larger volume of liquid may be processed to remove all beads. Similarly, using this technique, a larger volume of liquid may be processed to concentrate all beads into a smaller droplet volume. In an alternative embodiment, magnet 1146 is selected and arranged relative to reservoir 1134 such that magnet 1146 attracts into gap 1116 and aggregates substantially all magnetically responsive beads 1142 present in reservoir 1134.

A process of dispensing supernatant may be repeated any number of times and supernatant droplets 1150 may be removed to waste, removed from droplet actuator 1100 for further analysis, and/or may be subjected to one or more analytical protocols within droplet actuator 1100. Once dispensing is complete, magnetically responsive beads 1142 at reservoir electrode 1118 may be resuspended. For example, magnetically responsive beads 1142 may be resuspended in fresh wash buffer. Magnet 1146 may be removed to facilitate resuspension of magnetically responsive beads 1142. A liquid with a high surface tension may be used to collect magnetically responsive beads 1142 from magnet 1146. The surface tension may be selected such that the force of the surface tension overcomes the force of the magnetic field of magnet 1146, thereby permitting the droplet to remove magnetically responsive beads 1142 from the magnetic field as the droplet is transported away from magnet 1146.

Magnetically responsive beads 1142 at reservoir electrode 1118 may be "snapped off," e.g., by moving magnet 1146 away from electrode 1118 and/or providing a separate droplet. In some cases, snapping off of magnetically responsive beads may be facilitated by establishing a concentration of magnetically responsive beads 1142 in liquid 1138 that is sufficiently high to permit a magnetic field to overcome interfacial tension forces; by establishing an interfacial tension in liquid 1138 that is sufficiently low to permit a magnetic field to overcome interfacial tension forces; and/or by applying a magnetic field of sufficient strength to overcome interfacial tension forces.

In a related embodiment, magnetically responsive beads 1142 are combined with non-magnetically responsive beads (not shown). Droplet operations may dispense droplets 1160 including non-magnetically responsive beads (not shown) while concentrating magnetically responsive beads 1142 at reservoir electrode 1118. Similarly, droplet operations may dispense droplets 1160 including non-magnetically responsive beads (not shown) while concentrating magnetically responsive beads 1142 at magnet 1146.

Figure 13:
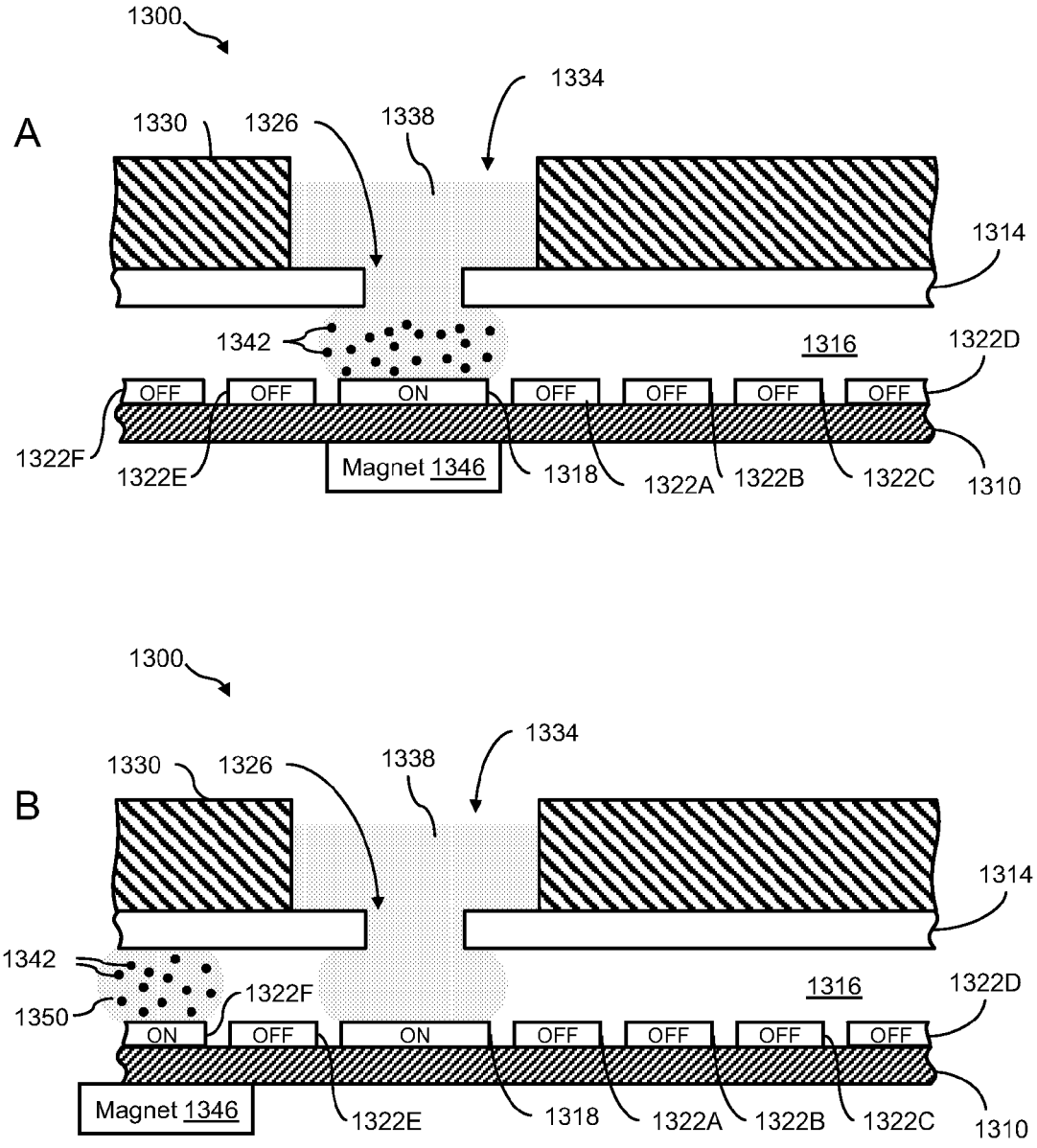

FIGS. 12-13 illustrate a side view of a portion of droplet actuator 1300 and a process of extracting beads from liquid and dispensing substantially bead-free droplets. Magnet 1346 is initially associated with droplet actuator 1300 such that reservoir electrode 1318 is within the magnetic field thereof. Similarly, magnet 1346 may be selected and positioned to attract magnetically responsive beads 1342 from within reservoir 1334 to an edge of liquid 1338 within gap 1316. Magnet 1346 may be movable, e.g., in an xy and/or z direction. Magnet 1346 may be used to attract and/or aggregate magnetically responsive beads 1342. Magnet 1346 may be used in a process of extracting magnetically responsive beads 1342 from liquid 1338. Similarly, magnet 1346 may be used in a process of extracting magnetically responsive beads 1342 from liquid 1338 and dispensing substantially bead-free droplets 1360.

The following steps are illustrative of a process of extracting beads from a liquid, such as a sample liquid or buffer liquid, and dispensing substantially bead-free droplets:

FIG. 13A shows a first step in a process of extracting beads from a liquid and dispensing substantially bead-free droplets. Reservoir electrode 1318 is activated and liquid 1338 that has magnetically responsive beads 1342 flows from reservoir 1334 through opening 1326 of top substrate 1318 and onto reservoir electrode 1318. The magnetic field of magnet 1346 aggregates substantially all magnetically responsive beads 1342 at an edge of liquid 1338 adjacent to the surface of substrate 1310 atop reservoir electrode 1318.

FIG. 13B shows another step in a process of extracting beads from a liquid and dispensing substantially bead-free droplets. In this step, magnet 1346 is repositioned away from reservoir electrode 1318. For example, magnet 1346 may be moved in an xy direction away from reservoir electrode 1318, and magnetically responsive beads 1342 may follow the movement of magnet 1346. Magnet 1346 may, for example, be placed in proximity to one or more droplet operations electrodes 1322, such as droplet operations electrode 1322F. In one embodiment, the movement of magnet 1346 causes a droplet including substantially all magnetically responsive beads 1342 to snap off and move to a position within gap 1316 atop the new position of magnet 1346. In another embodiment, one or more electrode-mediated droplet operations may be performed to dispense a bead-containing droplet 1350 and transport the bead-containing droplet 1350 to a droplet operations electrode 1322. Bead-containing droplet 1350 includes substantially all magnetically responsive beads 1342. The method may be used to provide a high concentration of magnetically responsive beads 1342 in bead-containing droplet 1350. The high concentration of magnetically responsive beads 1342 in bead-containing droplet 1350 results, at least in part, from the aggregation by magnet 1346 of magnetically responsive beads 1342. Magnetically responsive beads 1342 within liquid 1338 are attracted to the new position of magnet 1346, which is away from reservoir electrode 1318. Substantially all magnetically responsive beads 1342 may be present within dispensed bead-containing droplet 1350. Liquid 1338 that remains at reservoir electrode 1318 and in reservoir 1334 may be substantially free of magnetically responsive beads 1342.

Figure 14:
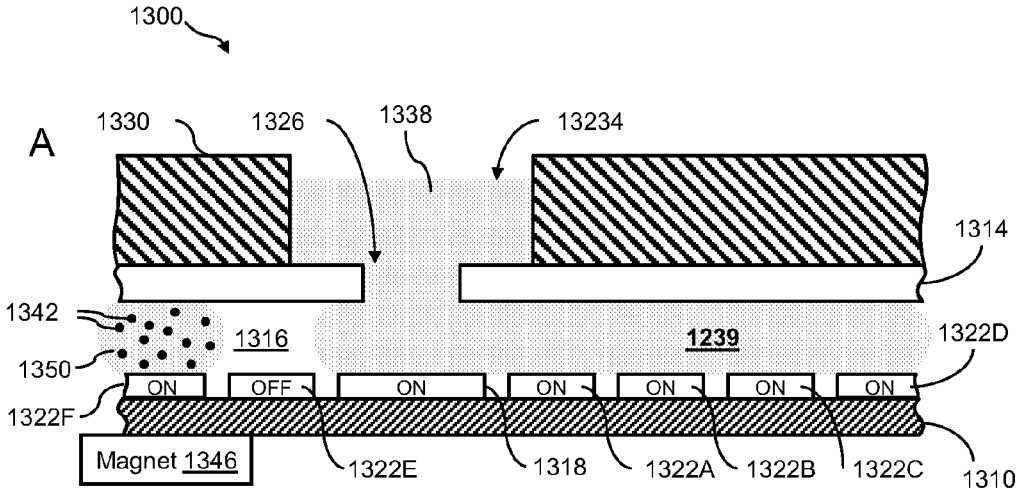
Figure 14:
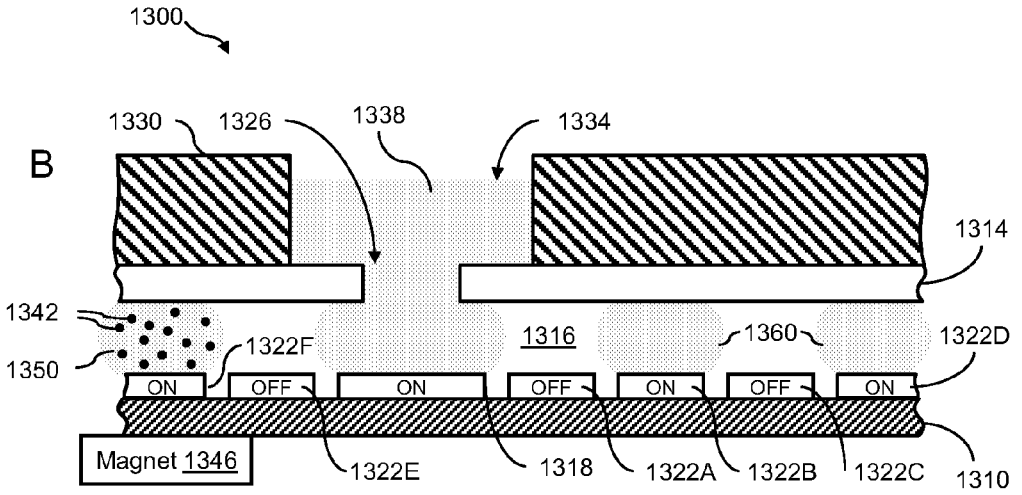

FIG. 14A shows another step in a process of extracting beads from a liquid and dispensing substantially bead-free droplets. Reservoir electrode 1318 and any number of droplet operations electrodes 1322 may be activated to form a droplet slug or droplet finger 1339 of liquid 1338 that flows away from reservoir electrode 1318 along gap 1316. For example, reservoir electrode 1318 and operations electrodes 1322A-D may be activated to cause formation of a droplet slug or droplet finger 1339 of liquid 1338 that extends along all four electrodes. Activation of electrodes 1322A-D may proceed in any manner which results in formation of droplet slug or droplet finger 1339. For example, activation may be simultaneous, substantially simultaneous, sequential in any order, or partially simultaneous and partially sequential. This droplet slug or droplet finger of liquid 1338 is substantially free of magnetically responsive beads 1342 because magnetically responsive beads 1342 remain separated (e.g., within bead-containing droplet 1350) from liquid 1338. As a result, the droplet finger 1339 of liquid 1338 may be substantially bead-free supernatant.

FIG. 14B shows yet another step in a process of extracting beads from a liquid and dispensing substantially bead-free droplets. One or more intermediate droplet operations electrodes 1322 along droplet slug or droplet finger 1339 of liquid 1338 are deactivated, while reservoir electrode 1318 and other droplet operations electrodes 1322 remain activated, resulting in the formation of one or more droplets 1360. For example, droplet operations electrodes 1322A and 1322C may be deactivated, while reservoir electrode 1318 and droplet operations electrodes 1322B and 1322D remain activated. As a result, droplet operations electrodes 1322A and 1322C function as "pinch-off" electrodes and droplet operations electrodes 1322B and 1322D function as droplet forming electrodes, forming droplets 1360 at droplet operations electrodes 1322B and 1322D. Because magnet 1346 aggregates magnetically responsive beads 1342 in bead-containing droplet 1350 during the droplet dispensing operation, each of the one or more droplets 1360 may be substantially pure bead-free supernatant.

Figure 15:
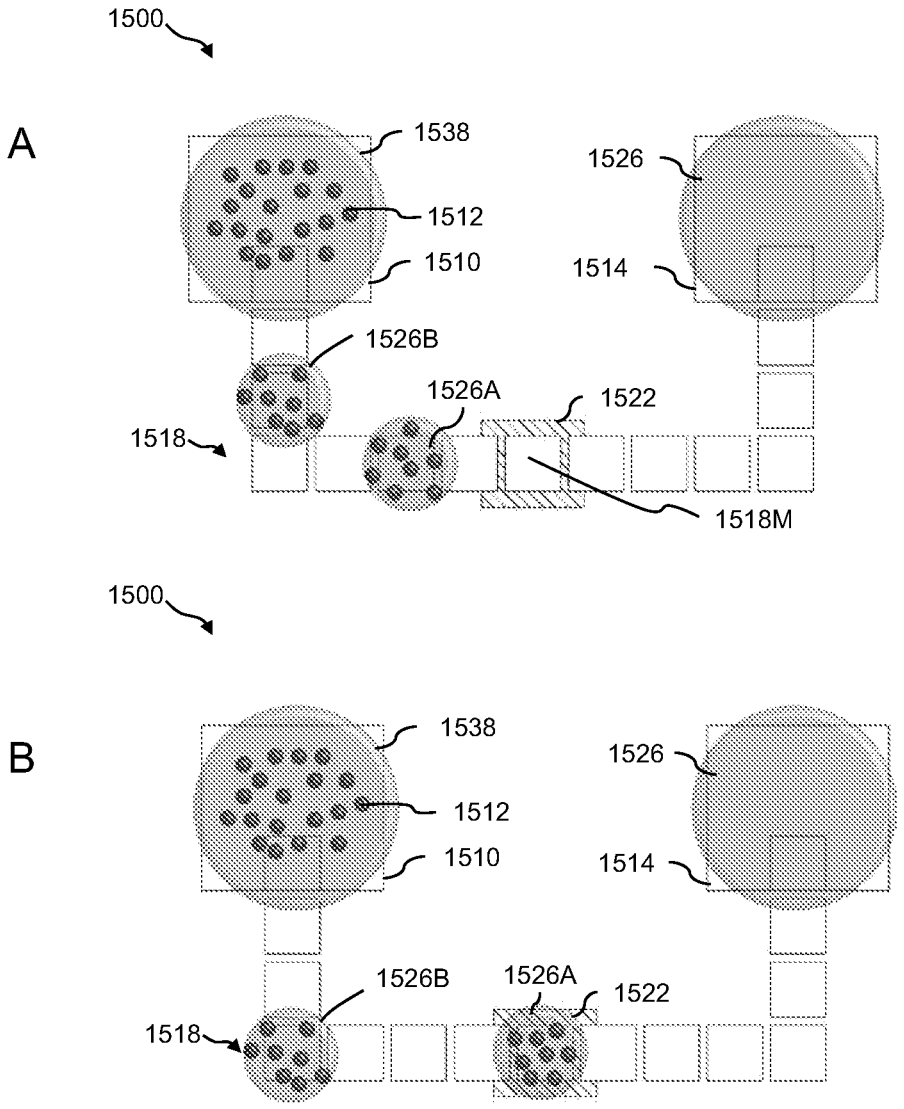
FIGS. 15-16 illustrate a top view of a portion of a droplet actuator and a magnetic field used in a process of pre-concentrating beads in a droplet.
Figure 16:
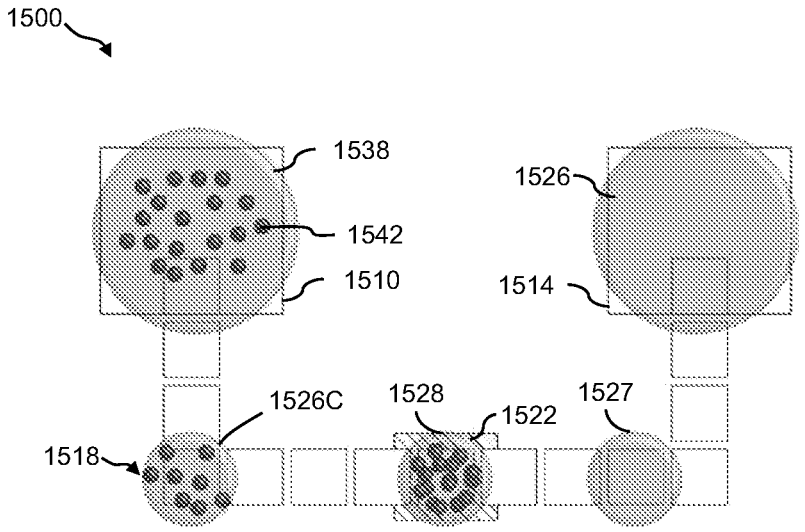

FIGS. 15-16 illustrate a top view of a portion of a droplet actuator 1500. A magnetic field is used in a process of pre-concentrating beads in a droplet. Droplet actuator 1500 includes supply reservoir electrode 1510 for dispensing bead-containing droplets and return reservoir electrode 1514 for receiving bead-free droplets. Reservoir electrodes are not required. In various alternatives, either or both reservoir electrodes may be replaced with an off-actuator liquid source, such as a liquid path into the droplet actuator gap (not shown) from an exterior of the droplet actuator. In one embodiment, a reservoir is provided in the top substrate, such as the reservoirs illustrated in the preceding embodiments of FIGS. 9-14 or other embodiments which follow.

Droplet actuator 1500 includes a supply reservoir electrode 1510 and a return reservoir electrode 1514. These reservoirs may be arranged in relation to a path or array of droplet operations electrodes 1518 (e.g., electrowetting and/or dielectrophoresis electrodes) in any arrangement that permits droplets to be dispensed from supply reservoir electrode 1510 onto droplet operations electrodes 1518 and added to return reservoir electrode 1514 from droplet operations electrodes 1518. Supply reservoir electrode 1510 and return reservoir electrode 1514 are illustrated as being larger than droplet operations electrodes 1518, but their size may be the same or smaller than droplet operations electrodes 1518. In some cases, supply reservoir electrode 1510 and return reservoir electrode 1514 are simply replaced with other droplet operations electrodes 1518. In some cases, supply reservoir electrode 1510 and return reservoir electrode 1514 are replaced with an array of smaller electrodes. Liquid 138 that includes a quantity of magnetically responsive beads 142 is provided at supply reservoir electrode 1510 for processing within droplet actuator 1500.

Magnet 1522 that is associated with droplet actuator 1500 in proximity to a droplet operations electrode 1518M. Droplet operations electrode 1518M, is within the magnetic field of magnet 1522. Magnet 1522 is arranged to aggregate magnetically responsive beads on or in proximity to droplet operations electrode 1518M. Magnet 1522 may, for example, be a permanent magnet or an electromagnet. Magnet 1522 may be employed in a process of pre-concentrating beads in a droplet. The ensuing steps are illustrative of a process of pre-concentrating beads in a droplet may include:

FIG. 15A shows a first step in a process of pre-concentrating beads in a droplet. In this step, droplet operations are performed to dispense one or more bead-containing droplets 1526 from supply reservoir electrode 1510. In the example illustrated, droplet 1526A is first dispensed, followed by droplet 1526B. Each of droplets 1526A and 1526B includes one or more magnetically responsive beads 142. In a process of transporting droplets 1526A and 1526B along droplet operations electrodes 1518 from supply reservoir electrode 1510 toward return reservoir electrode 1514 (in subsequent steps), each of droplets 1526A and 1526B passes within the magnetic field of magnet 1522. As illustrated, the droplets are 1× droplets, meaning that they have a footprint which is about the same as, or slightly larger than, the footprint of a single electrode. In other cases, the droplets may be 2×, 3×, 15×, 5×, or larger, and in some cases, the droplets may take on a droplet slug-shaped configuration.

FIG. 15B shows another step in a process of pre-concentrating beads in a droplet. In this step, droplet 1526A is transported onto droplet operations electrode 1518M that is within the magnetic field of magnet 1522. Magnetically responsive beads 142 of droplet 1526A may be substantially immobilized and retained at droplet operations electrode 1518M. A droplet splitting operation may be used to separate out a portion of the liquid from droplet 1526A, while retaining another portion of droplet 1526A, including the magnetically responsive beads, in association with electrode 1518M. In the embodiment illustrated, 1× droplet 1526A is parked atop electrode 1518M. 1× droplet 1526B is then merged with 1× droplet 1526A to yield a 2× droplet. Electrode 1518M and adjacent electrodes are then used to split off bead free droplet 1527 while leaving a new droplet 1528 atop electrode 1518M. Droplet 1528 includes beads 1542 that originated in bead-containing droplets 1526A and 1526B. Assuming homogenous dispersion of beads in source droplet 1538, the concentration of beads in droplet 1528 has been effectively doubled relative to the concentration of beads in droplets 1526A and 1526B.

FIG. 15C shows yet another step in a process of pre-concentrating beads in a droplet. In this step, droplet 1527 with substantially no beads is transported away from magnet 1522 and toward return reservoir electrode 1514. Droplet 1528 remains atop electrode 1518M. A new bead-containing droplet 1526C is transported into contact with, and merged with, droplet 1528. Substantially all magnetically responsive beads 1542 of bead-containing droplets 1526 are retained at droplet operations electrode 1518. Droplets split off from the droplet atop electrode 1518M are substantially bead-free. In some cases, such droplets may include substantially non-magnetically responsive beads, while magnetically responsive beads 1542 are retained.

If it is desirable to provide intense concentration of beads at electrode 1518M, the electrodes included in splitting the droplet to yield a bead-containing droplet and a substantially bead-free droplet may be sized such that the electrode forming the bead-containing droplet is smaller than the electrode or electrodes forming the substantially bead-free droplet. Similarly, the droplet splitting operation may be effected using common electrode sizes such that, for example, the bead-containing droplet is smaller than the electrode or electrodes forming the substantially bead-free droplet. For example, the bead-containing droplet may be a 1× droplet formed atop a single electrode while the substantially bead-free droplet may be a 2× or larger droplet formed atop a larger electrode or atop multiple electrodes.

As already noted, a splitting operation at electrode 1518M may be used concentrate the beads in a smaller droplet at 1518M, while transporting away a substantially bead free droplet. For example, droplets 1526A and 1526B may be combined at electrode 1518M, followed by a splitting operation to yield a droplet 1522 at electrode 1528M including a more concentrated set of beads and a substantially bead-free droplet 1527. In alternative embodiments, droplets 1526A and 1526B may be combined on the electrode path or array prior to bringing the droplets onto electrode 1518M. The combined droplet may be transported to electrode 1518M, followed by a splitting operation to yield a droplet 1528 at electrode 1528M including a more concentrated set of beads and a substantially bead-free droplet 1527.

A process of pre-concentrating beads in a droplet illustrated in FIGS. 15-16 is exemplary only. Any number of droplets may be transported into the field of magnet 1530 to form a droplet of any desired concentration of beads.

Once a desired concentration of magnetically responsive beads is achieved, the bead-containing droplet may be transported elsewhere. Transport off of electrode 1528M may be effected by interfering with the magnetic field of magnet 1522, by removing magnet 1522, and/or by establishing an interfacial tension in droplet 1528 which is sufficient to overcome the force of the magnetic field of magnet 1522 on beads 1542. The beads of bead-containing droplet 1528 may be subjected to further analysis. Bead-free droplets 1527 may also be subjected to further analysis. In one embodiment, bead-free droplets 1527 are combined with one or more new bead-containing droplets having affinity for a different target substance. For example, a new bead-type may be present atop reservoir 1514. The overall process may be used to extract multiple target substances on multiple bead sets from a single starting liquid.

In one embodiment, beads are concentrated into a droplet which is less than about ½ the volume of the source liquid. In another embodiment, beads are concentrated into a droplet which is less than about ¼ the volume of the source liquid. In another embodiment, beads are concentrated into a droplet which is less than about ⅛ the volume of the source liquid. In another embodiment, beads are concentrated into a droplet which is less than about 1/10 the volume of the source liquid. In another embodiment, beads are concentrated into a droplet which is less than about 1/20 the volume of the source liquid. In another embodiment, beads are concentrated into a droplet which is less than about 1/50 the volume of the source liquid. In another embodiment, beads are concentrated into a droplet which is less than about 1/100 the volume of the source liquid.

In another embodiment, the volume of the source liquid ranges from about 10 nL to about 10 mL, and beads are concentrated into a droplet which is less than about ½ the volume of the source liquid. In another embodiment, the volume of the source liquid ranges from about 10 nL to about 10 mL, and beads are concentrated into a droplet which is less than about ¼ the volume of the source liquid. In another embodiment, the volume of the source liquid ranges from about 10 nL to about 10 mL, and beads are concentrated into a droplet which is less than about ⅛ the volume of the source liquid. In another embodiment, the volume of the source liquid ranges from about 10 nL to about 10 mL, and beads are concentrated into a droplet which is less than about 1/10 the volume of the source liquid. In another embodiment, the volume of the source liquid ranges from about 10 nL to about 10 mL, and beads are concentrated into a droplet which is less than about 1/20 the volume of the source liquid. In another embodiment, the volume of the source liquid ranges from about 10 nL to about 10 mL, and beads are concentrated into a droplet which is less than about 1/50 the volume of the source liquid. In another embodiment, the volume of the source liquid ranges from about 10 nL to about 10 mL, and beads are concentrated into a droplet which is less than about 1/100 the volume of the source liquid.

In another embodiment, the volume of the source liquid ranges from about 100 nL to about 1 mL, and beads are concentrated into a droplet which is less than about ½ the volume of the source liquid. In another embodiment, the volume of the source liquid ranges from about 100 nL to about 1 mL, and beads are concentrated into a droplet which is less than about ¼ the volume of the source liquid. In another embodiment, the volume of the source liquid ranges from about 100 nL to about 1 mL, and beads are concentrated into a droplet which is less than about ⅛ the volume of the source liquid. In another embodiment, the volume of the source liquid ranges from about 100 nL to about 1 mL, and beads are concentrated into a droplet which is less than about 1/10 the volume of the source liquid. In another embodiment, the volume of the source liquid ranges from about 100 nL to about 1 mL, and beads are concentrated into a droplet which is less than about 1/20 the volume of the source liquid. In another embodiment, the volume of the source liquid ranges from about 100 nL to about 1 mL, and beads are concentrated into a droplet which is less than about 1/50 the volume of the source liquid. In another embodiment, the volume of the source liquid ranges from about 100 nL to about 1 mL, and beads are concentrated into a droplet which is less than about 1/100 the volume of the source liquid.

In a related embodiment, electrode 1522 associated with magnet 1522 is smaller than one or more has a size which is smaller than one or more nearby electrodes. This embodiment provides greater concentration of beads 1512 relative to embodiments in which the electrodes have a common size. For example, three electrodes may include a first electrode 1522 having a first size, a second, intermediate electrode having a second larger size, and a third electrode having the second, larger size. The three electrodes may be activated in the presence of a source droplet including magnetically responsive beads to cause an elongated droplet to form atop the three electrodes. The second intermediate electrode may be deactivated to cause the formation of two sub-droplets: a smaller sub-droplet atop electrode 1522 including substantially all of the beads from the source droplet and a larger sub-droplet atop the third electrode substantially lacking in the beads. Three electrodes are used here as an example, but it will be appreciated that any number of electrodes, such as 3, 4, 5, 6, or more electrodes, may be used, so long as the electrodes providing the destination for the bead containing droplet have a smaller footprint than the electrodes providing the destination for the droplet which is substantially lacking in beads. The intermediate electrode or electrodes which are deactivated in order to form the daughter droplet may be smaller or larger than the electrode or electrodes providing the destination for the droplet which is substantially lacking in beads and/or smaller or larger than the electrode or electrodes providing the destination for the bead containing droplet. Moreover, all of the electrodes in the sequence may be approximately the same size and the difference in the size of the daughter droplets may be effected by differences in the number of activated electrodes providing the destination for the droplet which is substantially lacking in beads and/or the number of electrodes providing the destination for the bead-containing droplet.

Figure 17:
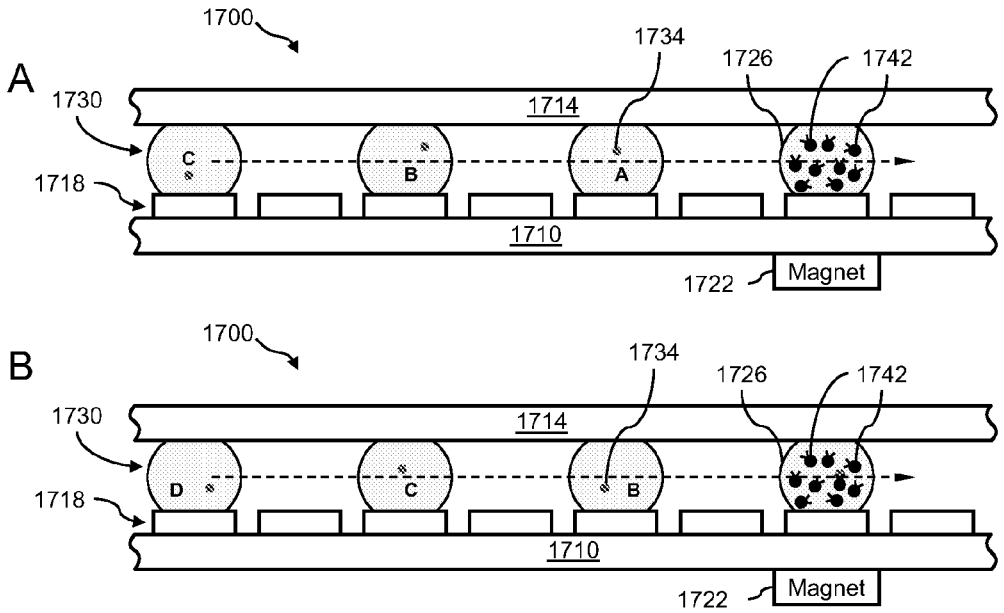
FIG. 17 illustrates a side view of a section of a droplet actuator and the use of a magnetic field in a process of concentrating a target substance on magnetically responsive beads.

FIG. 17 illustrates a side view of a section of a droplet actuator 500. A magnetic field is used in a process of concentrating a target substance on magnetically responsive beads. For example, the surface may be a surface of the droplet actuator or an object positioned in the droplet actuator gap. The method of the invention is useful for concentrating analytes for analysis in a droplet actuator. According to the method, an initial volume of source liquid, e.g., sample, may be dispensed into multiple small volume droplets. The multiple small volume samples may be sequentially contacted with one or more bead sets.

In one example, about a 1 μL source volume of liquid may be divided into ten droplets, each having a volume of about 100 nL. Each 100 nL droplets may be incubated with a single 100 nL bead-containing droplet. In this manner, the sample-to-bead ratio is reduced by about 10×. Consequently, the intensity of the signal of interest that may be detected may be increased by about 10×. In effect, this approach improves the limit of detection by about 10× (e.g., from about 1 pg/mL to about 1 ng/mL).

Referring again to FIG. 17, droplet actuator 1700 may include a bottom substrate 1710 that is separated from a top substrate 1714 by a gap 1716. A path or array of droplet operations electrodes 1718 (e.g., electrowetting and/or dielectrophoresis electrodes) may include electrodes that are associated with one or both substrates 1710 and 1714. Magnet 1722 is associated with droplet actuator 1700, and arranged in relation to droplet actuator 1700 such that a droplet operations electrode 1718 is within the magnetic field thereof. Magnet 1722 may, for example, be a permanent magnet or an electromagnet. Alternatively, magnet 1722 is associated with droplet actuator 1700, and arranged in relation to droplet actuator 1700 such that a hydrophilic spot on a surface of one or both substrates 1710 and 1714 is within the magnetic field thereof. Similarly, magnet 1722 may be associated with droplet actuator 1700, and arranged in relation to droplet actuator 1700 such that a droplet 1726 in gap 1716 is within the magnetic field thereof. Magnet 1722 may, for example, be a permanent magnet or an electromagnet. Magnet 1722 may have a magnetic field strength sufficient to aggregate beads 1742 in droplet 1726.

Bead-containing droplet 1726 may be provided at droplet operations electrode 1718A, such that bead-containing droplet 1726 is within the magnetic field magnet 1722. Bead-containing droplet 1726 may include a number of magnetically responsive beads 142 that have an affinity for a target substance, such as for a type of cell, protein, DNA, and/or antigen. The liquid in bead-containing droplet 1726 may, for example, be a buffer.

When a target substance 1734 comes into contact with magnetically responsive beads 1742 of bead-containing droplet 1726, target substance 1734 may bind to one or more magnetically responsive beads 1742. Magnetically responsive beads may be analyzed for target substance. For example, the analysis may make use of droplet-based analysis protocols conducted on droplet actuator 1700. Magnet 1722 may be used, for example, aggregate magnetically responsive beads 1742 during a merge-and-split droplet operations protocol.

FIGS. 17A-B illustrate a series of droplets 1730 that include a substance to be evaluated, such as target substance 1734. Droplets 1730 may be derived from dividing a large source liquid (not shown) into multiple smaller volume droplets, e.g., by dispensing droplets 1730 from the source liquid. For example, a source liquid having a volume of about 1 μL may be split or dispensed into multiple droplets 1730, such as about ten 100 nL droplets 1730. Bead-containing droplet 1726 may likewise be about a 100 nL droplet, which is about one tenth the volume of the original source liquid.

The following steps illustrate a process of concentrating a target substance on beads:

FIG. 17A shows a first step in which droplet operations are executed to queue up multiple droplets 1730 to be incubated with bead-containing droplet 1726 at droplet operations electrode 1718A. Of course, such queuing is not required; in an alternative embodiment, each dispensed droplet may be processed prior to dispensing the next droplet. Magnetically responsive beads 1742 of bead-containing droplet 1726 are substantially immobilized by the magnetic field of magnet 1722. In some embodiments, the magnetic field may be present during droplet splitting operations and absent during incubation to facilitate circulation of magnetically responsive beads 1742 within droplet 1726 and thereby enhance the kinetics of the incubation step. Similarly, droplet 1726 may in some embodiments be transported away from the magnetic field during incubation in order to facilitate circulation of magnetically responsive beads 1742 within droplet 1726. FIGS. 17A-B show successive droplets being combined with bead-containing droplet 1726 to permit concentration of the target substance 1734 by capture of same on beads 1742. Once a droplet 1730 has been incubated with bead-containing droplet 1726, a droplet splitting operation effected while the beads are magnetically aggregated in a specific region of the droplet. As illustrated, droplets 1730 are 1× droplets, and droplet 1726 is also a 1× droplet. It will be appreciated that either or both droplets 1730 and 1726 may be larger than 1×, for example, either or both may be 2×, 3×, 4×, 5× or larger. The splitting step yields a droplet substantially lacking in beads, which may be transported away.

In other embodiments, a physical barrier may be employed to retain beads during the splitting operation, e.g., as described in U.S. Patent Application No. 60/980,767, entitled "Bead Manipulations in a Droplet Actuator," filed on Oct. 17, 2007, the entire disclosure of which is incorporated herein by reference. Where a physical barrier is used to retain beads, the beads need not be magnetically responsive.

Substantially all of the target substance in a source liquid may be captured in a much smaller bead-containing droplet. This approach improves the limit of detection during analysis of the target substance. For example, when detecting the target substance using an assay which produces a fluorescent signal, the intensity of the fluorescent signal may be increased by a multiple of the number of droplets 1730, as compared with incubating the source liquid with a substantially equal volume of reagent solution.

In an alternative embodiment, the capture mechanism is not a magnetically responsive bead-containing droplet, but instead may be a surface for capturing analytes. In this embodiment, the multiple droplets may be sequentially transported using droplet operations into contact with the surface one or more times until the analytes of interest are suitably captured and evaluated.

In one embodiment, one or more target substances are concentrated into a droplet which is less than about ½ the volume of the source liquid. In another embodiment, one or more target substances are concentrated into a droplet which is less than about ¼ the volume of the source liquid. In another embodiment, one or more target substances are concentrated into a droplet which is less than about ⅛ the volume of the source liquid. In another embodiment, one or more target substances are concentrated into a droplet which is less than about 1/10 the volume of the source liquid. In another embodiment, one or more target substances are concentrated into a droplet which is less than about 1/20 the volume of the source liquid. In another embodiment, one or more target substances are concentrated into a droplet which is less than about 1/50 the volume of the source liquid. In another embodiment, one or more target substances are concentrated into a droplet which is less than about 1/100 the volume of the source liquid.

In another embodiment, the volume of the source liquid ranges from about 10 nL to about 10 mL, and one or more target substances are concentrated into a droplet which is less than about ½ the volume of the source liquid. In another embodiment, the volume of the source liquid ranges from about 10 nL to about 10 mL, and one or more target substances are concentrated into a droplet which is less than about ¼ the volume of the source liquid. In another embodiment, the volume of the source liquid ranges from about 10 nL to about 10 mL, and one or more target substances are concentrated into a droplet which is less than about ⅛ the volume of the source liquid. In another embodiment, the volume of the source liquid ranges from about 10 nL to about 10 mL, and one or more target substances are concentrated into a droplet which is less than about 1/10 the volume of the source liquid. In another embodiment, the volume of the source liquid ranges from about 10 nL to about 10 mL, and one or more target substances are concentrated into a droplet which is less than about 1/20 the volume of the source liquid. In another embodiment, the volume of the source liquid ranges from about 10 nL to about 10 mL, and one or more target substances are concentrated into a droplet which is less than about 1/50 the volume of the source liquid. In another embodiment, the volume of the source liquid ranges from about 10 nL to about 10 mL, and one or more target substances are concentrated into a droplet which is less than about 1/100 the volume of the source liquid.

In another embodiment, the volume of the source liquid ranges from about 100 nL to about 1 mL, and one or more target substances are concentrated into a droplet which is less than about ½ the volume of the source liquid. In another embodiment, the volume of the source liquid ranges from about 100 nL to about 1 mL, and one or more target substances are concentrated into a droplet which is less than about ¼ the volume of the source liquid. In another embodiment, the volume of the source liquid ranges from about 100 nL to about 1 mL, and one or more target substances are concentrated into a droplet which is less than about ⅛ the volume of the source liquid. In another embodiment, the volume of the source liquid ranges from about 100 nL to about 1 mL, and one or more target substances are concentrated into a droplet which is less than about 1/10 the volume of the source liquid. In another embodiment, the volume of the source liquid ranges from about 100 nL to about 1 mL, and one or more target substances are concentrated into a droplet which is less than about 1/20 the volume of the source liquid. In another embodiment, the volume of the source liquid ranges from about 100 nL to about 1 mL, and one or more target substances are concentrated into a droplet which is less than about 1/50 the volume of the source liquid. In another embodiment, the volume of the source liquid ranges from about 100 nL to about 1 mL, and one or more target substances are concentrated into a droplet which is less than about 1/100 the volume of the source liquid.

Figure 18:
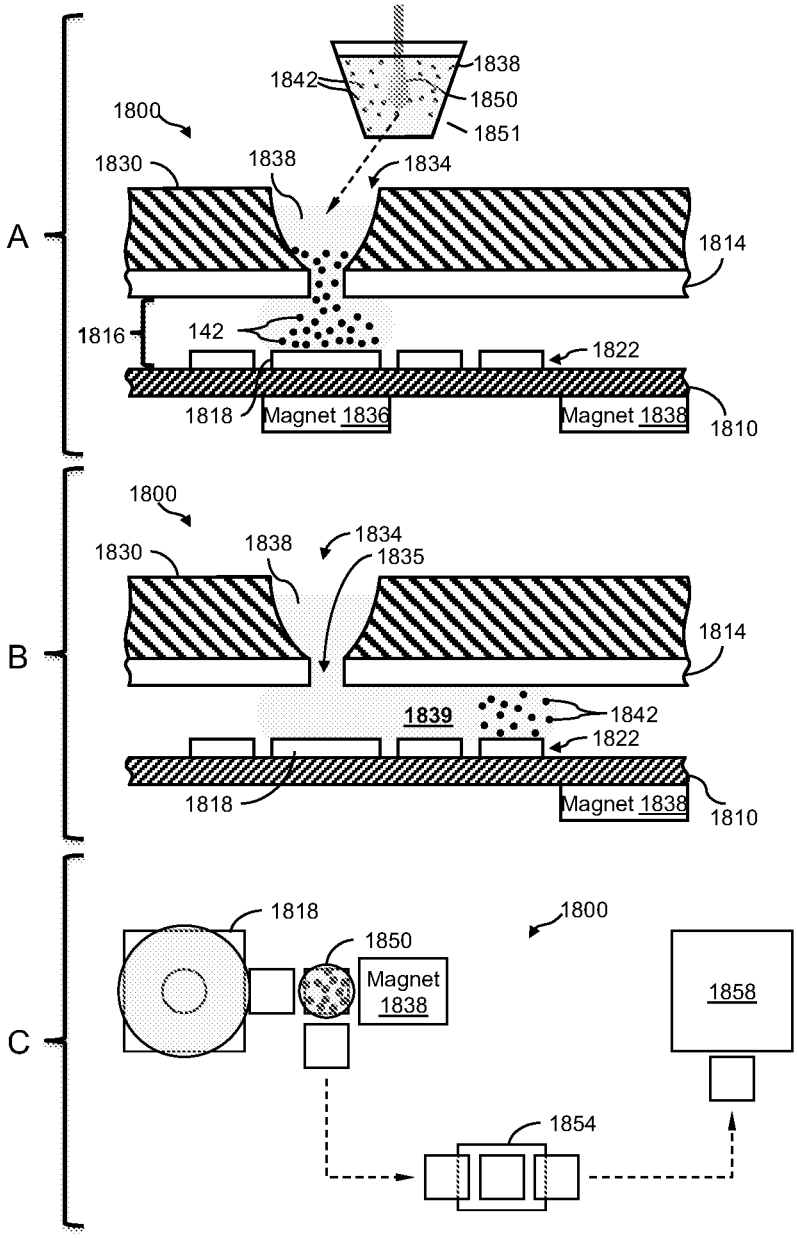
FIG. 18 illustrates various views of a portion of a droplet actuator and illustrates the use of a magnetic field in a process of preparing a sample for performing diagnostic polymerase chain reaction (PCR) from a nasal or throat swab.

FIGS. 18A-C illustrate various views of a portion of a droplet actuator 1800 and illustrate the use of a magnetic field in a process of preparing a sample for performing diagnostic polymerase chain reaction (PCR) from a swab, such as a nasal or throat swab. Droplet actuator 1800 may include a bottom substrate 1810 that is separated from a top substrate 1814 by a gap 1816. Gap 1816 establishes an interior volume for performing droplet operations. A reservoir electrode 1818 is associated with bottom substrate 1810. Reservoir electrode 1818 may be arranged in relationship to a path or array of droplet operations electrodes 1822 (e.g., electrowetting and/or dielectrophoresis electrodes). The path or array of droplet operations electrodes 1822 may include a set of electrodes that is associated with one or both substrates 1810 and 1814. Reservoir electrode 1818 is illustrated as being larger than droplet operations electrodes 1822, but it may be the same size or smaller or may simply be replaced with another droplet operations electrode. An opening 1835 is provided top substrate 1814, providing a liquid path from reservoir 1834 into gap 1816. Opening 1835 is substantially aligned with reservoir electrode 1818. A substrate 1830 that is atop top substrate 1814 or a part of top substrate 1814 includes a reservoir 1834, which is illustrated here as relatively conical in shape, but which may be any shape which is suitable for delivering liquid through opening 1835 and into gap 1814. Reservoir 1834 includes a quantity of liquid 1838. Substrate 1830 may be formed of, for example, glass, PCB, silicon, or plastic. Substrate 1830 may, in some embodiments, be formed as an integral part of top substrate 1814. Additionally, liquid 1838 may include a quantity of beads 1842, which may be magnetically responsive beads.

FIGS. 18A-B also show a magnet 1836 that is associated with droplet actuator 1800 such that reservoir electrode 1818 is within the magnetic field thereof. Similarly, magnet 1836 may be selected and positioned to attract magnetically responsive beads 1842 from within reservoir 1834 to an edge of liquid 1838 within gap 1816. Additionally, a magnet 1838 is associated with droplet actuator 1800 such that droplet operations electrodes 1822, such as droplet operations electrodes 1822A and 1822B, are within the magnetic field thereof. Magnet 1836 and magnet 1838 may, for example, be permanent magnets or electromagnets. Additionally, the position of magnet 1836 and/or magnet 1838 may be adjustable. Magnets 1836 and 1838 may be used, for example, to aggregate the magnetically responsive beads 1842.

The following steps illustrate a process of preparing sample for performing diagnostic PCR from a swab sample:

FIG. 18A shows a first step in a process of preparing sample for performing diagnostic PCR from a swab sample. In this step, a swab 1850 is used to collect a sample, such as a nasal swab or a throat swab. The sample may include a nucleic acid-containing substance of interest, such as a parasite, bacteria, virus, or abnormal host cell. Swab 1850 is then placed into vessel 1851. Vessel 1851 includes liquid 138, which may, for example, be lysis buffer. Liquid 138 including the sample and beads 1842 may be loaded into conical-shaped reservoir 1834 of substrate 1830. In an alternative embodiment, the swab and beads are placed directly into a buffer in reservoir 1834. The funnel shape of conical-shaped reservoir 1834 facilitates flow of beads through the liquid 1838 in response to the magnetic field of magnet 1836, such that substantially all of the beads enter the gap. Magnetically responsive beads 1842 may thus enter droplet actuator 1800 and settle at reservoir electrode 1818. Reservoir electrode 1818 may be activated to facilitate flow of liquid 1838 into gap 1816.

FIG. 18B shows another step in a process of preparing sample for performing diagnostic PCR from a swab sample. Magnet 1836 may be physically moved away from droplet actuator 1800 or in the case of an electromagnet, may be switched off. As a result of the removal of the magnetic field, magnetically responsive beads 142 are no longer aggregated at reservoir electrode 1818. Droplet operations electrodes 1822A and 1822B may be activated to form a droplet slug or droplet finger 1839 of liquid 138 that extends in the direction of magnet 1838. The magnetic field of magnet 1838 aggregates magnetically responsive beads 1842 in a terminus of the droplet slug or droplet finger 1839 of liquid 138.

FIG. 18C shows further steps in a process of preparing sample for performing diagnostic PCR from a swab sample. Using droplet operations, one or more bead-containing droplets 1850 may be dispensed at droplet operations electrode 1822B and then transported into other portions of droplet actuator 1800 for further processing, such as for DNA/RNA purification. For example, FIG. 18C shows that one or more bead-containing droplets 1850 may be transported to yet another magnet 1854 for further concentration and/or bead washing operations. In another example, droplets of purified DNA/RNA may be transported to an empty reservoir 1858 to be used, for example, as DNA stock solution for subsequent PCR reactions.

Figure 19:
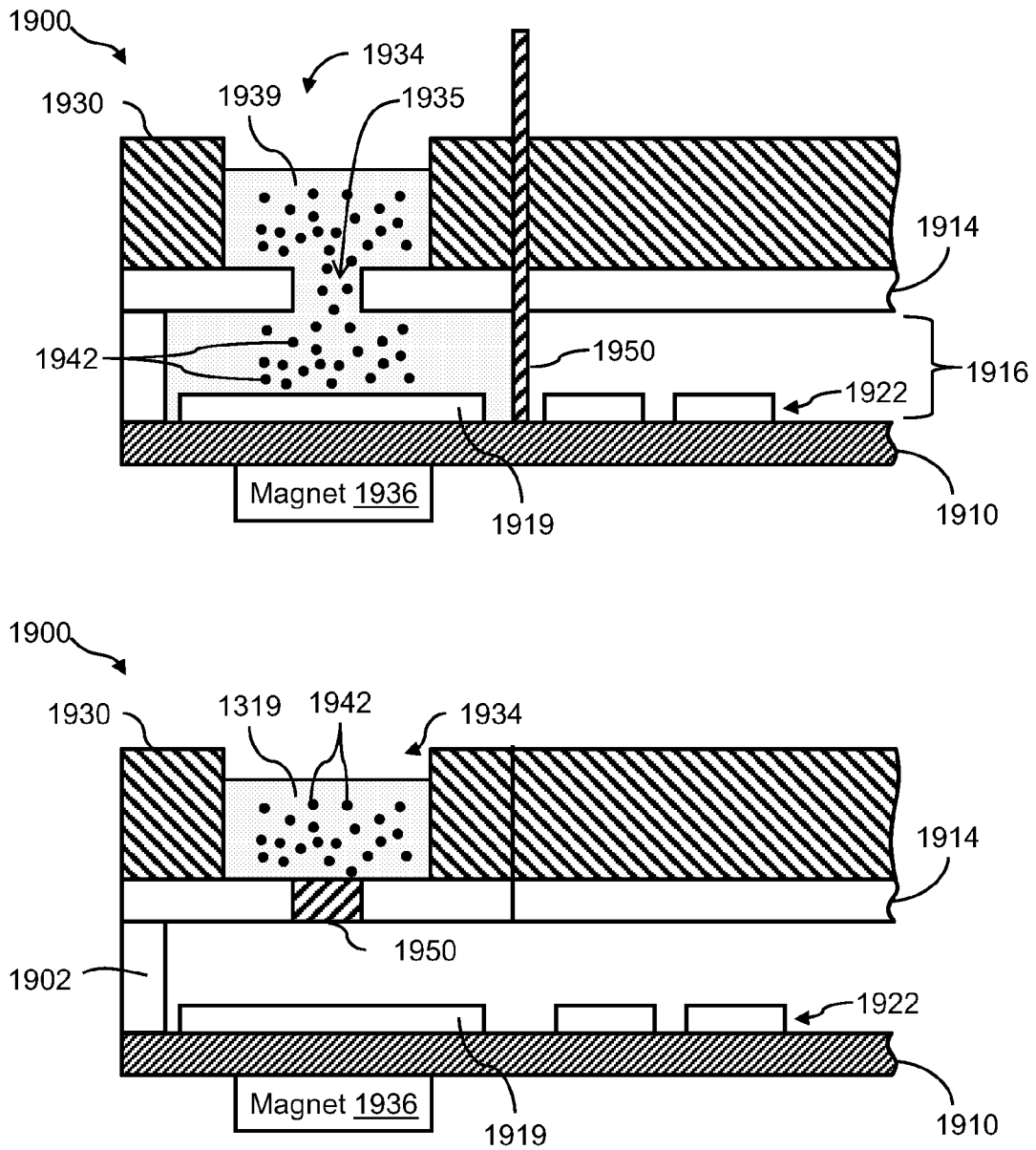
FIG. 19 illustrates a side view of a portion of a droplet actuator that includes a removable barrier for controlling the dispensing of a volume of liquid.

FIGS. 19A and 19B illustrate a side view of a portion of a droplet actuator 1900 that includes a removable barrier for controlling the dispensing of a volume of liquid. Droplet actuator 1900 may include bottom substrate 1910 that is separated from top substrate 1914 by droplet operations gap 1916. Gap 1916 may have a height that is established by gasket or spacer 1902. Reservoir electrode 1918 is disposed on bottom substrate 1910. Reservoir electrode 1918 may be arranged within a path or array of droplet operations electrodes 1922 (e.g., electrowetting and/or dielectrophoresis electrodes). The path or array of droplet operations electrodes 1922 may include electrodes that are associated with one or both substrates 1910 and 1914. Reservoir electrode 1918 is illustrated as being larger than droplet operations electrodes 1922, but it may be the same size or smaller. In some cases, reservoir electrode 1918 is simply replaced with another droplet operations electrode 1922.

Opening 1935 is provided within top substrate 1914. Opening 1935 is one means of establishing a liquid path from an external liquid reservoir into gap 1916. In the illustrated embodiment, opening 1935 is establishes a liquid path from reservoir 1934 into gap 1916. Opening 1935 may, in some cases, be configured such that liquid 1939 flowing through the opening will come into sufficient proximity with reservoir electrode 1918 to permit one or more droplet operations to be conducted using liquid 1939, where the droplet operation-mediated at least in part by reservoir electrode 1918.

Substrate 1930 atop top substrate 1914 includes reservoir 1934 for holding a quantity of liquid 1939. Substrate 1930 may and reservoir 1934, in some embodiments, be formed as an integral part of top substrate 1914. Liquid 1938 may include a quantity of magnetically responsive beads 1942.

Magnet 1936 may be configured relative to droplet actuator 1900 such that reservoir electrode 1918 is within the magnetic of magnet 1936. Similarly, magnet 1936 may be selected and positioned to attract magnetically responsive beads 1842 from within reservoir 1834 to an edge of liquid 1838 within gap 1816. For example, magnet 1936 may be selected and positioned to attract magnetically responsive beads 1942 from within reservoir 1934 to an edge of liquid 19142 within gap 1916 and atop electrode 1919. As with any of the reservoirs described in this specification, reservoir 1934 may, in some embodiments, have a funnel shape. The funnel shape may taper towards opening 1935. Such a configuration facilitates migration of beads from within reservoir 1934 into gap 1916. Where a magnet is used, a funnel shaped configuration may be used to facilitate attraction of magnetically responsive beads 1942 from within reservoir 1934 into gap 1916. Ideally, substantially all beads in reservoir 1934 enter gap 1916. Magnetically responsive beads 1842 may thus enter droplet actuator 1900 and be aggregate or substantially immobilized within liquid 1939 at reservoir electrode 1818. Reservoir electrode 1818 may be activated to facilitate flow of liquid 1838 into gap 1816. Droplet operations may be used to transport droplets containing the beads or droplets lacking the beads to other locations within the droplet actuator, and may also be used to transport one or more droplets out of the droplet actuator, e.g., into a waste reservoir or into a holding reservoir where such droplets will be available for further processing.

Droplet actuator 1900 includes a removable barrier 1950. When the volume of liquid being loaded into the droplet actuator exceeds the capacity of the droplet actuator dispensing region, such a barrier may serve as a flow control mechanism. The barrier may prevent the large volume of liquid from flooding the droplet actuator. Any type of removable physical barrier may be used. Preferred barriers are chemically compatible with the samples and reagents with which they are intended to be used. Removable barrier 1950 may, for example, be a polymer-based pull out strip or a wax barrier that may be melted and blended with the filler fluid. A wax plug may be melted using an internal or external heating element.

FIG. 19A shows a removable barrier 1950 installed in gap 1916 of droplet actuator 1900 and near reservoir electrode 1918. Barrier 1950 prevents liquid 1938 from completely overflowing the on-droplet actuator reservoir region into other regions of gap 1916. Barrier 1950 may be supplemented with on-droplet actuator non-removable barriers. For example, a gasket may surround reservoir electrode 1919 to provide an on-actuator reservoir. The gasket may include a gap for dispensing liquid from the reservoir electrode onto electrodes 1922. Removable barrier 1950 may be installed in the opening to prevent flow of liquid from the on-actuator reservoir. Removable barrier 1950 may, for example, remain in place during transport of the droplet actuator, in order to maintain reagents in on-actuator reservoirs. During operation, removable barrier 1950 may be removed in order to permit droplets to be dispensed from the reservoirs.

For example, with barrier 1950 installed, liquid 1938 with magnetically responsive beads 1942 may be loaded into reservoir electrode 1918. Magnet 1936 may attract magnetically responsive beads 1942 that are within liquid 1938 toward reservoir electrode 1918, concentrating magnetically responsive beads 1942 at reservoir electrode 1918. Removable barrier 1950 allows magnetically responsive beads 1942 to be concentrated and aggregated at reservoir electrode 1918 prior to flooding gap 1916 of droplet actuator 1900 with liquid 1938. Upon removal of barrier 1950, liquid 1938 at least partially flows into gap 1916. Droplet operations may be performed, such as further concentrating and/or processing magnetically responsive beads 1942 and/or removing and/or further processing the supernatant.

FIG. 19B shows another example of a removable barrier 1950. In this example, removable barrier 1950 is installed in the bottom of reservoir 1934 and/or in gap 1935. Removable barrier 1950 thus prevents liquid 1939 in reservoir 1934 from flowing through opening 1935 into gap 1916. Where liquid 1938 includes magnetically responsive beads 1942, magnet 1936 and/or gravity may attract magnetically responsive beads 1942 to the bottom of reservoir 1934. Magnetically responsive beads 1942 may thus be concentrated and aggregated at the bottom of reservoir 1934. Upon removal of removable barrier 1950, liquid 1938 with beads 1942 may flow into gap 1916. The flow may be facilitated by activating electrode 1919 and/or other electrodes 1922. Droplet operations may be performed, such as further concentrating and/or processing magnetically responsive beads 1942 and/or removing and/or further processing the supernatant.

Figure 20:
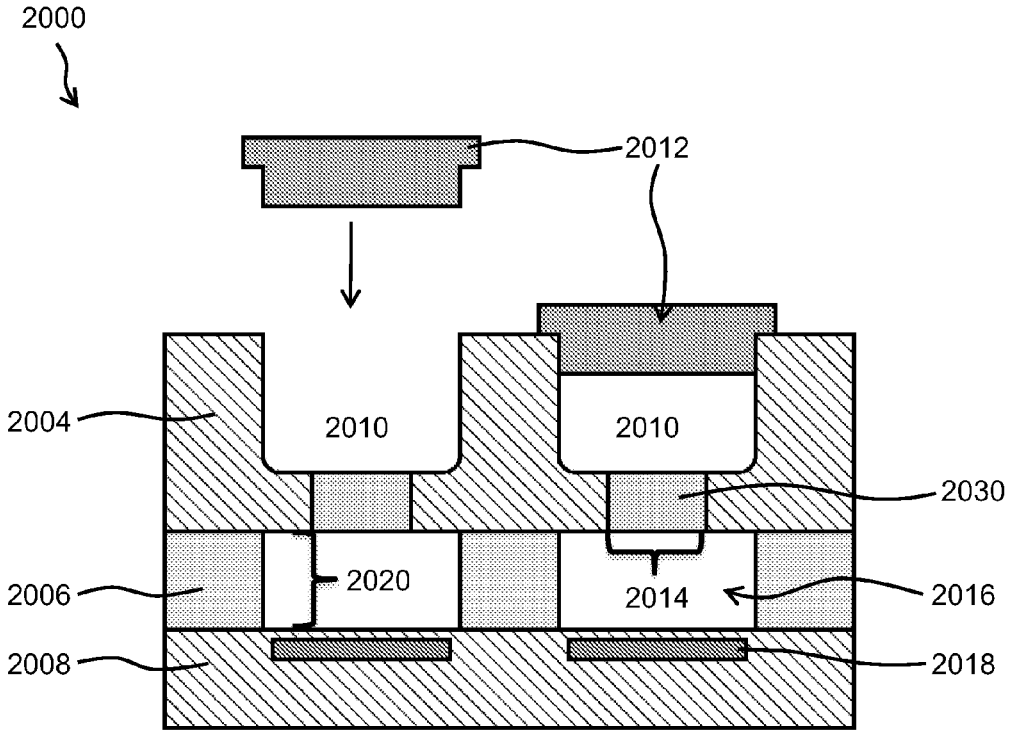
FIG. 20 illustrates a cross-section of a droplet actuator that includes caps and plugs in off-actuator reservoirs.

FIG. 20 illustrates a cross-section of a droplet actuator 2000 that includes caps and plugs in off-actuator reservoirs. Droplet actuator 2000 includes top substrate 2004 and bottom substrate 2008, separated by gaskets or spacers 2006 to form droplet operations gap 2020. Gaskets or spacers 2006 may be configured to establish on-actuator reservoirs 2016. Each on-actuator reservoir 2016 may be associated with one or more reservoir electrodes 2018. Top substrate 2004 includes reservoirs 2010 formed therein. Caps 2012 may be provided for sealing reservoirs 2010. Opening 2014 in top substrate 2004 may provide a liquid flow path for flowing liquid from reservoir 2010 into gap 2020. Opening 2014 in top substrate 2004 may be configured for flowing liquid from reservoir 2010 into a corresponding on-actuator reservoir 2016. Opening 2014 in top substrate 2004 may be configured for flowing liquid from reservoir 2010 into proximity with an electrode on top substrate 2004 and/or bottom substrate 2008, such as a reservoir electrode 2018. Plug 2030 may be provided in opening 2014 to block exit of liquid from reservoir 2010 into gap 2020 and/or entrance of liquid into reservoir 2010 from 2020. Plug 2030, like other removable barriers of the invention, may be made from any suitable substance, and may be punctured, removed and/or dissolved in order to permit liquid transport between reservoir 2010 and gap 2020.

Droplet actuator 2000 may be provided in a sealed package with one or more reagents loaded in reservoirs 2010 and with caps 2012 in place to prevent loss of reagent during storage and/or transport. In operation, a user may:

- remove droplet actuator 2000 from the sealed package;
- load a sample into a sample reservoir, which may for example be configured in a manner similar to reservoirs 2010;
- puncture, remove, dissolve or otherwise breach plugs 2030; and
- execute a droplet operations protocol for processing and/or analysis of the sample or a sub-component of the sample.

Figure 21:
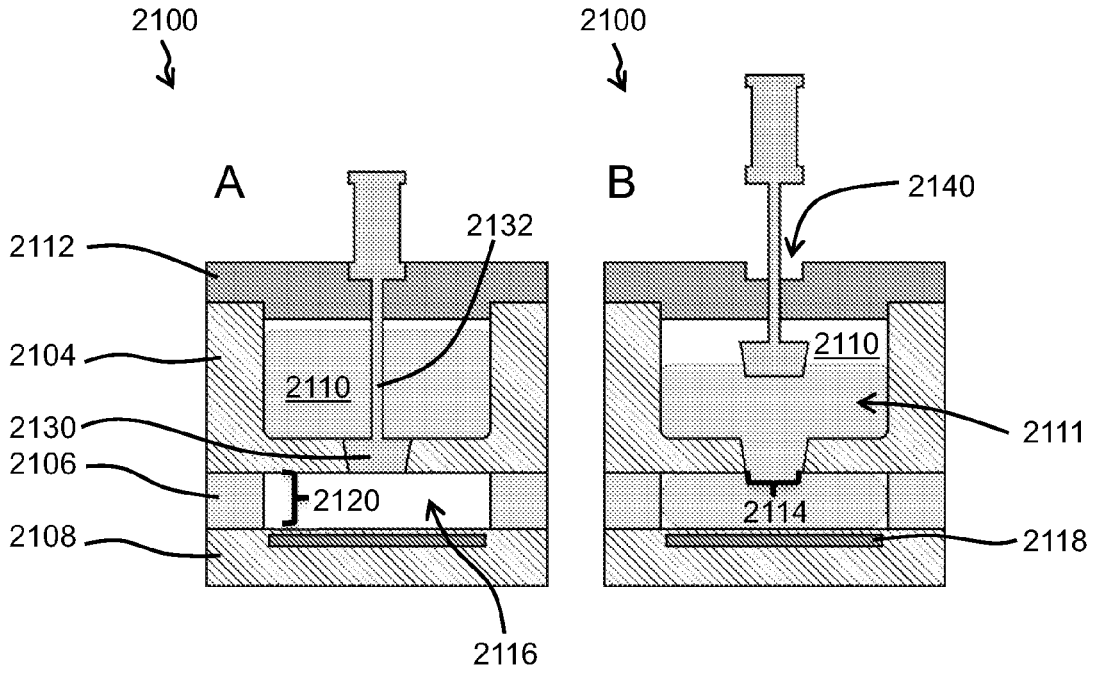
FIG. 21 illustrates a cross-section of a droplet actuator that includes caps and plugs in off-actuator reservoirs and shows plugs that are removable without removing the caps.

FIG. 21 illustrates a cross-section of a droplet actuator 2100 that includes caps and plugs in off-actuator reservoirs and shows plugs that are removable without removing the caps. Droplet actuator 2100 includes a top substrate 2104 and a bottom substrate 2108, separated by gaskets or spacers 2106 to form a gap 2120. Gaskets or spacers 2106 may be configured to establish on-actuator reservoirs 2116. Each on-actuator reservoir 2116 may be associated with one or more reservoir electrodes 2118. Top substrate 2104 includes reservoirs 2110 formed therein. Caps 2112 may be provided for sealing reservoirs 2110. Opening 2114 in top substrate 2104 may provide a liquid flow path for flowing liquid 2111 from reservoir 2110 into gap 2120. Opening 2114 in top substrate 2104 may be configured for flowing liquid 2111 from reservoir 2110 into a corresponding on-actuator reservoir 2116. Opening 2114 in top substrate 2104 may be configured for flowing liquid 2111 from reservoir 2110 into proximity with an electrode on top substrate 2104 and/or bottom substrate 2108, such as reservoir electrode 2118. Plug 2130 may be provided in opening 2114 to block exit of liquid 2111 from reservoir 2110 into gap 2120 and/or entrance of liquid into reservoir 2110 from 2120. Plug 2130 may be provided with shaft 2132 and handle 2134 for permitting a user to remove plug 2130 from opening 2114 without removing cap 2112. Shaft 2132 may extend through an opening 2140 provided in cap 2112. FIG. 21A shows plug 2130 inserted in and sealing opening 2114 so the liquid flow between reservoir 2110 and gap 2120 is prevented. FIG. 21B shows plug 2130 removed from opening 2114 so the liquid flow between reservoir 2110 and gap 2120 is established, in the case illustrated, permitting liquid 2111 to flow from reservoir 2010 through opening 2114 and into on-actuator reservoir 2116.

Figure 22:
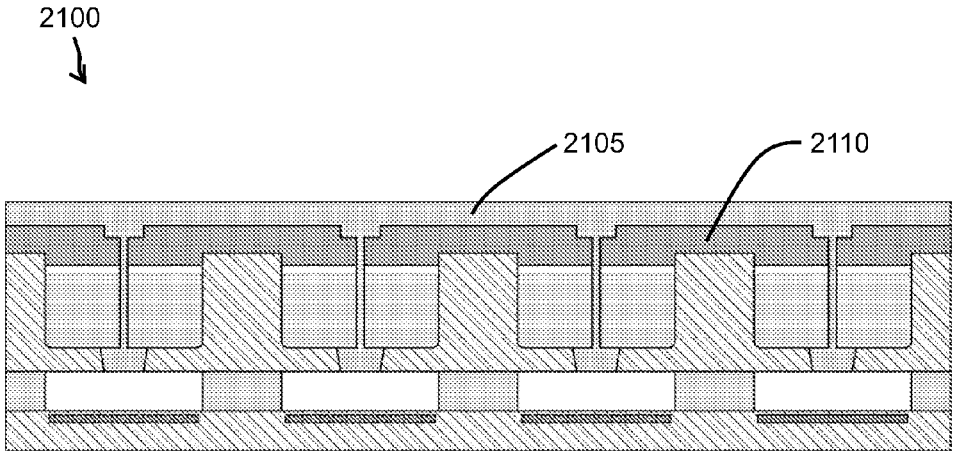
FIG. 22 illustrates a droplet actuator that includes a series of plugs that are attached to a common substrate such that the plugs may be removed together.

FIG. 22 illustrates a droplet actuator 2200 which is like droplet actuator 2100 of FIG. 21, except that a series of plugs are attached to a common substrate 2205, and the reservoirs are plugged with a common cap 2210. All of the plugs may be removed substantially together, e.g., by pulling substrate 2205 away from cap 2210. In various alternative embodiments, shaft 2132 may be configured such that as it is pulled up, it catches on cap 2210, so that it does not return to a closed position. For example, shaft 2132 may include a bulbous region that catches in opening 2140 so that opening 2114 is not readily closed. In another alternative embodiment, opening 2114 may be reclosed during operation by refitting plug 2130 into a sealing position. In still another embodiment, shafts may be designed to break off as substrate 2205 is pulled away from the droplet actuator, thereby providing confirmation for a user that plugs 2130 have been successfully removed.

For applications, such as PCR, it is often desirable to first concentrate the target material from a larger sample using magnetically responsive beads. The larger sample may, for example, be 100 μL or larger. One or more external reservoirs may be provided for depositing such samples. For example, one or more reservoirs may be formed in the top substrate or may be provided separately from the droplet actuator. In some cases, some sample processing may occur in the external reservoir(s), such as agitation of beads within the sample liquid and/or addition of one or more reagents to the sample liquid. The sample may be transported through a liquid path from the external reservoir into the droplet operations region of the droplet actuator for further processing and/or analysis. Most typically, the magnetically responsive beads dispersed throughout the sample would be collected at the bottom of the external reservoir where they can concentrated into a single droplet for analysis.

In some embodiments, a fixed reservoir may be replaced with an opening or fitting designed to fluidly interact with a removable reservoir. The external reservoir may, for example, be a microcentrifuge tube or pipette tip. The reservoir may include an opening in the bottom to allow communication between the external reservoir and the droplet actuator.

The invention may also provide a kit with one or more of the removable reservoirs and one or more droplet actuator cartridges configured for use with the removable reservoirs. One or more of the removable reservoirs may be pre-loaded with a reagent selected for conducting an assay on the droplet actuator. The kit may in some cases provide reservoirs including a complete set of reagents for conducting one or more assays. The kit may also provide one or more reservoirs for loading sample. In one embodiment, a reservoir for loading a sample may be sealed and may include beads having an affinity for one or more target substances in the sample. In a related embodiment, a reservoir for loading a sample may include a cover or region that is puncturable by a sharp object, such as a needle, for loading sample and/or reagent into the reservoir. In another related embodiment, a reservoir for loading a sample may be provided as a vacuum tube with a hollow needle or other opening for flowing a sample into the vacuum tube.

In operation, the reservoirs, including a reservoir with a sample, may be mounted on the droplet actuator cartridge, and a droplet-based assay may be executed to analyze one or more components of the sample. In an alternative embodiment, one or more reservoirs integral with the droplet actuator cartridge may be used along with one or more removable reservoirs to deliver some or all reagents and sample required for executing a droplet-based assay on the droplet actuator cartridge analyzing one or more components of the sample.

In various embodiments, a user may be provided with a external reservoir that is initially closed but can be opened on the bottom. For example the external reservoir may include an opening which is plugged with a wax that is soluble in oil or which may be melted by application of heat. The user may collect the sample in the tube, execute process steps, such as addition of reagents, vortexing, agitating, etc. The tube may then be mounted on the droplet actuator in a manner which exposes the plug to an interior droplet operations gap of the droplet actuator. The plug may be dissolved by the oil which is present in the droplet actuator and/or melted by application of an elevated temperature sufficient to melt the plug. The contents of the external reservoir may the flow into the droplet operations gap of the droplet actuator. For example, they may flow into an on-actuator reservoir from which they may be dispensed. Alternatively, they may flow into off-actuator reservoir, such as reservoir 934 of FIGS. 9-10, reservoir 1134 of FIG. 11, reservoir 1334 of FIG. 13 and other reservoirs described herein or known in the art. The sample may be further processed in the off-actuator reservoir, e.g., by mixing the sample with additional reagents and/or beads. In this and other examples presented herein, an agitator, such as a piezoelectric agitator may mix sample with reagents in the off-actuator reservoir. From the off-actuator reservoir, the sample may flow into an on-actuator reservoir or otherwise flow into a droplet operations gap of the droplet actuator. Where the sample flows into an on-actuator reservoir, sample subdroplets may dispensed from the on-actuator reservoir for conducting one or more droplet-based protocols further processing and/or analyzing the sample.

Where a wax plug is used, the wax can be selected to dissolve at a predetermined rate in order to control the timing of liquid exiting the removable reservoir. Various waxes having a wide range of melting temperatures are widely available from a variety of sources. Examples include the paraffin waxes, available from Sigma Aldrich Co. (St. Louis, Mo.) and those available from Fushun International Economic Trade Co., Ltd. (Fuhsun City, China). When magnetically responsive beads are used, the force of the beads' attraction to the magnet may be used to facilitate removal of the plug as it dissolves. Other means may be used to remove the plug. For example, the plug may be chemically dissolved and/or heated. In another embodiment, the droplet actuator may include a structure which pierces the tube or a film covering the tube as it is mounted on the droplet actuator. In yet another embodiment, the tube may ordinarily open or made open by removal of a protective film where capillary forces are sufficient to retain the liquid in the tube. A droplet of liquid on in the tube may be merged with a liquid in an off-actuator or on-actuator reservoir in order to form a liquid connection that promotes flow through the restrictive opening. Similarly, liquid exiting from the external reservoir may in some case be controlled by opening and/or closing an opening in the tube or a cap on the tube which serves as a vent to control the head pressure of liquid in the tube. In some cases, beads may be pulled through the oil and into a suspension buffer.

Figure 23:
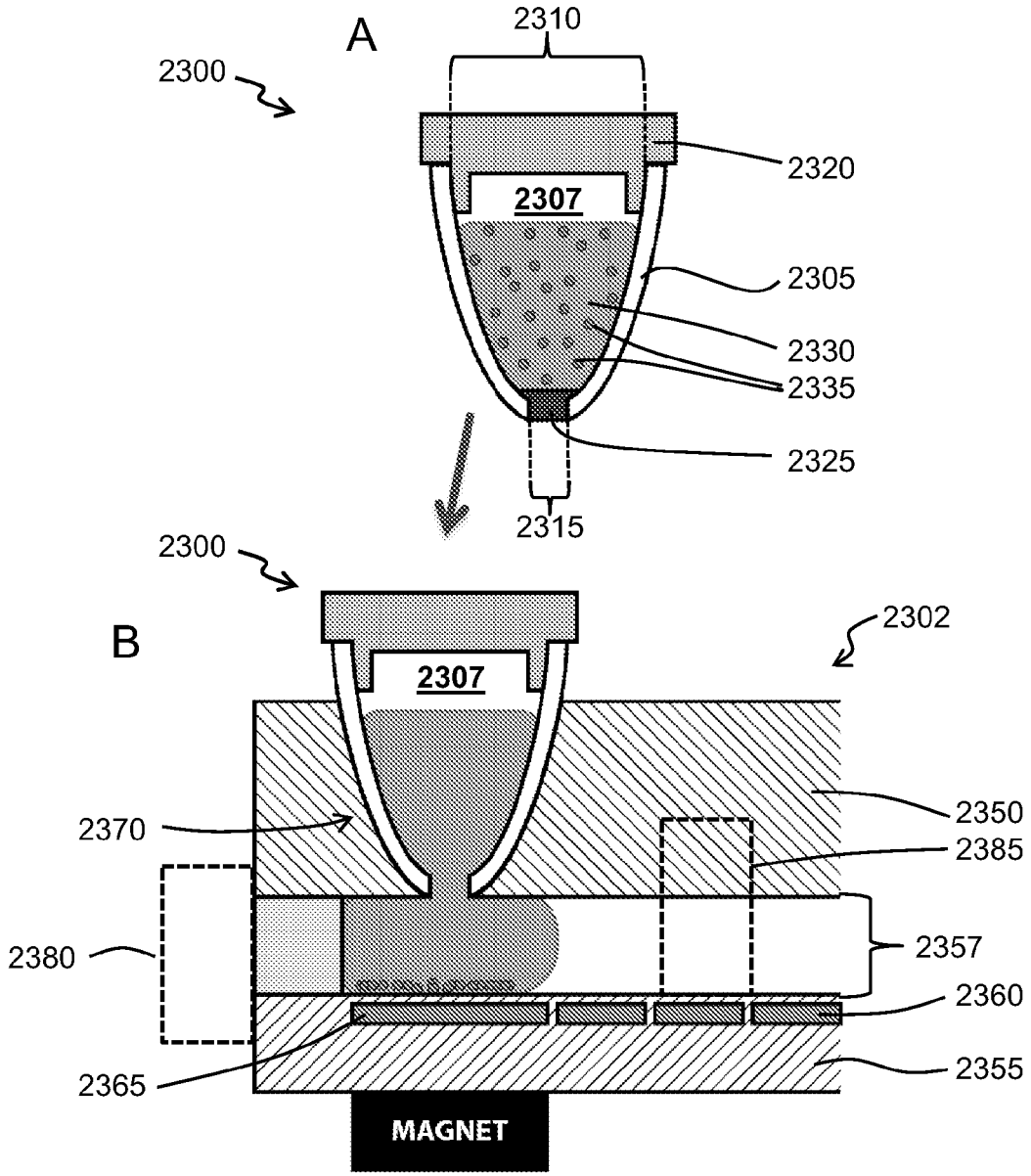
FIG. 23 shows an illustrative embodiment of a droplet actuator with a removable reservoir.

FIGS. 23A-B show an illustrative embodiment of a external reservoir 2300. External reservoir 2300 may be coupled to a droplet actuator and in some cases may also be removable or detachable from a droplet actuator. External reservoir 2300 includes reservoir body 2305 forming an interior volume 2307, first opening 2310 and second opening 2315. As illustrated in FIG. 23A, first opening 2310 is sealed with cap 2320. Second opening 2315 is sealed with plug 2325. Liquid 2330 including magnetically responsive beads 2335 is disposed in the interior volume. FIG. 23B shows external reservoir 2300 mounted on droplet actuator 2302, a cross-sectional segment of which is illustrated. Droplet actuator 2302 includes top substrate 2350 and bottom substrate 2355 separated to form droplet operations gap 2357. Bottom substrate 2355 includes droplet operations electrodes 2360 and reservoir electrode 2365. Top substrate includes fitting 2370 for coupling external reservoir 2300 to droplet actuator 2302. As illustrated, external reservoir 2300 is coupled to droplet actuator 2302. Plug 2325 is dissolved or otherwise removed, permitting liquid 2330 and beads 2335 to flow into droplet operations gap 2357. Droplet actuator 2302 is also illustrated with a magnet configured in relation to reservoir electrode 2365 to attract beads 2335 from within reservoir 2300 into droplet operations gap 2357. In the arrangement shown, beads 2335 are attracted to an edge of liquid 2330 that is atop reservoir electrode 2365; however, it will be apparent that a variety of other arrangements is possible. One such alternative arrangement is illustrated by box 2380, which shows a position for the magnet at a position which is lateral to gap 2357. Box 2385 illustrates another magnet position which is partially within gap 2357. In another embodiment, a magnet may be completely within gap 2357. In still another embodiment, a magnet may be completely within top substrate 2350 or completely within bottom substrate 2355, partially within top substrate 2350 or partially within bottom substrate 2355, or adjacent to top substrate 2350 or adjacent to bottom substrate 2355, or any combination of the foregoing.

As will be appreciated by one of skill in the art, the invention may be embodied as a method, system, or computer program product. Accordingly, various aspects of the invention may take the form of hardware embodiments, software embodiments (including firmware, resident software, micro-code, etc.), or embodiments combining software and hardware aspects that may all generally be referred to herein as a "circuit," "module" or "system." Furthermore, the methods of the invention may take the form of a computer program product on a computer-usable storage medium having computer-usable program code embodied in the medium.

Any suitable computer useable medium may be utilized for software aspects of the invention. The computer-usable or computer-readable medium may be, for example but not limited to, an electronic, magnetic, optical, electromagnetic, infrared, or semiconductor system, apparatus, device, or propagation medium. More specific examples (a non-exhaustive list) of the computer-readable medium would include some or all of the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission medium such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, propagate, or transport the program for use by or in connection with the instruction execution system, apparatus, or device.

Computer program code for carrying out operations of the invention may be written in an object oriented programming language such as Java, Smalltalk, C++ or the like. However, the computer program code for carrying out operations of the invention may also be written in conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through a local area network (LAN) or a wide area network (WAN), or the connection may be made to an external computer (for example, through the Internet using an Internet Service Provider).

aspects of invention are described with reference to various methods and method steps. It will be understood that each method step can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the methods.

The computer program instructions may also be stored in a computer-readable memory that can direct a computer or other programmable data processing apparatus to function in a particular manner, such that the instructions stored in the computer-readable memory produce an article of manufacture including instruction means which implement various aspects of the method steps.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing various functions/acts specified in the methods of the invention.

8 CONCLUDING REMARKS

The foregoing detailed description of embodiments refers to the accompanying drawings, which illustrate specific embodiments of the invention. Other embodiments having different structures and operations do not depart from the scope of the invention. The term "the invention" is used with reference to specific examples of the many alternative aspects or embodiments of the applicants' invention set forth in this specification, and neither its use nor its absence is intended to limit the scope of the applicants' invention or the scope of the claims. This specification is divided into sections for the convenience of the reader only. Headings should not be construed as limiting of the scope of the invention. The definitions are intended as a part of the description of the invention. It will be understood that various details of the invention may be changed without departing from the scope of the invention. Furthermore, the foregoing description is for the purpose of illustration only, and not for the purpose of limitation, as the invention is defined by the claims as set forth hereinafter. Where a process of the invention is described using multiple steps, each individual step of the process may be considered an independent aspect of the invention; combinations of such steps are also independent aspects of the invention, as is the entire process.

We claim:

1. A method of concentrating beads in a droplet, the method comprising:

(a) providing a droplet actuator comprising:
  (i) an interior droplet operations volume; and
  (ii) a reservoir exterior to the interior volume;
  (iii) a first substrate;
  (iv) a second substrate separated from the first substrate to provide the interior volume between the first substrate and the second substrate, comprising the reservoir and a liquid path;
  (v) electrodes associated with the first and/or second substrate and arranged for conducting one or more droplet operations in the interior volume; and
  (vi) a magnet providing a magnetic field arranged to attract magnetically responsive beads from the liquid reservoir into the interior volume;

(b) establishing a droplet in the liquid path extending from the reservoir into the interior volume;

(c) providing a first concentration of magnetically responsive beads in the portion of the droplet which is in the reservoir;

(d) magnetically attracting the magnetically responsive beads through the liquid path into the portion of the droplet which is in the interior volume; and (e) forming a droplet comprising a second concentration of magnetically responsive beads in the interior volume, wherein the second concentration of magnetically responsive beads in the droplet formed in the interior volume is greater than the first concentration of magnetically responsive beads provided in the portion of the droplet which is in the reservoir; and (f) conducting one or more droplet operations on the droplet in the interior volume via electrowetting.

2. The method of claim 1 wherein:

(a) the beads are magnetically responsive; and (b) step 1(*d*) comprises magnetically attracting the magnetically responsive beads to a terminus of the liquid path in the interior volume.

3. The method of claim 1 wherein step 1(*e*) comprises breaking the liquid path in a region lacking the magnetically responsive beads to yield a droplet comprising substantially all of the magnetically responsive beads attracted to the terminus of the liquid path in the interior volume.

4. The method of claim 1 wherein the droplet formed in step 1(*e*) comprises substantially all of the magnetically responsive beads provided in the reservoir.

5. The method of claim 1 wherein step 1(*b*) and step 1(*c*) comprise:

(a) providing a liquid comprising the magnetically responsive beads in the reservoir; and (b) flowing a portion of the liquid comprising the magnetically responsive beads into the interior volume to establish the liquid path.

6. The method of claim 5 wherein step 5(*b*) is electrode-mediated.

7. The method of claim 5 wherein step 5(*b*) comprises changing an activation state of one or more electrodes to cause the liquid to flow onto a surface of the droplet actuator bounding the interior volume.

8. The method of claim 7 wherein step 1(*e*) comprises changing an activation state of one or more electrodes to cause the formation of a droplet comprising substantially all of the beads provided in the reservoir.

9. The method of claim 7 further comprising changing an activation state of one or more electrodes to cause the formation of one or more droplets substantially lacking the beads.

10. The method of claim 7 wherein step 1(*d*) comprises magnetically attracting the beads to a terminus of the flow of liquid.

11. The method of claim 10 wherein step 1(*e*) comprises changing an activation state of one or more electrodes to cause the formation of a droplet from the terminus of the flow, the droplet comprising substantially all of the beads provided in the reservoir.

12. The method of claim 7 wherein step 1(*d*) comprises magnetically attracting the beads to an intermediate locus of the flow.

13. The method of claim 12 further comprising changing an activation state of one or more electrodes to cause the formation of one or more droplets from the terminus of the flow, the one or more droplets substantially lacking the beads.

14. The method of claim 1 wherein magnetically attracting the magnetically responsive beads into the interior volume comprises magnetically attracting the beads towards a locus of the interior volume which is substantially opposite an entry point of the liquid path.

15. The method of claim 1 wherein the beads have affinity for a target substance in the liquid.

16. The method of claim 1 wherein:

(a) the liquid comprises a biological sample; and (b) the beads have affinity for a target substance in the liquid.

17. The method of claim 1 wherein:

(a) the liquid comprises a lysis buffer; and (b) the beads have an affinity for one or more target substances from cells lysed with the lysis buffer.

18. The method of claim 1, wherein the second concentration of magnetically responsive beads is at least 2× the first concentration of magnetically responsive beads.

19. The method of claim 1, wherein the second concentration of magnetically responsive beads is at least 5× the first concentration of magnetically responsive beads.

20. The method of claim 1, wherein the second concentration of magnetically responsive beads is at least 10× the first concentration of magnetically responsive beads.

21. The method of claim 1, wherein the second concentration of magnetically responsive beads is at least 50× the first concentration of magnetically responsive beads.

22. The method of claim 1, wherein the second concentration of magnetically responsive beads is at least 100× the first concentration of magnetically responsive beads.

* * * * *